US006745097B2

(12) United States Patent
Kusuzono et al.

(10) Patent No.: US 6,745,097 B2
(45) Date of Patent: Jun. 1, 2004

(54) MANAGEMENT METHOD FOR FIBER PROCESSING AND A MANAGEMENT APPARATUS THEREOF

(75) Inventors: Hiroaki Kusuzono, Ehime (JP); Mitsumasa Sasaki, Ehime (JP); Bunji Hamasu, Ehime (JP); Yoshiharu Imamura, Ehime (JP)

(73) Assignee: Teijin Limited, Osaka (JP)

( * ) Notice: Subject to any disclaimer, the term of this patent is extended or adjusted under 35 U.S.C. 154(b) by 186 days.

(21) Appl. No.: 10/018,664

(22) PCT Filed: Apr. 17, 2001

(86) PCT No.: PCT/JP01/03285

§ 371 (c)(1),
(2), (4) Date: Dec. 21, 2001

(87) PCT Pub. No.: WO01/83348

PCT Pub. Date: Nov. 8, 2001

(65) Prior Publication Data

US 2002/0161470 A1 Oct. 31, 2002

(30) Foreign Application Priority Data

| | | |
|---|---|---|
| Apr. 27, 2000 | (JP) | 2000-127304 |
| May 15, 2000 | (JP) | 2000-141322 |
| May 26, 2000 | (JP) | 2000-156084 |
| Aug. 7, 2000 | (JP) | 2000-238248 |
| Aug. 16, 2000 | (JP) | 2000-246724 |

(51) Int. Cl.[7] ..... G06F 19/00
(52) U.S. Cl. ..... 700/142; 700/143; 57/332
(58) Field of Search ..... 700/142, 136, 700/137, 138, 143; 57/265, 264, 58.86, 332; 226/11, 10, 100; 242/485.2; 112/470.05, 273, 278

(56) References Cited

U.S. PATENT DOCUMENTS

| | | | | |
|---|---|---|---|---|
| 3,858,416 A | | 1/1975 | White | |
| 4,666,096 A | | 5/1987 | Heel | |
| 4,787,198 A | | 11/1988 | Stahlecker | |
| 4,988,050 A | | 1/1991 | Tone | |
| 5,237,944 A | * | 8/1993 | Willenbacher et al. | 112/273 |
| 5,284,008 A | | 2/1994 | Raasch | |
| 5,463,557 A | | 10/1995 | Nakano et al. | |
| 5,566,574 A | | 10/1996 | Tiziano | |
| 5,881,657 A | * | 3/1999 | Asano | 700/138 X |
| 6,199,361 B1 | * | 3/2001 | Yakushi et al. | 57/332 |
| 6,536,643 B2 | * | 3/2003 | Kusuzono et al. | 226/11 |

FOREIGN PATENT DOCUMENTS

| | | |
|---|---|---|
| EP | 0 305 811 A2 | 3/1989 |
| EP | 0 619 261 A1 | 10/1994 |
| JP | 1-127567 | 5/1989 |
| JP | 6-264317 | 9/1994 |
| JP | 6-264318 | 9/1994 |
| JP | 7-133504 | 5/1995 |
| JP | 7-133508 | 5/1995 |
| JP | 7-133534 | 5/1995 |
| JP | 7-138828 | 5/1995 |
| JP | 7-300278 | 11/1995 |
| JP | 9-111557 | 4/1997 |

OTHER PUBLICATIONS

European Search Report (Feb. 9, 2004).

* cited by examiner

*Primary Examiner*—Peter Nerbun
(74) *Attorney, Agent, or Firm*—Rader, Fishman & Grauer PLLC

(57) ABSTRACT

A management method for fiber-processing and a management apparatus thereof, which can detect the occurrences of the selected monitoring events by monitoring the occurrences, can investigate the causes of the occurrences of the events by treating the events so that the factors of the occurrences of the problems can be easily determined whether they are attributable to the problem of the fiber-processing machine itself or the problem of supplied yarn, and can promptly accurately present countermeasures against the problems.

36 Claims, 19 Drawing Sheets

(a)

(b)

(a)

(b)

(a)

(b)

MANAGEMENT METHOD FOR FIBER PROCESSING AND A MANAGEMENT APPARATUS THEREOF

TECHNICAL FIELD

The present invention relates to a management method and a manufacturing apparatus for fiber-processing which can promptly accurately investigate problems of yarns or machines, even going upstream to a fiber forming process, by detecting something wrong from the occurrence of events prescribed as monitoring events, and thereafter by classifying the detected monitoring events during a fiber manufacturing process, a false-twisting process, a yarn twisting process, and others.

BACKGROUND ART

A fiber of a thermoplastic synthetic resin (hereafter, referred to as "polymer") such as polyester, polyamide, and so forth is generally formed continuously into a fibrous state in a fiber forming process (melt spinning process). Subsequently, it is treated in a draw texturing process, a false twist-texturing process, a yarn twist-texturing process and the like, and then, depending on its use, for example, when the textured yarn is to be used as a fiber for clothes, the yarn is supplied to a weaving or knitting machine, or the like.

Here, the abovementioned fiber forming process (melt spinning process) is explained referring to a figure. FIG. 1 is a rough explanatory diagram schematically expressing a melt spinning apparatus 100 to be used in a melt spinning process to produce a partially oriented yarn (POY). In FIG. 1, at first, a polymer, the starting material, is melted in an extruder (not shown in the figure) or the like. Then, the polymer is fed to a spinneret 101 under metering the polymer for prescribed volume by a gear pump (not shown in the figure) or the like in a molten state, the polymer is discharged into a fibrous state through spinning holes having a small diameter drilled in the spinneret 101. Subsequently, filaments Y thus spun in the fibrous molten state are optionally treated for delayed cooling in a heated state with a heating device (not shown in the figure) set up below the spinneret 101, or cooled with cooling air brown on in the direction of the arrowhead in FIG. 1 by a cooling device 102. During this process, the polymer spun in the fibrous state is getting thinned under being in the control of the degree of orientation or the degree of crystallization that is caused by the air resistance during the heating or the cooling, or during the passing through the spinning box 103. Then, after the thinning is completed, an oil is applied on the filaments by an oiling apparatus 104 or the like which is a guide type oiling apparatus having an oil-supplying hole, and it is imparted with an adequate amount of entanglement by an entangling apparatus 105 or the like, and thereafter, if required, the filament is drawn at an adequate draw ratio. And, it is needless to say that the draw ratio is determined by the ratio between the spun speed of the polymer discharged from the spinneret 101 and the speed of rotation of a pair of rotating rollers 106*a* and 106*b*. Subsequently, a winder 107 continuously winds up the filaments Y as a filament packages P1 and P2 one after another. As the winder 107 for winding up the filament into the filament packages P1 and P2 one after another, a known automatic changeover winder can be used. An example of such winder is a turret-type automatic changeover winder in which a pair of bobbin holders are placed on a freely rotatable turret board, and when a fully wound filament package is formed on a bobbin holder, the turret board rotates, and the filaments to be wound are changed over to an empty bobbin placed on the other bobbin holder, and thereby the winding is continuously carried on. The filament packages P1 and P2 and the like which have been wound up in the above process are doffed by an automatic doffing machine (not shown in the figure) or the like. For the filament packages P1 and P2 and the like which have been doffed by the automatic doffing machine (not shown in the figure), managing information (in concrete terms, the number of the manufacturing machine, the number of the position of the manufacturing machine and the number of the doffing machine, or fiber forming management information such as the time of manufacturing) needed in the subsequent fiber-processing treatment is recorded on the management card attached to each package in the form of bar cord information or the like.

It is known that, in a melt spinning process of polymer, filaments consisting of an undrawn yarn (UDY), a partially oriented yarn (POY), a fully oriented yarn (FOY) or the like are obtained by the various conditions such as the kind of the polymer, the melt spinning conditions for heating and cooling the polymer, a winding-up speed, and the like. Further, it is known that the abovementioned filament such as an undrawn yarn (UDY), a partially oriented yarn (POY) or a fully oriented yarn (FOY) is fed to a draw-texturing machine, a false twist-texturing machine, a yarn twist-texturing machine, or the like (hereafter, these apparatus are collectively referred to as "fiber-processing machine") depending on the physical properties of each of the filaments to produce a textured yarn.

As mentioned above, in the manufacturing process of filaments (hereafter, referred to as "yarn"), the yarn Y firstly spun out from the discharging holes of the spinneret 101 receives various forces in the course where it is drawn or twisted as shown above. Naturally, the yarn is heated for thermal plasticization or softening in these texturing processes. Further, whenever the polymer discharged from the spinneret 101 is cooled to solidify, or whenever the thermally plastisized yarn Y is cooled again, thermal stress is generated, and this acts on the yarn. The physical forces, which have been applied in the abovementioned process, are therefore internally stored as stress or strain in a yarn Y that is finally supplied to a fiber-texturing process. Further, the abovementioned factors affect large influence on fiber structure or physical property of fiber such as the degree of orientation or the degree of crystallization of fiber molecules, or thermal stress property. Accordingly, as going down from the melt spinning process to the texturing processes at the downstream side, the yarn has received more physical forces. Due to this, these physical forces also affect the tension of yarn, which is given under the processing of the yarn Y, and it is expressed as a complex force that these combined forces are superimposed to each other.

Under the circumstances explained above, in a conventional method for managing a fiber-processing machine and a conventional apparatus thereof, the tension of yarn is not grasped as a combined force that the various processing factors are superimposed to each other. That is, in a conventional technology, it is extremely difficult to separate and extract the superimposed processing factors from the generated tension while the yarn moves, so that it is not completely expected to realize such separation and extraction.

Now, conventional technologies will be briefly surveyed in the following. At first, in various fiber forming processes, trials to use the tension of yarn for managing the conditions of the process have been proposed. However, these trials are based on a basic technical concept that processing conditions are controlled in order for the tension of yarn to fall into a desirable range that is empirically or experimentally predetermined in each process of various kinds of fiber manufacturing processes.

A false twist-texturing machine that is commonly used for performing POY-DTY processing is cited as a representative example of a fiber-processing machine which embodies the conventional technical concept, and the abovementioned management method and an apparatus for carrying out the management will be explained. Further, needless to say, the following explanation is applicable not only to a false twist-texturing machine but also all of the abovementioned fiber-processing machines. That is, we can make explanation on all of the abovementioned fiber-processing machines without limiting to a false twist-texturing machine; however, such explanation including various matters tends to become complicated, and result in causing troubles for the adequate understanding of the conventional technology, therefore the explanation will be made by limiting the processing machine to a false twist-texturing machine.

At first, the outline of the abovementioned false twist-texturing machine will be explained. In the false twist-texturing machine, a large number of positions (several tens to several hundreds of positions) are commonly parallelly placed in such a state that they are touching to each other. For every position of the false twist-texturing machine having a large number of positions like this, a pair of yarn packages consisting of the partially oriented yarn (POY) obtained in the abovementioned melt spinning process are placed on a yarn supply device 201 which is placed corresponding to each position. The reason why a pair of the yarn packages are placed for every position is that the tail yarn of one yarn package (POY package) and the lead yarn end of the other yarn package (POY package) are tied together beforehand. This enables that, when the whole yarn wound as one yarn package is fed to the false twist-processing, the yarn wound on the other yarn package is unwound to be sent out automatically to the false twist-texturing machine. That is, a pair of yarn packages whose yarn ends are tied together are always prepared on a yarn supply device, and thereby, a yarn is alternately unwound from each package, so that the yarn is continuously supplied to the false twist-texturing machine without interrupting the processing. Finally, false twists are imparted to thus continuously supplied yarn using a false twist-imparting unit, so that the twists are retroacted to the upstream side of the moving yarn, and the retroacted twists are thermally set by a heating device and a cooling device in order to form a false-twisted shape to the yarn.

A false twist-texturing machine constituted in a state shown above is, as is well known, equipped with a number of various treating units such as guide, roller, heating device, or false twist-imparting unit in a section having the whole length of 8–10 m, and the moving yarn is continuously treated with these units. In the false twist-texturing process using the false twist-texturing machine like this, for example, the defects of the fed yarn such as broken filaments or loops, and factors such as yarn breakage or processing defect appear, as shown above, as the variation of tension (especially, untwisting tension) of the yarn under false twist-processing. In the technology disclosed in JP-A 7-138828 (JP-A means Japanese unexamined patent publication), it is proposed that, for a tension of yarn like this, the quality control of the yarn processed by the false twist-texturing machine is performed by monitoring the variation of an untwisting tension with time course.

Further, in the technology disclosed in JP-A 6-264318, it is proposed that the abovementioned untwisting tension is measured by a tension sensor, and according to the result, the quality of the package of the wound up false-twist textured yarn is classified. Further, it is also proposed that a tension controlling means is additionally installed, and the yarn feeding force and the twisting force of a false twist-imparting unit are controlled so that the untwisting tension falls into an objective controlling range.

In the abovementioned conventional technology, it is needless to say that the technical concept only concentrates on falling the untwisted yarn tension into a controlled range during the false-twist-texturing process. The textured yarn package, which does not fall into the management range, is rated to the lower class being regarded as a package whose quality is not guaranteed. However, the result obtained through diligent study for the untwisting tension by the present inventors has confirmed that the level of the untwisting tension widely varies in accordance with the physical properties of the supplied yarn and exhibits abnormal behavior. In the case that a large fluctuation of the tension level or that of the tension value showing an abnormal behavior is observed, there is a high possibility that the supplied yarn has been suffered from some kind of abnormal treatment different from the treatment under usual standard conditions for fiber forming and false twist-processing, during process other than the false twist-texturing process, for example, during the abovementioned melt spinning process or the like.

Nevertheless, compulsive control in order for an untwisting tension to uniformly fall into the management range by a tension controlling means, which is disclosed in the abovementioned JP-A 6-264318, results in overlooking abovementioned abnormal production history in spite that there exists the case where the yarn supplied to the false-twist-texturing process has been treated under some abnormal conditions for fiber-processing or false-twisting. Further, it may result in the worst case where such abnormal yarn is supplied, as it is, to the false twist-texturing process, and the textured yarn is sent to the market as a textured yarn package. The cause of these results may be going back to such a trial that, in the conventional method and apparatus for managing false twist-texturing process, attention is only paid on a momentarily varying untwisting tension in the false twist-texturing process, and the process management is carried out so that the momentarily varying untwisting tension falls into the targeting management range in any event. That is, the abovementioned results are derived from the trial that the conventional techniques manage to control the conditions of the false-twist-processing to the predetermined standard conditions at every point. Further, even in the case where the yarn package supplied to the false twist-texturing process has problems in itself already in the manufacturing stage, the serious problems of the prior arts are that there is absolutely no means to treat them.

Summarizing it, the abovementioned prior arts intend to bring the tension of yarn into the management target value on every process, or on every time when an event occurs. In other words, in the prior arts, problems or the like in fiber forming process and false twist-texturing machine itself with which the yarn package has been manufactured are thoroughly neglected, and the process management is carried out according to a narrow view point that the false twist-processing is carried out in a predetermined standard state.

To the contrary, even going upstream to the fiber forming process such as melt spinning process, the management engineering has not at all been tried to totally manage the problems derived from the yarn itself and the yarn treating machines by surveying whole fiber manufacturing processes. This situation is attributable to the fact that the prior arts do not recognize the technique using the information of the tension of yarn as important information in which various combined forces are superimposed to each other. In addition, it is attributable to the fact that the prior arts cannot provide a means to extract this important information separately. Further, the above explanation has been made by using a false twist-texturing process as an example, but needless to say, in the prior arts, the management which is based on the similar technical concept is performed in other processes such as a draw texturing process and a yarn twist-texturing process.

DISCLOSURE OF THE INVENTION

In the present invention, firstly, a yarn wound up as a yarn package in fiber forming process is supplied to at least one position of a fiber-processing machine, and at the same time, in order to manage the state of processing of the yarn supplied to the fiber-processing machine, monitoring events to be monitored are selected. The monitoring events can be ① variation in a yarn tension under processing, ② variation in a characteristic value which is extracted by uptaking the varying tension values and subjecting the taken up values to fast Fourier transformation (FFT), ③ the occurrence of yarn breakage, ④ the occurrence of broken filaments or loops (hereafter, they are referred to simply as "broken filaments") of a yarn, ⑤ the detection of the changeover of yarn packages (this may be "the detection of the starting point of winding in a yarn package" or "the detection of the passage of a knot tying the tail yarn of a yarn package and the lead yarn end of another yarn package together"), or ⑥ the starting of a doffing machine for doffing a textured yarn package after fiber-processing.

The object of the present invention is to inclusively, surely and speedily perform ① the detection of the abnormal treatment which is suffered in the fiber forming process while the yarn under processing is not supplied to the fiber-processing yet, ② the detection of the problem of a processing machine occurred under yarn processing, ③ the detection of the yarn breakage occurred under processing or the changeover of yarn packages, ④ the detection of the abnormal treatments suffered before processing, ⑤ the detection of the occurrence of yarn breakage and the detection of the point of the yarn breakage under fiber-processing, and the like, by monitoring the abovementioned monitoring events, by detecting the occurrence of the events, and by analyzing the states of the occurrences of the monitoring events. And, the object is to utilize the information accurately obtained from the monitoring events for managing the fiber-processing. For such purpose, it is very important to know that in which position of the fiber-processing machine, in what point or in what processing device of the position, at what point of time, and of what yarn package under fiber-processing, the abovementioned monitoring events have occurred. For such purpose, it is very important to know in which position of the fiber-processing machine, in what point or in what processing device of the position, at what point of time, and during the processing of the yarn wound up at which point of which yarn package, the abovementioned monitoring events have occurred. In the present invention, this is realized by storing the abovementioned monitoring events with time occurred under the processing of the yarn package together with the data specifying the times of occurrences of the events as an operational management database by yarn package under processing and/or by position under processing. Until such a database is prepared, the following countermeasures going back to the fiber forming process cannot be realized. That is, the detection of the problem of a fiber-processing machine itself occurred under fiber-processing; the classification of causes of yarn breakage and the point of the yarn breakage occurred under processing; the detection of abnormal treatments attributable to human causes such as threading miss; the detection of abnormal treatments from which the yarn has suffered in the fiber forming process; and the like. Further, the database enables the prompt and accurate investigation of the causes, and thereby enables the prompt and accurate execution of countermeasures.

The management method for fiber-processing of the present invention is characterized in that it comprises the following basic steps A to D:

A: the yarn wound up as a yarn package in a fiber forming process is supplied to at least one position of fiber-processing machines, and at the same time, in order to manage the state of fiber-processing supplied to said fiber-processing machine, monitoring events necessary for the management is selected, B: each of the selected monitoring events is monitored, and the occurrences of said monitoring events are detected, C: the abovementioned monitoring events occurred during processing of a yarn supplied from said yarn package are chronologically stored together with the data to specify the times of the occurrences of the events by yarn package during processing and/or by position of the fiber-processing machine during processing, and D: fiber-texturing processes or fiber-processing machines are managed by the stored data.

Wherein, regarding yarn tension during fiber-processing by the fiber-processing machine, in order to investigate the causes of the occurred monitoring events, it is preferable to detect the large variation in the tension level of the yarn and the variation in tension value whose behavior is different from the behavior under normal processing conditions as an abovementioned monitoring event, and thereafter store all measured tension data extending over a certain period after the time that said monitoring event detected.

In order to investigate the causes and to promptly accurately take adequate countermeasures, it is preferable to classify the monitoring events according to the abovementioned tension variation into each factor such as yarn breakage, threading, changeover of yarn packages, and monitoring needed variation based on the abovementioned stored data of the measured tension.

Further, in the present invention, the yarn tension under fiber-processing is detected, and the measured signals consisting of said yarn tension are converted into digital signal from analog signal at a prescribed sampling cycle, and regarding the converted data, a moving average value is calculated from a prescribed number of the updated measured data, the obtained moving average value is set as a managing criterion, and in the case where the newest datum of yarn tension is not less than the managing criterion when compared, the tension variation is detected as a monitoring event.

Further, in the present invention, the yarn tension under fiber-processing is detected, the measured signals consisting of said yarn tension are converted into digital signal from analog signal at the prescribed sampling cycle, said digital signals are subjected to Fourier transformation at a prescribed time interval in order to transform them into space signals in a frequency domain, a characteristic value is obtained from the signal components in the specific frequency domain where said space signal has been set up, the obtained characteristic value is compared with the predetermined managing criterion, and in the case where the compared value is not less than the managing criterion, the characteristic value variation is detected as a monitoring event.

Further, in the present invention, plural yarn packages are placed on each position of a fiber-processing machine, and when yarn supply from one yarn package is completed, the yarn packages are changed over so that the yarn can be continuously supplied to the fiber-processing machine from a new yarn package, and in this occasion, said changeover of the yarn packages is detected as a monitoring event.

Further, in the present invention, the start of a doffing machine for doffing a textured yarn package obtained during fiber-processing and/or broken filaments occurred against the yarn during fiber-processing is judged as a monitoring event.

Furthermore, yarn breakage occurred during fiber-processing is judged as a monitoring event, and the point that the yarn breakage occurred is determined by the calculation based on the time when the yarn breakage occurs, the time when the broken end of the yarn passes through a prescribed reference point and the processing speed of the yarn. In this calculation, regarding a yarn breakage occurred as a monitoring event during the fiber-texturing process, the occurred point of the yarn breakage is determined as the wound point from the start point of winding of each yarn package. Then, before they are supplied to the fiber-texturing process, for plural yarn packages obtained under same winding conditions in the fiber forming process, the yarn breakages occurred during the fiber-texturing process are totalized by the wound point, and the result of the totalization is outputted as a yarn breakage occurrence distribution in terms of wound point. Further, the yarn breakages occurrence during fiber-processing are monitored online as a monitoring event, the yarn breakages occurred in a prescribed interval are classified into the yarn breakages whose causes is clear or the yarn breakages whose causes is unclear, and thereafter the classification data are outputted after statistical processing. When the abovementioned yarn breakage of unclear cause occurs, the point of the yarn breakage is determined to enable the speedy investigation of the unclear cause.

In order to carry out the process shown above, it is preferable to construct an operational management database consisting of a position file for recoding the monitoring events occurred to each position of a fiber-processing machine and a yarn package file for recoding the monitoring events occurred to each yarn package. By this process, referring to the abovementioned operational management database, the monitoring events occurred to each position and/or each yarn package can be subjected to a statistical processing, and/or monitoring events can be subjected to a pigeonhole processing. Thus, the result can be outputted, and used for process management.

Further, the monitoring events are processed separately in the following two processing steps, that is, one is a processing step which processes the data online conforming to the occurrence of the monitoring events, and the other is a processing step which executes an analytical processing and/or a statistical processing which is relatively time consuming, and/or a processing having low necessity of immediate processing. This is preferable from the viewpoint of making the management easy, improving the speed of processing, and reducing the cost of processing. Further, the abovementioned management method for fiber-processing can be applied in the case where the fiber-texturing process is a false twist-texturing process, a draw texturing process, a yarn twist-texturing process, or the like.

The basic constituting elements of the management apparatus for fiber-processing in the present invention comprises the following elements of a–c:

a: a monitoring event detector which is placed on each of the positions constituting a fiber-processing machine for detecting the occurrences of monitoring events selected to monitor the state of processing of a yarn at every position during processing.

b: a scanning apparatus for scanning all positions to be monitored so as to detect the occurrence of the monitoring events detected by said monitoring event detector at each position, and c: a managing device for chronologically storing the result of the detection of the abovementioned monitoring events occurred during the processing of the yarn supplied from said yarn package together with the data for specifying the occurred times of the events for each yarn package during processing and/or for each position of a fiber-processing machine during processing.

The abovementioned monitoring event detector contains a broken filament detector for detecting the broken filaments occurred against the yarn during processing. Further, the abovementioned managing device in the present invention is equipped with a device shown below so as to determine the point of the yarn breakage occurred during processing.

That is, a yarn breakage point detector for detecting the yarn breakage as a monitoring event occurred during fiber-processing. Said detecting device comprises a tension detector placed at the reference point so as to detect the tension of a moving yarn by touching the yarn, a yarn breakage occurrence detector for detecting the first moment when the breakage of the moving yarn occurs corresponding to the tension signal from the tension detector, a broken yarn end passage detector for detecting the second moment when the end of the broken yarn passes through the abovementioned reference point corresponding to the tension signal, and a yarn-breakage-point detector for detecting the broken point of the yarn based on the abovementioned first and second moment.

Further, in the present invention, the management apparatus for fiber-processing comprises a tension detector for detecting a yarn tension during processing, and the abovementioned managing device including a Fourier transformer for transforming the tension signals detected by said tension detector into space signals in a frequency domain through Fourier transformation at a prescribed time interval.

Furthermore, said managing device comprises a characteristic value extractor for obtaining a characteristic value from the signal components in the predetermined specific frequency domain related with the abovementioned space signal which has been Fourier transformed, and having a function capable of detecting the characteristic value obtained as a monitoring event in the case where the variation of the characteristic value is not less than the managing criterion when the characteristic value is compared with the predetermined managing criterion. The abovementioned Fourier transformer preferably comprises an A/D (analog/digital) converter for converting the tension signals into digital signal from analog signal, a tension storage device for storing the tension signals digitalized at least at the prescribed time interval and a fast Fourier transformer for transforming the tension signals during a prescribed time which have been stored at the prescribed time interval into space signals in a frequency domain by fast Fourier transform technique.

Further, as the abovementioned monitoring event detector, the management apparatus for fiber-processing is preferably equipped with a yarn package changeover detector for detecting the changeover of the yarn packages from which a yarn can be supplied continuously for processing by tying together the tail yarn of the undergoing yarn package (P1) and the lead yarn of the yarn package (P2) to be supplied for next processing in order to form a crossing yarn at each position of yarn supply devices of the fiber-processing machine. Herein, for reducing the occurrence of troubles in the changeover of yarn packages, it is preferable that the abovementioned yarn package changeover detector is a detector capable of detecting the movement of the abovementioned crossing yarn in a tightened state as the changeover of the yarn package, wherein the crossing yarn has been engaged in a loosened state before the changeover. Further, for the sake of surely detecting the changeover of yarn packages, it is preferable to place a freely movable engaging member which makes the abovementioned crossing yarn apart from the ordinary yarn supplying point and engages it in a loosened state, and a movement detector for detecting the engaging member's movement which is engaged with the movement of the tightened crossing yarn to the ordinary yarn supplying point. Furthermore, the abovementioned movement detector is preferably a limit switch or a photoelectric detector.

By virtue of the excellent detection of the changeover of a yarn package shown above, the corrective calculation of the starting time and the finishing time of processing of each yarn package during processing before and after the changeover can be executed by using the detected changeover signal from the yarn package changeover detectors. Further, the wound point from the start of winding in a yarn package can be calculated by using the detected changeover signal from the yarn package changeover detector. In order to manage each of textured yarn packages separately, which is wound up after fiber-processing, a fully wound textured yarn package is doffed, and thereafter the following textured yarn must be wound up as new textured yarn package. For this purpose, in order to detect the changeover, it is preferable to install at least an interface circuit for uptaking a start-up signal, which is generated by the start-up of a doffing apparatus for doffing the textured yarn package obtained in fiber-processing, and/or a detected signal as a monitoring event from the monitoring event detector.

Further, in the management apparatus for fiber-processing of the present invention, it is preferable to install an A/D (analog/digital) converter for converting the yarn tension signals which have been detected by the tension detector into digital signal from analog signal at the prescribed sampling cycle and a moving average value calculator for calculating a moving average value from the prescribed number of the newest measured tension data that have been converted. Installation of such means enables the detection of the tension variation as a monitoring event in the case where, the newest moving average value calculated by the abovementioned moving average value calculator is set as the managing criterion, and the updated measured tension data captured in the abovementioned A/D converter is not less than the abovementioned managing criterion when the both values are compared.

In the abovementioned management apparatus for fiber-processing of the present invention, the abovementioned managing device is preferably equipped with a yarn breakage classification means which classifies the yarn breakages occurred in the fiber-processing machine into yarn breakages having clear cause whose causes of yarn breakage is clear and that of unclear cause whose cause having yarn breakage is unclear. Further, the abovementioned managing device is preferably equipped with an operational management database consisting of a position file for recording the monitoring events occurred by position of the fiber-processing machine and a yarn package file for recording the monitoring events occurred by yarn package. By this way, the monitoring events occurred by position and/or by yarn package can be treated in statistical processing, and/or the monitoring events can be subjected to pigeonhole processing referring to the abovementioned operational management database, and the result can be outputted after processing into an easily understandable form for a manager. Wherein, it is more preferable that the abovementioned statistical processing is an arithmetic processing related to a chronological distribution of occurrences of the monitoring events and/or an arithmetic processing related to an occurrence distribution regarding the points of the occurrences of yarn breakages in the fiber-processing machine.

PREFERRED EMBODIMENTS OF THE INVENTION

Figure 1:
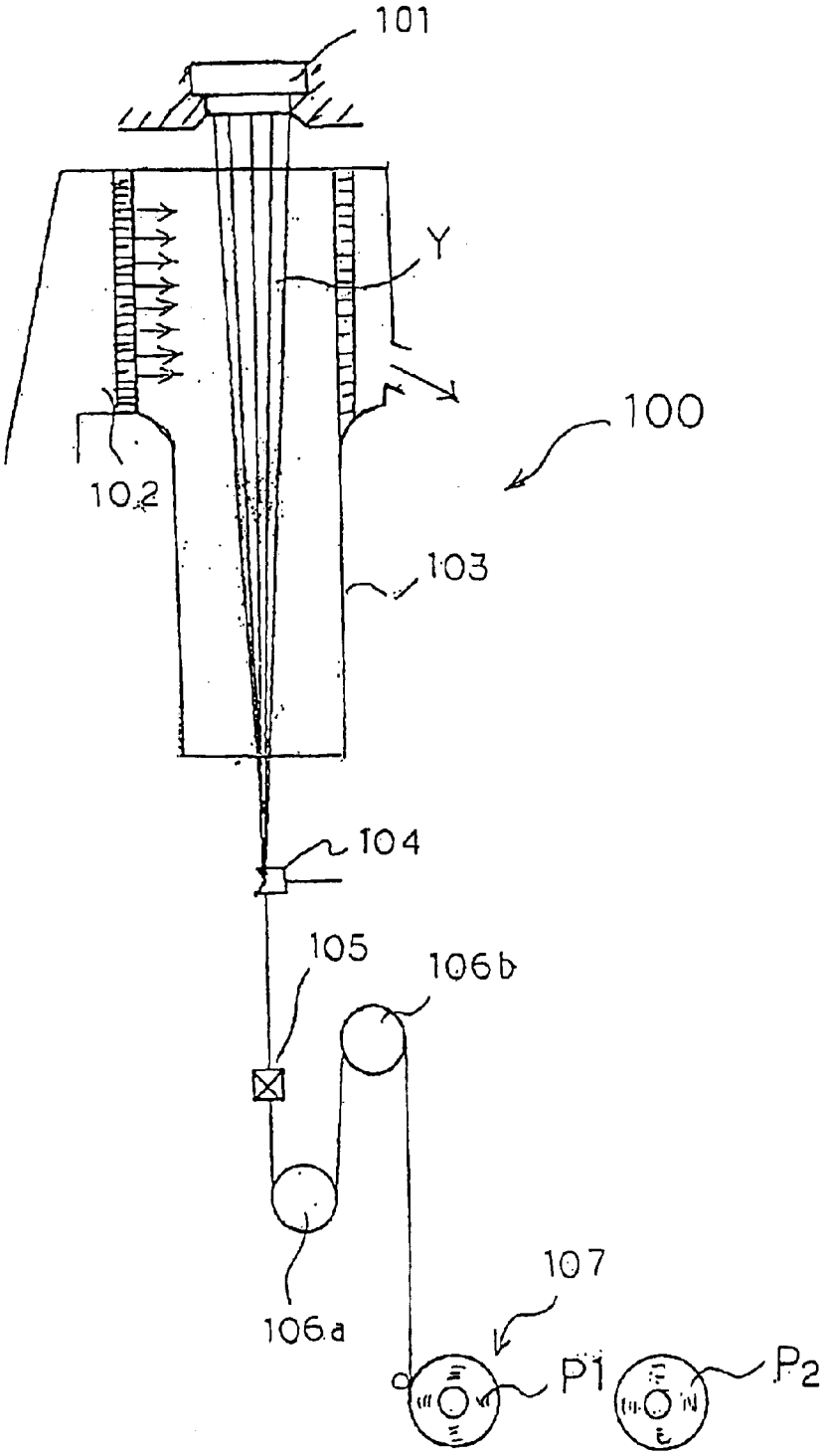
FIG. 1 is a flowchart schematically expressing a fiber forming process (melt spinning process) for producing a yarn package to be supplied to a fiber-processing machine from polymer.

In the present invention, a yarn Y wound up as a yarn package P in the melt spinning process (fiber forming process) exemplified in FIG. 1, as shown above, is supplied to at least one position of a fiber-processing machine such as a false twist-texturing machine, a draw texturing machine, a yarn twist-texturing machine, and so forth. In this case, the process starts with the selection of "monitoring events" needed to manage the state of processing of the yarn Y supplied to the fiber-processing machine. The examples of the monitoring event may be the variation in the yarn tension during processing, the variation in the characteristic value which is obtained from a contribution value of specific frequency components obtained by subjecting the yarn tension to fast Fourier transformation (FFT), the occurrence of yarn breakage, the occurrence of broken filaments or loops of a yarn, the changeover of yarn packages, or the start of a doffing machine for doffing a textured yarn package. Then, the occurrence of such selected monitoring events is monitored, and the occurrence of the monitoring event is detected accurately promptly. And, the present invention is characterized in that the abovementioned monitoring events occurred during processing of the yarn supplied from the yarn package are chronologically stored together with the data specifying the occurred times of the events. The storing is performed by yarn package during processing and/or by position of a fiber-processing machine under processing.

By analyzing the stored monitoring events, the characteristics of the present invention mentioned above are to inclusively, accurately, and promptly carry out the detection of abnormal treatments treated during the fiber forming process before the yarn is supplied to fiber-processing; the detection of the problem of a processing machine occurred during yarn processing; the detection of the yarn breakage occurred during processing and the changeover of yarn packages; the detection of abnormal treatments received before processing; and the like. And, the characteristics are utilized as the information that have been obtained from the monitoring events, for managing fiber-processing through accurate analysis. For such purpose, it is very important to know that on which position of the fiber-processing machine, at what point or on what processing device of the position, at what moment of time, and of what yarn package the abovementioned monitoring events have occurred during processing. In the present invention, for realizing this, it is very important to chronologically store the abovementioned monitoring events occurred during the processing of a yarn package together with the data specifying the times of occurrences of the events by yarn package during processing and/or by position during processing. Until this action is taken, the following can not be realized by going back to a fiber forming process. That is, the detection of the problem of a fiber-processing machine itself occurred during fiber-processing; the classification of the factors of the yarn breakage occurred during processing; the detection of the occurred point of the yarn breakage and an abnormal treatment attributable to human causes such as threading; the detection of the abnormal treatments which the yarn has received during the fiber forming process; and the like. Further, the abovementioned action enables the speedy accurate investigation of the causes, and thereby enables the speedy accurate execution of countermeasures.

The abovementioned embodiments of the present invention will be explained in detail hereafter.

One of the inventors of the present invention found that it is possible in the abovementioned false twist-processing to separately extract important information as a monitoring event by applying frequency analysis technique using fast Fourier transformation (FFT) to the abovementioned untwisting tension, which is a combined force in which various kinds of information are superimposed. Further, he found that the separately extracted monitoring event contains operational problems of a false twist-texturing machine itself and further even the information expressing abnormal treatments in the manufacturing process of a supplied yarn itself. In this case, the inventors of the present invention found the possibility that not only the conditions of false twist-texturing progress is held in the optimum state as in the case of the prior arts, but also the operational state of a specific instrument constituting a false twist-texturing machine, specific properties of the yarn, the state of treatment in the manufacturing process of the yarn, or the like can be taken as the object of "management element" for managing the fiber forming process and the false twist-texturing process.

Figure 2:
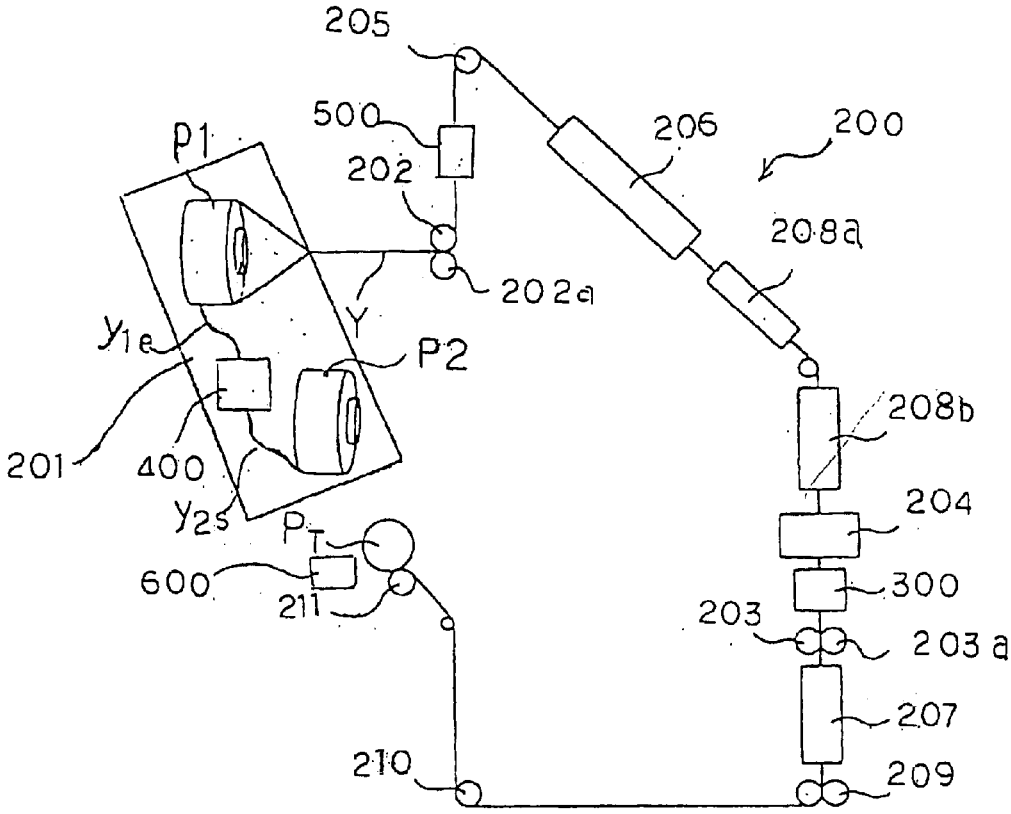
FIG. 2 is a flowchart schematically expressing a false twist-texturing process which treats the yarn package obtained in the fiber forming process shown in FIG. 1 in false twist-processing.

In order to explain this in detail, some extent of knowledge about the false twist-texturing process is required so that the false twist-texturing process is briefly explained here referring to FIG. 2. In FIG. 2, packages of a yarn consisting of a synthetic yarn such as polyester POY (partially oriented yarn) produced in a fiber forming process (refer to FIG. 1), are set on the yarn supply device 201. In the present example, as shown in the figure, a pair of yarn packages P1 and P2 are placed on the abovementioned yarn supply device 201 per position of the false twist-texturing machine 200. In these packages, the tail yarn y1*e* formed on the end of bobbin of one yarn package P1 is tied to the lead yarn end y2*s* guided out from the outermost layer of the other yarn package P2. When the yarn package P is formed using the winder 107 in the fiber forming process shown in FIG. 1, lap winding is once formed at the start of winding on the end of a bobbin. Then, the winding point moves to the central part of the bobbin while forming a transfer tail on the bobbin, where the yarn Y is traversed by a traversing mechanism (not shown in the figure) of the winder 107 to form a yarn wound body. In this process, the abovementioned tail yarn y1*e* is formed as a transfer tail. Further, in the outermost layer part of the abovementioned yarn wound body, bunch winding is formed at the end of winding, and this becomes a lead yarn end y2*s*. In this way, as shown in FIG. 2, when the yarn Y, which is wound on the yarn package P1 under yarn supply on the yarn supply device 201, is exhausted, the yarn package P1 is automatically changed over to the waiting full yarn package P2, and thus the yarn is continuously supplied. Then, the yarn Y is drawn out by the feed roller 202 from the yarn package P1 placed on the yarn supply device 201, and supplied to the main body of the false twist-texturing machine 200. Subsequently, the yarn Y supplied from the yarn supply device 201 is twisted by the false twist-imparting unit 204 placed on the upstream side of the delivery roller 203, and the false twist is retroacted up to the twist setting guide 205. The false twist retroacted up to the twist setting guide 205 is thermally set by the first heating device 206 to impart a false twisted shape. Further, the heated yarn Y is cooled successively by the cooling devices 208*a* and 208*b*. In addition, the second heating device 207 is optionally applied to adjust the physical properties of the textured yarn. Finally, the yarn Y imparted with the false twisted shape is delivered to the winder 211 by the delivery rollers 209 and 210, and it is wound up as a textured yarn package $P_T$ which has been treated in false twist-processing. The winder 211 is constructed in such a state that the doffing of the textured yarn package $P_T$ is commonly performed automatically by the doffing machine 600, and thus a continuous treatment is realized from the supply of the yarn Y through the doffing of the textured yarn package $P_T$.

In the abovementioned FIG. 2, the tension detector 300 is placed on the downstream side of the false twist-imparting unit 204. Further, in FIG. 2, the reference mark 400, which is explained later in detail, is a changeover detector for detecting the changeover of the yarn packages P1 and P2 in which the tail yarn y1*e* and the lead yarn end y2*s* are tied together. The reference mark 500 is a broken filament detector for detecting broken filaments and loops of the supplied yarn Y. As the broken filament detector 500, a product for commercial sale is available. For example, an infrared photoelectric BFD broken filament detector manufactured by Meiners-del Co. (product name: Meiners-del Broken Filament Detector, AMP-type; BFD-ADO-8POS, sensor head type; BFD-A-FCL-DH) or the like can be used. The abovementioned tension detector 300, the changeover detector 400, and the broken filament detector 500 are devices for detecting the occurrence of the monitoring event, and they constitute a monitoring event detector.

Incidentally, in order to classify various kinds of administration information for each yarn package, it is necessary to detect the changeover from the yarn package P1 to the yarn package P2. As mentioned above, in the fiber-processing such as the false twist-processing, when the fiber-processing of one yarn package P1 is finished, the next yarn package P2 is continuously supplied to the fiber-processing. For the sake of finding the starting time of winding in the yarn packages P1 and P2, we must know on what point of time the changeover has been performed between the yarn packages P1 and P2. Under these circumstances, in order to detect the starting point of the winding of the yarn Y, which forms the yarn packages P1 and P2, the inventors of the present invention found that it is necessary to have a method and an apparatus for online detection of knot of the tail yarn y1*e* and the lead yarn end y2*s* linking the yarn packages P1 and P2 to each other.

A prior art capable of achieving the object of detecting the changeover between yarn packages (this may be the detection of "the starting point of winding of a yarn package" or "the passing of the knot") is, for example, a technique disclosed in JP-A 6-32535. This technique judges the occurrence of the changeover between the yarn package P1 and the yarn package P2 when the disappearance of a yarn layer is detected by monitoring the existence of yarn layers on the yarn package P1 or P2 which is supplied to fiber-processing. In this case, the existence of yarn layers is detected by irradiating light along the shaft of the bobbins of the yarn packages P1 and P2 and by judging the existence of the reflection. However, this technique can judge only the lowering of the yarn layer in the yarn package P1 or P2 below a prescribed value, and it is difficult to exactly know the disappearance of yarn layer from the bobbin. It is therefore difficult to exactly detect the timing of changeover between the yarn packages P1 and P2.

Further, JP-A 9-67064 discloses a prior art, that is, in the region of the crossing yarn formed by tying the tail yarn y1*e* of one yarn package P1 and the lead yarn end y2*s* of the other yarn package P2 together, a clip nipping the crossing yarn is placed, and further a pin rod is leaned against the yarn near the clip. According to the technique, the occurrence of the changeover is detected by the falling down of the pin rod leaned against the crossing yarn, which is caused by the movement of the clip together with the crossing yarn when the unwinding of the yarn Y from the yarn package Y1 is finished. Surely, this method of detection is excellent in the point of accurately detecting the timing of changeover. However, in order to hold the clip stably to prevent the accidental coming off from the crossing yarn by some disturbance, the holding power of the clip must be large. In such case, on the contrary, the holding power tends to be too large so that the crossing yarn is hard to come off from the crossing yarn, and a trouble of the untying of the knot occurs in some cases. Further, there is another trouble that, in some cases, the pin rod leaned against the yarn is caught by the yarn, and this also causes the untying of the knot. Under such circumstances, the inventors of the present invention had to newly develop a method and an apparatus which can surely accurately detect the changeover of yarn packages P1 and P2.

Now, the technology of the present invention will be explained briefly. The first item is the detection of the change in which the crossing yarn (hereafter, this is expressed with a reference mark y) formed by tying the tail yarn y1*e* and the lead yarn end y2*s* together is shifted from a loosened state to a tightened state related to the changeover between the yarn packages P1 and P2. In the technology of the present invention, the crossing yarn firstly exists in a state where it is confined within a closed space for holding the crossing yarn y in a loosened state without having any force of constraint applied. Since the crossing yarn y is surely held in the closed space by an engaging member, it does not come out from the closed space. Further, since the crossing yarn is in a loosened state as shown above even during holding by the engaging member, unnecessary force does not work on it. Thereby, the knot of the crossing yarn is not untied, and the crossing yarn is surely held. Then, when the changeover starts at last, the holding part is immediately opened with the tension acting on the crossing yarn, and the crossing yarn is immediately released from the holding part only by the action of this little force. Further, the knot formed on the crossing yarn y runs through the point, which is apart from the engaging member, and no longer touches the engaging member having no obstruction, and thereby the abovementioned problem of the prior arts is dissolved. Further, since the present technique detects the traveling of the crossing yarn y (that is, the movement of the engaging member), the movement is sure, and sure detection is realized.

Hereafter, the present invention for detecting the changeover (passing of the knot) of the yarn packages P1 and P2 is explained in detail referring to a concrete example.

Figure 3:
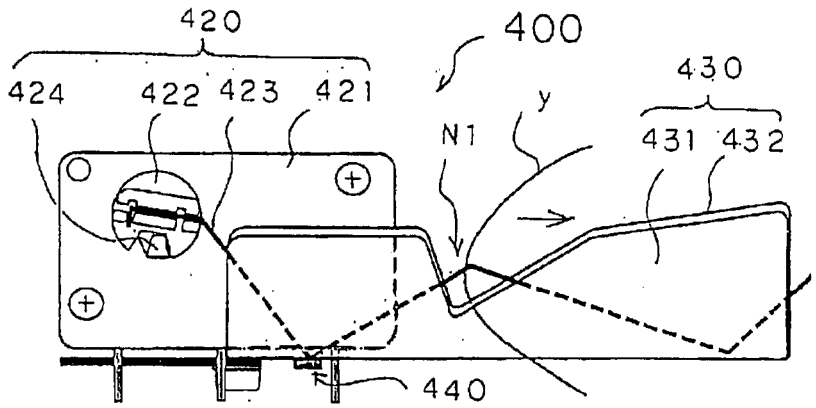
FIG. 3 is (a) a side view and (b) a plan view schematically expressing the engaged states of a limit switch type detector for detecting the occurrence of changeover of yarn packages.
Figure 3:
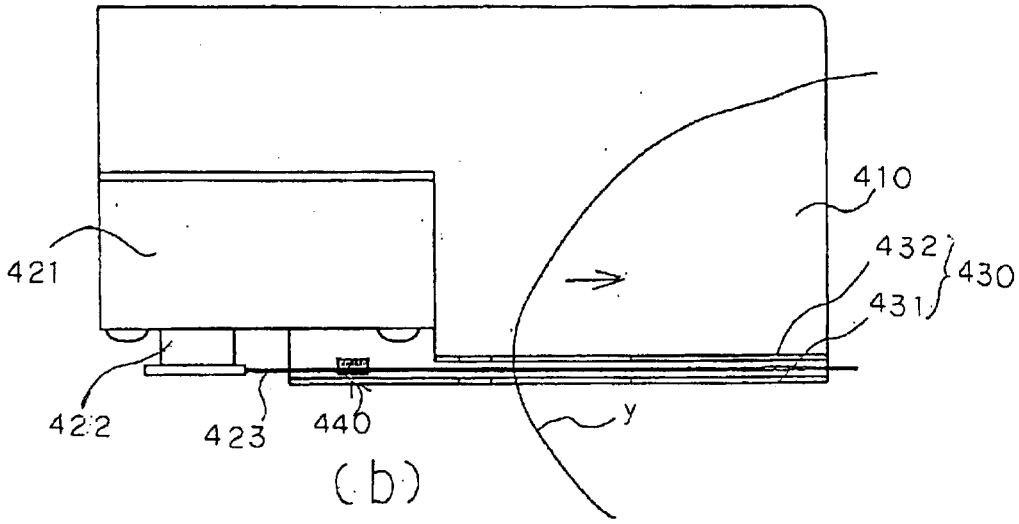
Figure 4:
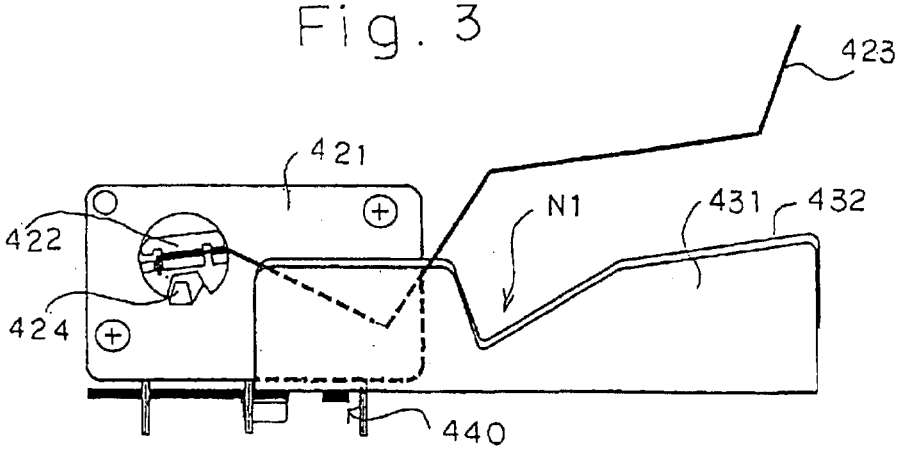
FIG. 4 is a side view schematically expressing the state after shifting from the engaged state of FIG. 3 to a released state.

FIG. 3(*a*) and FIG. 3(*b*) respectively show the side view and the plan view of an example of the limit switch type detector 400 for detecting the occurrence of the changeover of yarn packages, and they schematically show a holding state where a crossing yarn formed with the tail yarn y1*e* and the lead yarn end y2*s*, which are tied together, is set. On the other hand, FIG. 4 is a side view schematically expressing the state where the crossing yarn y is released from the holding state of FIG. 3.

Figure 5:
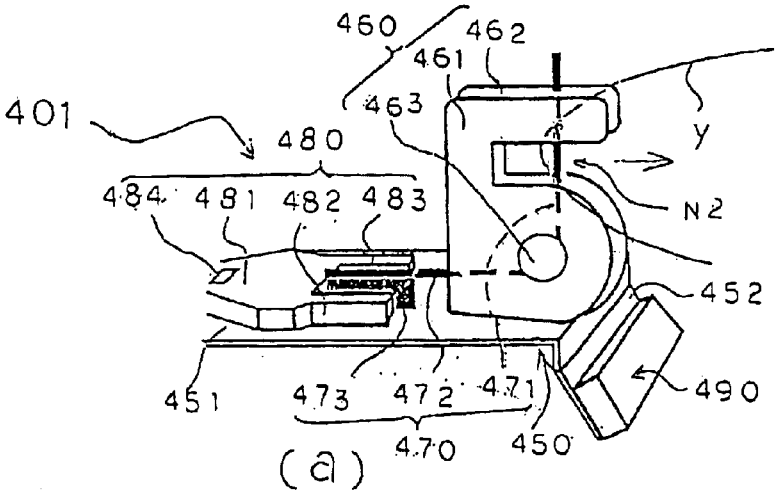
FIG. 5 is (a) a side view and (b) a plan view schematically expressing the engaged states of a photoelectric detection type detector for detecting the occurrence of changeover of yarn packages.
Figure 5:
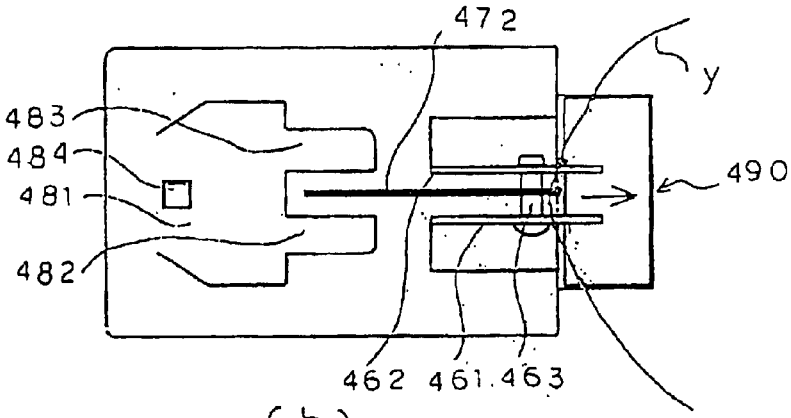
Figure 6:
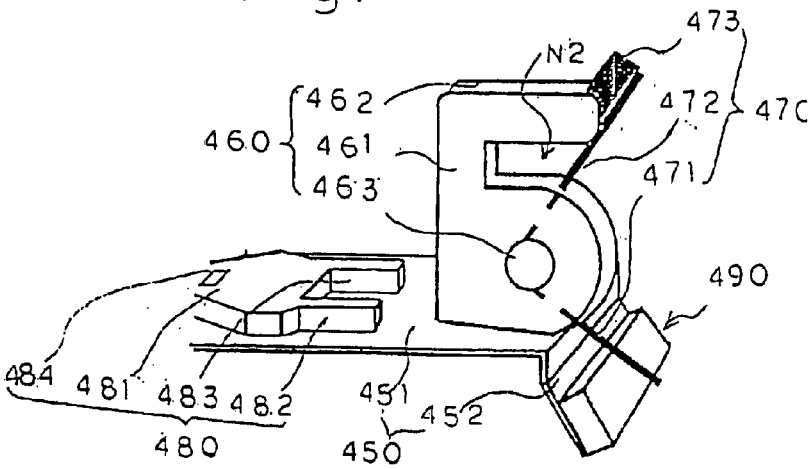
FIG. 6 is a side view schematically expressing the state after shifting from the engaged state shown in FIG. 5 to a released state.
Figure 7:
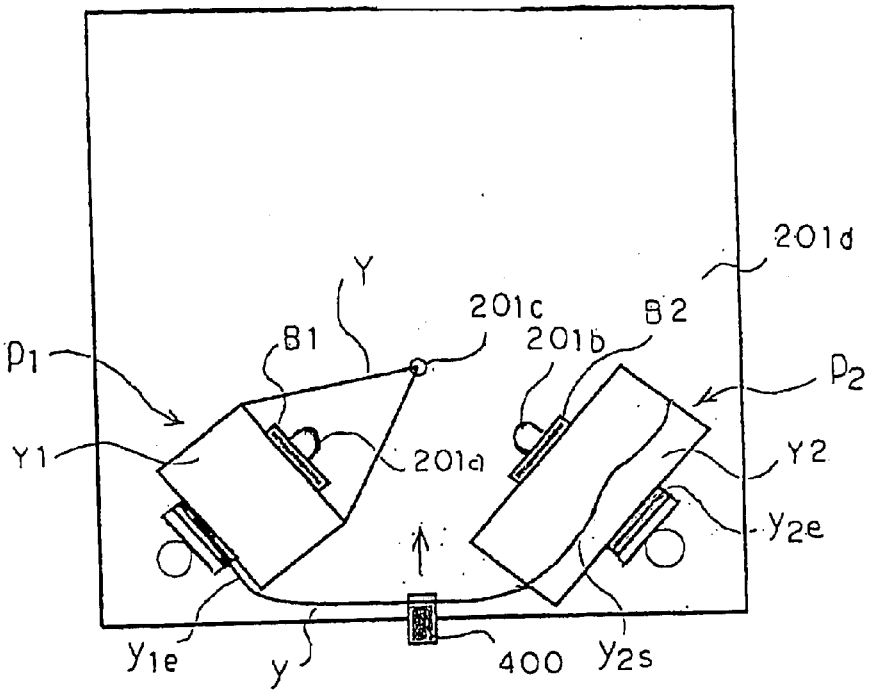
FIG. 7 is an explanatory diagram explaining the action of a changeover detector, and (a) is an explanatory diagram before the changeover and (b) is an explanatory diagram after the changeover.
Figure 7:
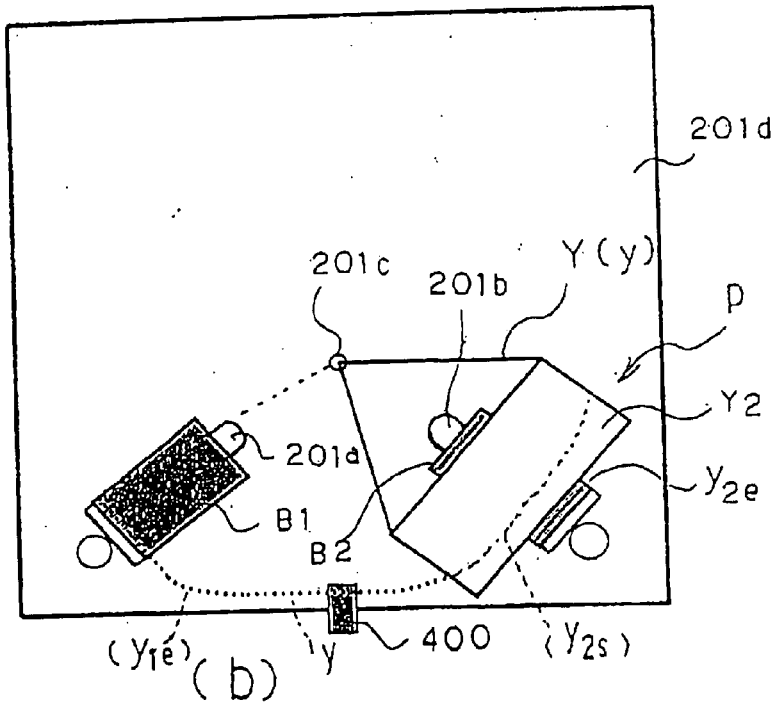

Yet, FIG. 5(*a*) and FIG. 5(*b*) respectively schematically show the side view and the plan view of an example of the photoelectric type detector 401, which is an embodiment different from the limit switch type detector 400, and they show a holding state where the crossing yarn y is set. On the other hand, FIG. 6 is a side view schematically expressing the state where the crossing yarn y is released from the holding state of FIG. 5. Further, FIG. 7 is a schematic diagram explaining the action of the changeover detector 400 for detecting the changeover of the yarn packages P1 and P2 in the yarn supply device 201 of the false twist-texturing machine 200, and FIG. 7(*a*) is a schematic diagram before the changeover and FIG. 7(*b*) is a schematic diagram after the changeover. Yet, the limit switch type detector 400 is exhibited as a representative example of a contact type detector for detecting the moving of the crossing yarn y in a contact system, and the photoelectric type detector 401 is exhibited as a representative example of a non-contact type detector, respectively.

Now, the limit switch type detector 400 shown in FIG. 3 is firstly explained. The basic construction of the detector 400 comprises the basic board 410, the limit switch 420, the holding member 430, and the magnet 440 and a spring (not shown in the figure), and they are fixed on the base board 410 as shown in the figure. Further, the abovementioned limit switch 420 constitutes a movement detector for detecting the movement of the crossing yarn y, and it comprises a main body part 421, a rotary member 422, an engaging member 423, and a point-controlling member 424. In this case, the abovementioned engaging member 423 is made of a linear material attractable by the abovementioned magnet 440. Further, the linear material is bent into a W shape, and one end is fixed on the rotary member 422. On the lower end of the abovementioned rotary member 422, a notch is formed as shown in the figure, and the notch is engaged with the point-controlling member 424. Further, the abovementioned rotary member 422 is controlled by the point-controlling member 424 as shown in the figure, and pivoted on the main body part 421 in a freely rotatable manner either in the normal direction or in the reverse direction in the range between the holding point shown in FIG. 3(*a*) and the released point shown in FIG. 4. The rotation of the rotary member 422 is detected, for example, by the conduction or the interception of an electric signal with the contact point electrically or mechanically formed on the main body part 421. The abovementioned rotary member 422 is energized by a spring (not shown in the figure) in the rotation direction toward the released state shown in FIG. 4, that is, counter-clockwise.

Next, the abovementioned holding member 430 is constructed of a pair of tabular materials 431 and 432, which are apart from each other with a prescribed space and stand on the base board 410 in a state where they are facing to each other as shown in the figure. Further, on the upper parts of the rectangular tabular board materials 431 and 432, V shape notch parts N1 are formed as shown in the figure, and on the notch parts N1, the crossing yarn y is set in a loosened state. The abovementioned magnet 440 is fixed on the board 410 which is shown in the figure, and it holds such a relation that the magnet 410 and the W-shaped bottom part of the abovementioned engaging member 423, which is held in a holding state, attract each other by a prescribed force of constraint.

Further, the abovementioned engaging member 423 is placed in such a manner that it freely comes into or out the space formed with the pair of tabular materials 431 and 432 by themselves. In order to restrict the crossing yarn in the holding state, the W-shaped central mountain part of the abovementioned engaging member 423 and the notch part N1 formed on the tabular materials 431 and 432 are constructed so that they are overlapped to each other. Accordingly, the mountain part at the central part of the engaging member 423 of the limit switch 420 is placed so as to close the upper opening in the notch parts N1 of the tabular materials 431 and 432 of the holding member 430 in the holding state shown in FIG. 3.

In the released state shown in FIG. 4, the crossing yarn y is therefore placed on the notch part Ni of the holding member 430, and in order to close the upper opening of the notch part Ni with the engaging member 423, the engaging member 423 is rotated until the holding point shown in FIG. 3(*a*) to make the holding member be attracted by the magnet 440. Thus, the crossing yarn y is surely trapped in the holding part of the closed space formed by the notch part N1 of the holding member 420 and the central mountain part of the engaging member 423. Thereby, even if the shaking of yarn or the like, which is caused by shocks generated in a yarn supply work or the like, or outer air flow, acts on the crossing yarn, the crossing yarn is not released from the abovementioned closed space. Further, the crossing yarn y is trapped not completely, but it is held in a state where it can freely move as shown in the figure, and needless local strain is not generated on the crossing yarn y, and thereby the troubles such as untying of knot or the like is not observed. Further, needless to say, the engaging member 423 is hidden in the space formed by the tabular boards 431 and 432 in the holding state as shown in the figure, and a setting miss and non-setting of the crossing yarn y therefore can be easily found by glancing the state.

In the changeover detector 400 constructed as shown above, when the opportunity of the changeover from the yarn package P1 to the yarn package P2 comes at last, tension acts on the crossing yarn y set in the slacken state shown in FIG. 3(*a*), and the crossing yarn y gets tightened. The tightened crossing yarn y is pulled in the direction shown by the arrowhead and goes up the slop forming the notch N1 of the holding member 430. At the same time, the engaging member 423 is pushed up by the tightened crossing yarn y, and it is released from the restraint of the magnet 440. The engaging member 423 is then rotated at a stroke to a released state shown in FIG. 4 by the abovementioned spring (not shown in the figure) energized in the releasing direction (anticlockwise). Since released at a stroke by the tightened crossing yarn y in this manner, the engaging member 423 is released without causing such troubles that the knot formed on the crossing yarn is caught by the holding part and further unreasonable damages are given on the crossing yarn y.

The concrete example of the limit switch type detector 400 was explained above, and a concrete example of the photoelectric type detector 401 is next explained referring to FIG. 5 and FIG. 6.

As shown in FIG. 5(*a*) and FIG. 5(*b*), the photoelectric type detector 401 has the basic construction which comprises the base board 450, the holding member 460, the linear rotation member 470, the photoelectric detector 480 and the magnet 490. As shown in the figure, the abovementioned base board 450 comprises the main body part 451 and the bent part 452 which is bent downward in front of the main body part. As shown in the figure, the holding member 460 is placed on the front part of the main body part 451, and the photoelectric detector 480 is placed on the rear part. The magnet 490 is fixed on the bent part 452. The abovementioned photoelectric detector 480 constitutes a movement detection device for detecting the traveling of the crossing yarn y. The abovementioned holding member 460 comprises a pair of tabular members 461 and 462 of a symmetrical shape and the shaft 463. The abovementioned pair of tabular members 461 and 462 is fixed on the base board 450 with a prescribed space between them, and the rectangular notch part N2 is formed from the front edge toward the backside. Further, the abovementioned linear rotation member 470 comprises the engaging member 471 formed in an L-shaped bent state and the shading member 472, and the shading weight 473 is fixed on the head of the shading member 472. The abovementioned shaft 463 is fixed between the abovementioned pair of tabular members 461 and 462 in a state where both the ends of the shaft are supported. The abovementioned linear rotation member 470 is freely rotatable in either of the normal or reverse direction in the space formed by the pair of tabular members 461 and 462 centering on the shaft 463. The abovementioned notch part N2 forms a closed space whose opening at the front end is closed with the engaging member 471, and the crossing yarn y is stably held in the closed space in a loosened state until the changeover of the yarn packages P1 and P2 starts. On the other hand, the shading member 472 of the linear rotation member 470 acts on the photoelectric detector 480 and detects the changeover of the yarn packages P1 and P2.

This will be explained further in detail. The abovementioned photoelectric detector 480 has a construction comprises a main body part 481, a light projecting part 482, and a light receiving part 483 that are placed on both the lateral ends of the main body part 481 with a specific space between them, and the signal lamp 484. A light emission element and a photodetector element (not shown in the figure) are placed on the abovementioned light projecting part 482 and light receiving part 483, respectively, in such a state that they are facing each other and protruding forward. Accordingly, they have a structure allowing the shading member 472 of the abovementioned linear rotation member 470 to come into between the light projecting element and the light receiving element arranged in a facing state. The shading member 472 takes a state of hanging down on the base board 450 having itself down side by the gravity acting on the shading weight 473 placed on the head of the shading member 472. This state is held until the occurrence of the changeover of the yarn packages P1 and P2. In this manner, the shading weight 473 performs the duty of sure blocking of the light projected from the light projecting element so that the light projected from the light projecting part 482 of the photoelectric detector 480 does not reach the light receiving part 483 until the occurrence of the changeover of the yarn packages P1 and P2. This example is related to the detector 401 of a light transmission type, but it may be a detector of a light reflection type in which a light projecting element and a light receiving element are placed side by side, the light which is projected from the light projecting element is reflected by the shading weight 473, and the reflected light is detected by the light receiving element.

Next, when a changeover of the yarn packages P1 and P2 occurs, tension acts on the crossing yarn y held in a loosened state shown in FIG. 5(*a*), and the crossing yarn y is shifted to a tightened state, and thereby the crossing yarn y travels in the direction of the arrowhead shown in the figure. At the same time, the engaging member 471 is pulled by the crossing yarn y in the direction of the arrowhead. By this, the linear rotation member 470 rotates anticlockwise at a stroke, and thereby the opening, of the notch part N2, which has been closed with the engaging member 471 is released, and the crossing yarn y is released from the closed space. Also the shading member 472 rotates, and as a result, the light from the light projecting element, which has been blocked by the light shading weight 473, reaches the light receiving element. The changeover from the yarn package P1 to the yarn package P2 is detected by detection of the reached light. Yet, due to the inertia force attributable to the weight of the shading weight 473, the engaging member 471 rotates at a stroke to the released point shown in FIG. 6, and it is surely attracted by the magnet 490. Accordingly, the linear rotation member 470 is free from the turning over due to reaction or the like in rotation, and it is surely held on the released point. Furthermore, since the crossing yarn y is released at a stroke, there is no trouble of catching the knot. Further, no unreasonable damages are given on the crossing yarn y, and the crossing yarn y is smoothly released from the closed space.

Yet, in the released state shown in FIG. 6, when the crossing yarn y is inserted into the notch part N2 of the holding member 460, the shading member 472 is also pushed into the notch, and at the same time, the engaging member is released from the restraint of the magnet 490, and the shading member 472 is further pushed in. Then, by the self-weight of the shading weight 473 placed on the head of the shading member 472, the linear rotation member 470 automatically rotates, and it returns to the engaged state (the crossing yarn is trapped in the closed space) shown in FIG. 5(*a*) mentioned at the beginning. Thereby, even if the shaking of yarn or the like, which is caused by shocks generated by the job or the like in the yarn supply device 201, or outer air flow, acts on the crossing yarn, the crossing yarn does not come off from the holding member 460. The crossing yarn y is held by the holding member 460 in a loosened state, so that the crossing yarn y can freely travel, and needless local strain is not generated on the crossing yarn y, and thereby no troubles such as untying of knot or the like are observed. Further, the photoelectric detector 480 is equipped with the signal lamp 484 as shown in FIG. 6, and the photoelectric detector 480 is designed so that the signal lamp 484 is lighted when the crossing yarn y is got engaged. Non-setting of the crossing yarn y into the detector 401 therefore can be found by affirming the lighting of the signal lamp 484.

When the changeover signal from the yarn package P1 to the yarn package P2 is surely detected as shown above, the next necessary step is smoothly unwinding the yarn Y from the yarn package P2, which has been changed over, and supplying it to the false twist-texturing machine 200. Now, regarding this point, the changeover operation of the yarn packages P1 and P2 will be explained using a concrete example referring to FIG. 7.

FIG. 7 shows the yarn package change-over detector including the abovementioned limit switch type detector 400 or photoelectric type detector 401, in which both types of the changeover detectors for yarn package are shown with the newly unified reference mark 400. The yarn packages P1 and P2 are constituted of bobbins B1 and B2, and wound yarn bodies Y1 and Y2, respectively. Tail yarns y1*e* and y2*e* are formed on the ends of bobbins B1 and B2, respectively, as a transfer tail in the winding process of the fiber forming process (melt spinning process) exemplified in FIG. 1. As shown in FIG. 7, the yarn supplying apparatus 201 of the false twist-texturing machine 200 is equipped with creels 201*a* and 201*b* holding the yarn packages P1 and P2, respectively, and a pair of changeover detectors 400 are placed on the partition plate 201*d* placed under the yarn supplying apparatus 201. Further, the yarn supplying apparatus 201 is equipped with the suction pipe 201*c* for sucking the yarn Y. Accordingly, by sucking the end of the yarn Y with the pipe, the yarn Y can be supplied to the feed roller 202 of the false twist-texturing machine 200 or the like. On start of the operation of the false twist-texturing machine 200 or on occurrence of yarn breakage, threading is carried out in this manner. Needless to say, in this case, the tail yarn y1*e* of the yarn package P1 and the lead yarn end y2*s* of the yarn package P2 are tied together, and a crossing yarn y of a loosened state is formed. Further, it is also needless to say that the crossing yarn y is pulled in the direction of the arrowhead shown in FIG. 7(*b*) to take a tightened state when the yarn package P1 is changed over to the yarn package P2. Accordingly, it is a matter of course that the abovementioned changeover detector 400 is placed considering the behavior of the crossing yarn y on occurrence of the changeover of the yarn packages P1 and P2.

Now, regarding FIGS. 7(*a*) and (*b*), it will be explained further in detail. FIG. 7(*a*) shows the state that the yarn Y is already a little unwound from the yarn package P1, and the unwound yarn Y is supplied to the main part of the false twist-texturing machine 200 via the pipe 201*c*. Thus, the unwinding of the yarn Y proceeds, and when the wound yarn body Y1 on the bobbin B1 is exhausted, the yarn package P1 is changed over to the yarn package P2 via the crossing yarn y as shown with a dotted line in FIG. 7(*b*), and as a result, a yarn is unwound from the wound yarn body Y2 on the bobbin B2, and it is supplied to the false twist-texturing machine 200. At this time, the bobbin B1 left on the creel 201*a* is removed, a new yarn package (not shown in the figure) is placed, and a new crossing yarn y is formed by tying the tail yarn y2*e* of the yarn package P2 and the lead yarn end of the new yarn package (not shown in the figure) together with a known yarn tying device (not shown in the figure). Thus formed new crossing yarn is set on the changeover detector 400, and false twist-texturing progresses without having interception through the alternative changeover of yarn packages.

By using the method for detecting the occurrence of the changeover of yarn packages shown above, and also by using the detector 400 for performing it, the changeover from the yarn package P1 to the yarn package P2 can be surely detected. The fact that said detector becomes possible means, in other words, that the sure detection of the winding start-point (passing of the knot) in the yarn packages P1 and P2 has become possible. Thus, the present inventors have developed a technique that can specify the point of time when a monitoring event has occurred based on the abovementioned winding start-point when any monitoring event to be monitored is detected during processing of the yarn Y supplied from the yarn package P1 or P2.

Subsequently, by using also the technique developed by the present inventors, the information showing the treatment problem in the production process of the yarn itself which is actually supplied to the false twist-texturing process, and further the operation problem of the false twist-texturing machine 200 itself can be clearly separated and extracted by yarn package supplied to processing. Hereafter, the example of the monitoring event separated and extracted from the untwisting tension at the exit side of a false twist-imparting unit by using frequency analysis technology according to fast Fourier transformation (FFT) is explained.

Figure 8:
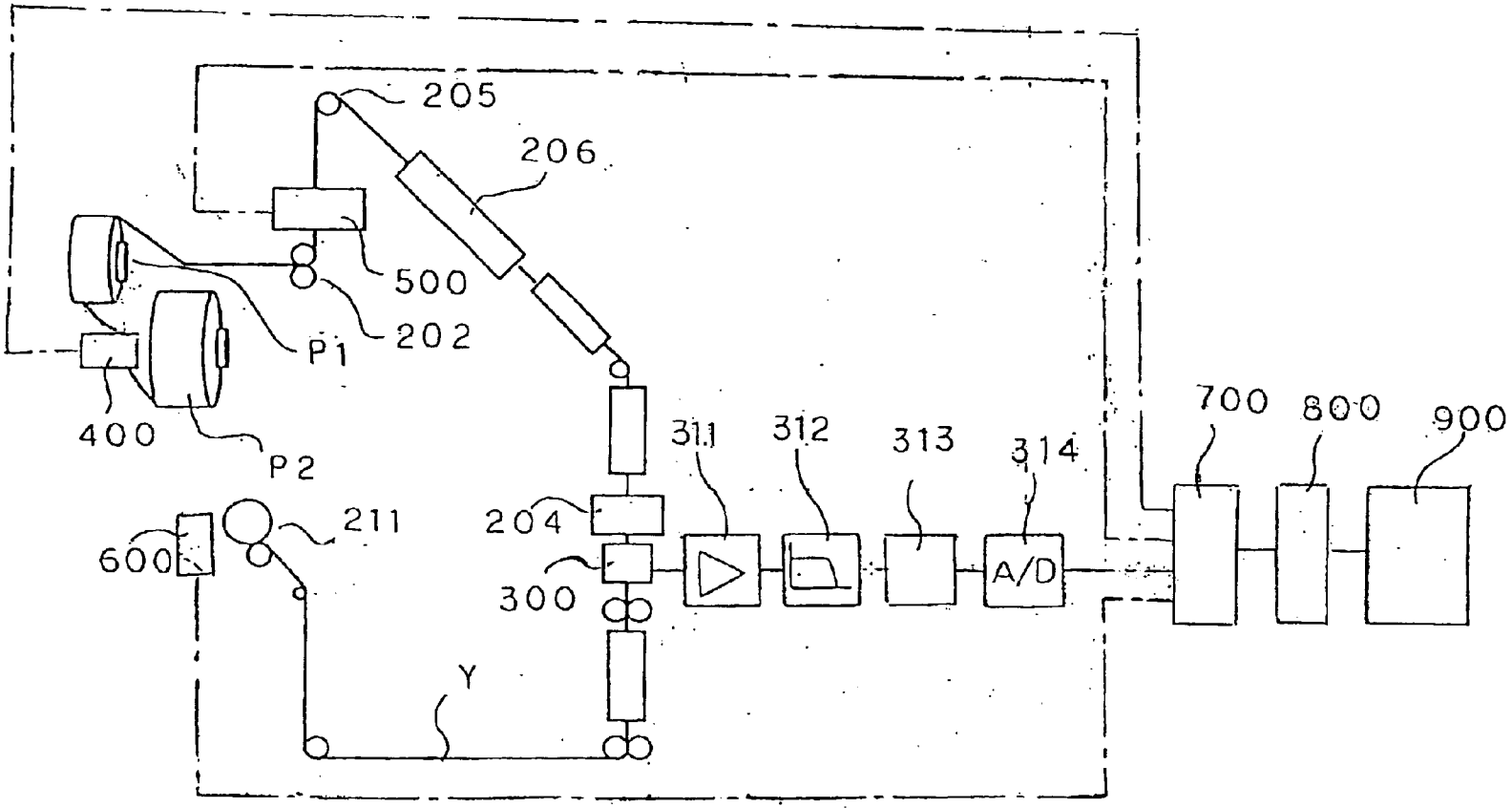
FIG. 8 is a block diagram schematically expressing management apparatuses of the present invention.

FIG. 8 exemplifies the construction and the like for analyzing the untwisting tension through FFT processing, and it is a block diagram showing the construction of the management apparatus of the present invention. In the figure, the untwisting tension signals (analog signals) chronologically detected online by the abovementioned tension detector 300 are converted into electric signals. The untwisting tensions are amplified by the amplifier 311, and subsequently they are pre-treated in order to remove various unnecessary noises with the filter apparatus 312. Thus pretreated untwisting tension signals are scanned for each position of the false twist-texturing machine 200 by the scanning device 313, and they are taken in as analog signals. Subsequently, the taken-in analog signals are digitized and quantumized (converted into digital signals) at a prescribed sampling interval with the A/D converter (analog/digital converter) 314. Further, the sampling interval, as widely known, is selected according to sampling theorem in such a manner that significant information is not lost from the tension signals. Then, the converted tension signals are inputted through the interface circuit 700 into the decentralized management unit 800 placed on every machine and comprising computers which manage said machine. Further, in the decentralized management unit 800, the abovementioned tension signals are transformed from time domain data to the frequency domain data by a means (not shown in the figure) for fast Fourier transformation (FFT). Through this process, the abovementioned tension signals are converted into space signals in a frequency domain, a characteristic value is obtained from the signal components in the specific frequency domain where the space signals are set, and the obtained characteristic value is compared with a predetermined managing criterion. When the compared value is not less than the managing criterion, a monitoring event is detected as the variation of the characteristic value. In order to output finally on a display (not shown in the figure) or to perform further precise analysis, the result thus obtained is inputted into the central management unit 900 comprising a high-ranked computer, or in some case, it is outputted through a recording medium or through papers printed by a printing means, and thereafter the existence of a problem is judged by the result. In this manner, the central management unit 900 has such a function to store and accumulate the data and further analyze the information.

The output signal from the changeover detector 400 set for the yarn package of each position and that from the broken filament detector 500 are directly inputted into the decentralized management unit 800 via the interface circuit 700 as the pulse signals (digital signals) expressing the occurrence of the changeover of the yarn packages P1 and P2, and the existence or absence of broken filaments. Further, the start signal of the doffing apparatus 600 is also inputted into the decentralized management unit 800 as a digital signal in the same way via the interface circuit 700. The start-up signal for starting up the doffing-apparatus 600 may be inputted from a keyboard or the like in such a manner that the operator manually inputs the time when the doffing apparatus 600 has actually started. However, from the viewpoint of automation, reliability, or the like, it is preferable to have the system of the present example that the start-up signal for starting the above doffing apparatus 600 is branched, and the branched signal is directly inputted into the interface circuit 700 in order to improve the workability and the accuracy of the treatment.

The decentralized management unit 800 is connected to the upper-ranked central management unit 900, which is common to plural decentralized management unites 800. By doing this, the processing which needs relatively long time for analysis or has lower necessity of real-time processing are processed by the central management unit 900. The hierarchical structure like this realizes high speed processing such as recoding of data required to online processing.

Figure 9:
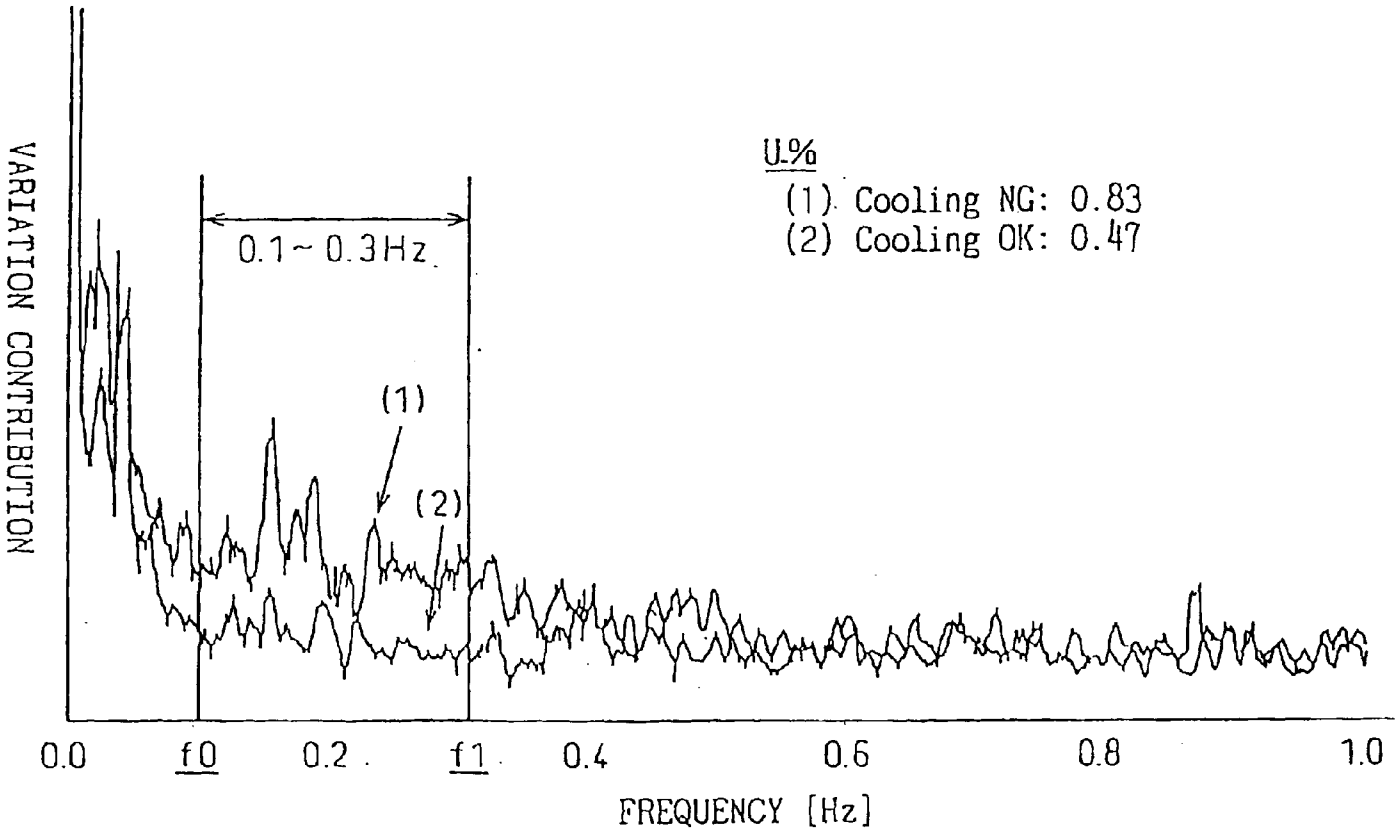
FIG. 9 is a concrete example obtained by analysis of the cooling problem of a yarn Y by cooling wind blown out from a cooling device 102 as the abovementioned monitoring event through fast Fourier transformation (FFT) in a melt spinning process.
Figure 10:
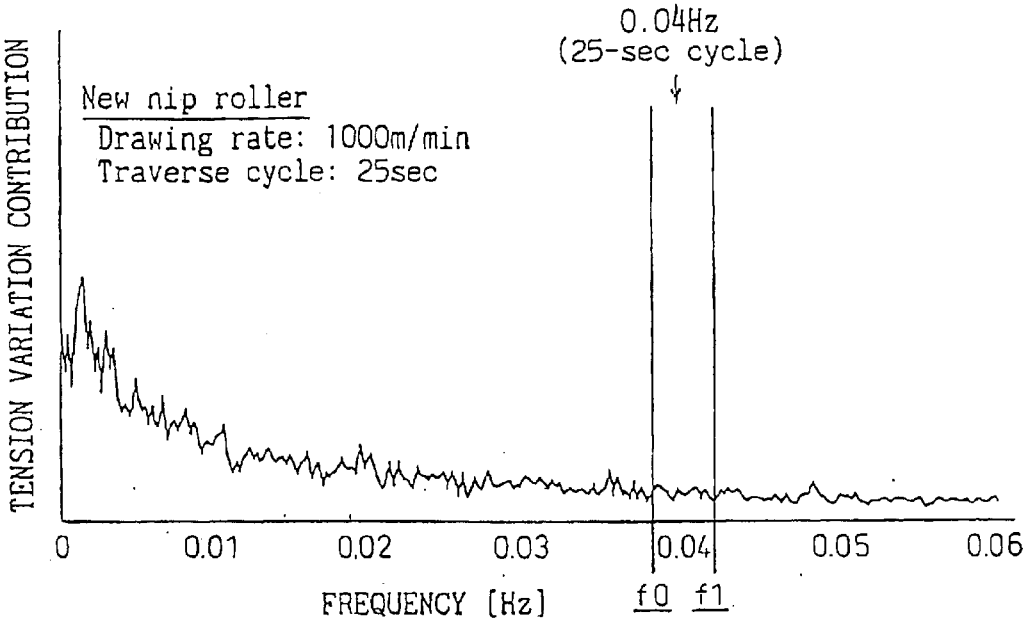
FIG. 10 is a normal example obtained by analysis of the nip roller abrasion of a delivery roller regarding a false twist-texturing machine as a monitoring event.
Figure 11:
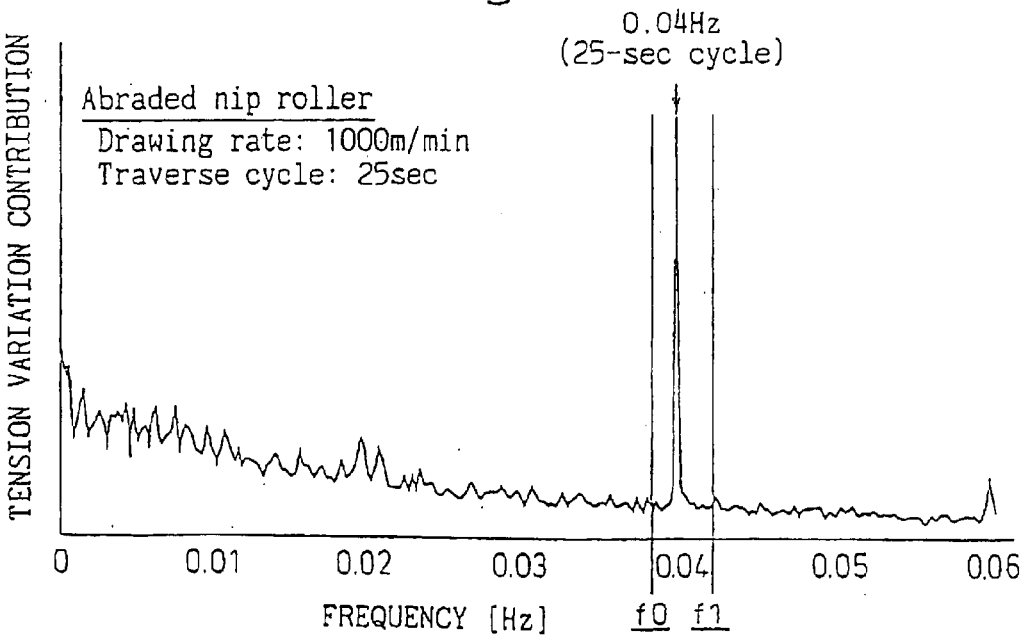
FIG. 11 is an abnormal example obtained by analysis of the nip roller abrasion of a delivery roller regarding a false twist-texturing machine as a monitoring event.

Next, FIG. 9 is a figure exemplified a concrete example in which various kinds of valuable information derived from an untwisting tension, which is a combined force overlapping the influences of thermal stress, frictional force, tensile force, twisting force, and the like, have been separated and extracted. Further in detail, it is a concrete example that is analyzed as the abovementioned monitoring event by analyzing the cooling problem of a yarn Y that is cooled by the air blown out from the cooling device 102 in the abovementioned melt spinning process shown in FIG. 1. Yet, in FIG. 9, Graph (1) is the case where the problem has occurred in the fiber forming process for the yarn supplied to the false twist-texturing process, and Graph (2) is the case where the yarn has been produced under normal conditions. FIG. 10 and FIG. 11 show an example that is analyzed as a monitoring event related to the operational problem of the false twist-texturing machine 200 itself, in concrete terms, the roller abrasion regarding the abrasion of the nip roller 203*a* of the delivery roller 203.

At first, FIG. 9 shows the case of fast Fourier transformation in the case where attention is paid to the U % problem (the problem regarding unevenness of filament fineness in the longitudinal direction of the yarn) of the yarn Y supplied to the false twist-texturing process attributable to cooling failure in the melt spinning process (fiber forming process) shown in FIG. 1. As the specific frequency band in order to monitor the cooling failure in the spinning process regarding the yarn Y supplied to the false twist-texturing process, namely, as the management range, the range of the frequency domain of 0.1 Hz (f0) to 0.3 Hz (f1) shown in FIG. 9 is set. For an integrated value (area value) or a peak value in the range of the frequency band of f0 to f1, which had been set as the management range, the managing criterion were predetermined. In the present example, the integrated value (area value) was selected as the managing criterion, and 0.6 was set as the value. Further, in this case, the speed of processing and the draw ratio of the false twist-texturing machine 200 were 1000 m/min and 1.795 times, respectively. Yet, the yarn Y supplied to the false twist-texturing machine 200 was melt-spun by ordinary method, at 3000 m/min roughly according to the melt spinning process shown in FIG. 1. The fineness of the partially oriented yarn (POY) obtained at this point was 140 dtex (125 de). In concrete examples of a false twist-processing using the false twist-texturing machine 200 explained later, these conditions are used unless they are particularly noted.

False twist-processing was applied in this manner, and the untwisting tension of the yarn Y discharged from the false twist-imparting unit 204 was measured online by the tension detector 300 shown in FIG. 2, and the untwisting tension was analyzed by fast Fourier transformation means shown in FIG. 8. The U % of the case (1) of the cooling failure by the cooling device 102 in the melt spinning process was 0.83, and the case (2) of appropriate cooling was 0.47. In this manner, the obtained integrated value (0.83) is compared with the predetermined managing criterion (0.6). When the integrated value exceeds the managing criterion, it can be jugged that the yarn supplied to the false twist-texturing process caused the problem of the U % in the spinning process. That is, if the result (the integrated value of U % is 0.83) is such as shown in Graph (1) of FIG. 9, it is jugged that the cooling conditions in the spinning process for the supplied yarn have been incomplete (NG) and the result is inputted into the upper-ranked computer (not shown in the figure) or outputted to the display 302; however, if the result (the integrated value of U % is 0.47) is such as shown in Graph (2) of FIG. 9, it is considered that the supplied yarn Y has been spun under normal cooling conditions (OK) since the obtained result is smaller than the predetermined managing criterion (0.6).

Further, the problem against the amount of oil adhered to the yarn Y in the oil applying apparatus 104 can be detected as another managing event. For example, they are U % characteristic value and OPU (the criterion of the amount of adhered oil) characteristic value, which are obtained by integrating the components in the second specific frequency region, 0.6–1.4 Hz, whose relationship with OPU has been confirmed. Other treatment problems in the fiber forming process, for example, the variation in throat pressure in the case of supplying a polymer to the spinneret 101, the problem of the winding width of a yarn package P, or the like can mention as a monitoring event regarding characteristic value variation to judge the problem.

Heretofore, examples of the analysis of a monitoring event related to the problem of a characteristic value variation in the fiber forming process (melt spinning process) for producing the yarn packages P1 and P2 supplied to the false twist-processing; however, problems occurred in the false twist-texturing machine 200 itself also can be analyzed as a monitoring event based on the variation in characteristic value.

FIGS. 10 and 11 are exactly the results of the analysis shown above, and they are graphs showing the examples of fast Fourier transformations in the case where attention is paid on the abrasion problem of a nip roller 202*a* placed on the yarn feeding roller 203 or the like of the false twist-texturing machine 200. In the figures, FIG. 10 shows the case where the nip roller 203*a* is a new one free from abrasion. FIG. 11 shows the case where the nip roller 203*a* which is abraded (the amount of abrasion, 900 to 60 $\mu$m). The processing speed of the false twist-texturing machine 200 is 1000 m/min. Yet, in the nip roller 203*a*, the yarn Y is traversed in its width direction at a traverse interval of 25 sec. This is done to reduce the amount of the abrasion of the nip roller 202*a* by changing the holding point of the yarn Y by the nip roller 203*a*. Under these circumstances, since the traverse frequency is 25 sec, the specific frequency band f0 to f1 for monitoring the abrasion of the nip roller is set in the range of 0.038 to 0.042 Hz with the center of 0.04 Hz. Then, the integrated value (area value) of the contribution of the variation in tension to each frequency in the specific frequency band form f0 to f1, or the peak value in the contribution of the variation in tension in the band are obtained as a pattern in order to compare it with the pattern of managing criterion. Subsequently, the obtained pattern is compared with the predetermined pattern of managing criterion (for example, a managing criterion of a integrated value or a peak value). By doing this, if a peak value exceeding the managing criterion shown in FIG. 11 is obtained, it is judged that the amount of the abrasion in the nip roller 203*a* of the false twist-texturing machine 200 is increased, and the result is inputted into the higher-ranked computer (not shown in the figure), recorded in a recording medium such as floppy disk or hard disk, outputted into a display 320, or in some cases printed on paper. Examples of a mechanical factors to be detected as these problems in the false twist-texturing machine 200 include a distance between yarn guides, the problem of the temperature of the heating device 206, the problem of the false twist-imparting unit 204, and the like. In this manner, the specific frequency band determined by the predetermined conditions of the mechanical factors of the false twist-texturing machine 200 is monitored, and the result is judged from voluntary online comparison. These become feedback information of process management for monitoring the problem regarding the false twist-texturing machine 200 itself, and as a result, on the occasion that a problem occurred, it can be instantaneously treated in proper manner.

Thereupon, the present inventors reconsidered the false twist-texturing process from the standpoint of improvement of productivity of the process. Thus, they resultingly decided to monitor the state of operation related to specific units constituting the abovementioned false twist-texturing machine 200, specific characteristics of the yarn Y, the state of treatments in the manufacturing process of the yarn Y, and the like. Here, as the monitoring events, the present inventors could grasp the problems in the false twist-texturing machine 200 and the yarn based on the above obtained information, and also found a managing technique capable of promptly accurately analyzing factors of the problems. During that time, the present inventors realized that it is not necessary to adhere only to the false twist-texturing process for applying the present managing technique, but the present technique can be generally applied even to all the fiber-texturing processes integrating the abovementioned fiber forming process (melt spinning process) and the false twist-texturing process. And, in these fiber-texturing processes, resultingly the present inventors searched an innovative managing technique that can realize quick treatments. In this study, it has been found that the abovementioned technique which analyzes the yarn tension in a frequency domain is not suitable for detecting the momentary increase of tension and yarn breakage, because of the feature of using fast Fourier transformation (FFT).

Under these circumstances, the present inventors further went on diligent studies in the false twist-texturing process. As a result, the present inventors found that it can be embodied the managing technique being more inclusive, accurate, and prompt only to analyze the obtained information in a frequency domain by subjecting the data of measured untwisting tension to Fourier analysis, but to additionally use the raw information of the untwisting tension detected online. Concrete examples of such a technique can include one for effectively monitoring the instantaneous large variation in tension or the occurrence of yarn breakage. In this case, especially, in the detection of the yarn breakage, it is inevitable to detect not only the occurrence of yarn breakage, but also the point and the treating unit of the occurrence of yarn breakage. Namely, it is the technique to judge the breakage point and unit from the moment of the yarn breakage while the yarn Y is supplied to the false twist-texturing machine 200.

However, the prior art has extremely large number of problems in these points. Accordingly, in order to deepen the understanding of the yarn breakage detection technique of the present invention, at first, the prior art will be briefly explained. The prior art like this comprises the continuous monitoring of the tension of a moving yarn Y at a prescribed reference point, and the detection and judgment of the instantaneous large variation or disappearance of the tension. Certainly, according to the prior art, it is easy to recognize the occurrence of yarn breakage at a specific position of the false twist-texturing machine 200. But, for the prior art, it is extremely difficult to judge on what point, and by what treating unit of the false twist-texturing machine 200, the yarn breakage has occurred. Of course, even the prior art can judge on what point, and by what treating unit, the yarn breakage has occurred. For example, the tension detectors 300 are placed on many points besides the point shown in FIG. 2, and the plural pieces of information detected by the group of tension detectors may be combined to each other. Of course, the occurrence of yarn breakage may be detected by using the detecting system like this. However, since a tension detector that can detect the yarn tension in a noncontact system is very expensive, it is not practical to install a number of such tension detectors on every position. Accordingly, the tension of the yarn Y must be measured in contact with the yarn Y. Considering the current state like this, the conventional tension measuring technique using a contact type tension detector causes troubles such as damaging of the yarn Y under tension measurement and difficulty of threading work to the machine due to existence of the tension detector 300. It also causes problems that it is necessary to place a number of tension detectors and to construct a tension measuring system for integrating pieces of information from these tension detectors, and the cost for such investment is expensive.

Accordingly, against the problems of the prior art, the present inventors have started the development of technique which can specify the point of yarn breakage and the device on which the yarn breakage has occurred only by placing at least one tension detector 300 without placing a number of tension detectors like the case of the prior art. In addition, the objective technique has a merit that it can utilize the analysis using the abovementioned fast Fourier transformation (FFT) at the same time.

In this technique, the tension detector 300 is placed at a specific reference point (in the case of the false twist-texturing process in FIGS. 2 and 8, on the downstream side of the point where the false twist-imparting unit 204 is placed) of the fiber-texturing machine, and at first, the tension of the yarn Y is measured at the reference point online. If the yarn Y under processing is broken, the information of the occurrence of the yarn breakage is promptly communicated to the tension detector 300 through the moving yarn Y. On this occasion, the end of the broken yarn Y reaches tardily the tension detector 300. As shown above, the technique for detecting the point of yarn breakage in the present invention uses the time difference between the time of the occurrence of yarn breakage and the time when the end of the broken yarn passes. Namely, at first, the information of the occurrence of the yarn breakage is detected, and secondly, the time difference ($\Delta T$) from the time of the detection of the occurrence of the yarn breakage to the arrival of the end of the broken yarn Y to the tension detector is measured, and through these processes, the point of the occurrence of the yarn breakage or the device on which the yarn breakage occurred can be specified. That is, since the yarn Y passes the tension detector at the predetermined constant processing speed (V), the multiplying of the processing speed (V) by the measured time difference ($\Delta T$), i.e. the calculation of $V \times \Delta T$ enables the determination of the distance that the end of the yarn generated by the occurrence of the yarn breakage has traveled from the point of the occurrence of the yarn breakage to the tension detector. And, going back toward the upstream side of the movement of the yarn Y by the obtained distance from the abovementioned reference point for measuring the tension of the yarn Y, it can be concluded that the point reached or the treating device placed on the point is the source of the yarn breakage.

Further, the below-mentioned example about the present invention for detecting yarn breakage shows the case where it is applied to a false twist-texturing process, but, needless to say, it can be applied to other fiber-processing processes such as draw texturing process and yarn twist-texturing process. The detecting technique for yarn breakage of the present invention will be explained in detail with a concrete example referring to FIGS. 12–14.

Figure 12:
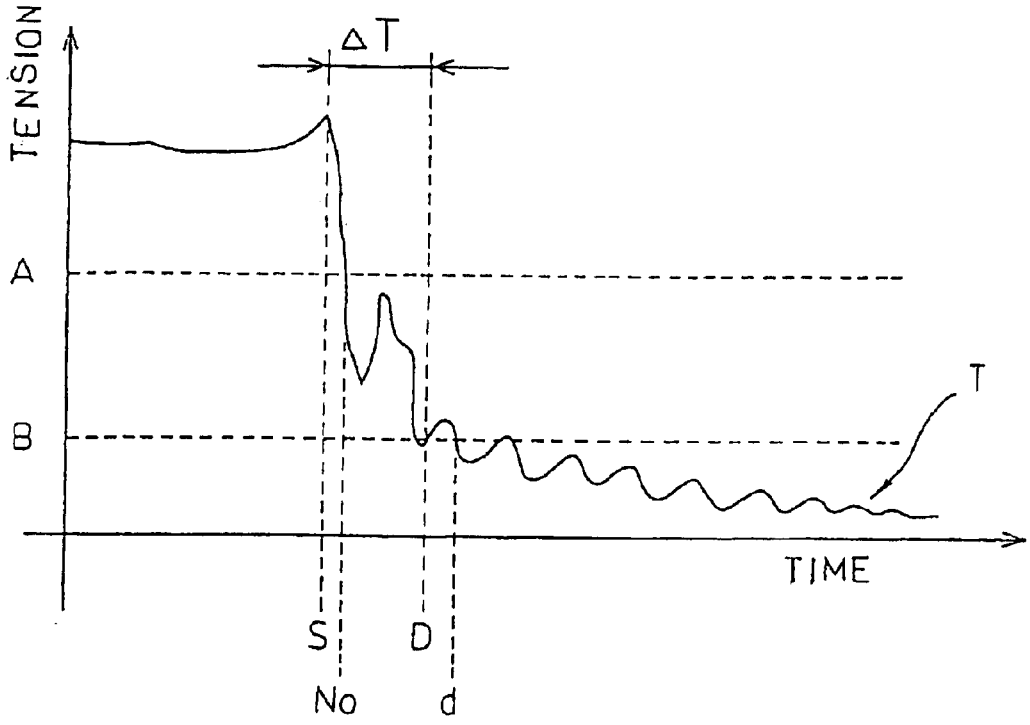
FIG. 12 is a graph exemplifying the state obtained by measuring the change with the lapse of time of a yarn tension before and after the occurrence of yarn breakage with a tension detector placed on the downstream side of a false twist-imparting unit.

For example, the graph of FIG. 12 is the change with time of yarn tension before and after the occurrence of the yarn breakage measured by the tension detector 300 placed on the downstream side of the false twist-imparting unit 204 in the abovementioned false twist-texturing process shown in FIG. 2. In FIG. 12, the time of the occurrence of the yarn breakage is shown by the reference mark S, and the time when the yarn end of the broken yarn passes the tension picking up part is shown by the reference mark D.

As shown in FIG. 12, the tension signal T measured by the tension detector 300 shows a variation pattern, that is, it once rises to the peak value from the stable operation value at the time S, subsequently it makes sudden large lowering, and after rising a little again, it goes down. On this occasion, it is observed that, after the time D when the yarn end of the broken yarn passes, a periodic signal having a specific cycle, whose intensity gradually attenuates, gradually goes down to the zero level while it superimposes on the tension signal T. The abovementioned periodic signal observed here has been understood to be attributable to the proper vibration of elastic system associated with the picking up of the tension signal by the tension detector 300. Considering these factors, the variation in the tension signal T after the occurrence of the yarn breakage is understood that, when attention is turned on a greater variation waveform obtained by removing the influence of small variation waveforms such as the abovementioned periodic signal, it shows a change with time capable of being approximated by a first-order lag system as a whole. Yet, the reference mark A in the figure shows the set value of yarn breakage judgment to be used for judging the occurrence of yarn breakage as mentioned below, and the reference mark B shows the lower limit to be used for detecting the passage of the yarn end of the broken yarn, having the relation of A>B.

The technique for detecting yarn breakage in the present invention is carried out by analyzing the tension behavior on the occurrence of yarn breakage as stated above. Accordingly, the main constituting components of the detection means for yarn breakage point in the present invention comprises the tension detector 300 and the decentralized management unit 800 constituted of microcomputers and the like, shown in FIG. 8. The decentralized management unit 800 is constituted of the yarn breakage occurrence detector 302, the broken yarn end passage detector 303 and the yarn-breakage-point measuring device 304, shown in FIG. 14, so that it executes various processings. In this example, in the filter device 312, a tension signal whose high frequency zone noises have been filtered through a low-pass filter (LPF) is read at first from the tension detector 300 via the amplifier 311. And, the decentralized management unit 800 has a basic processor for executing processings such as noise removal from the tension signal or the like, and for storing the results. The basic processor is constituted as shown in FIG. 13, and it is placed in the main body of the decentralized management unit 800 constituted of microcomputers.

Figure 13:
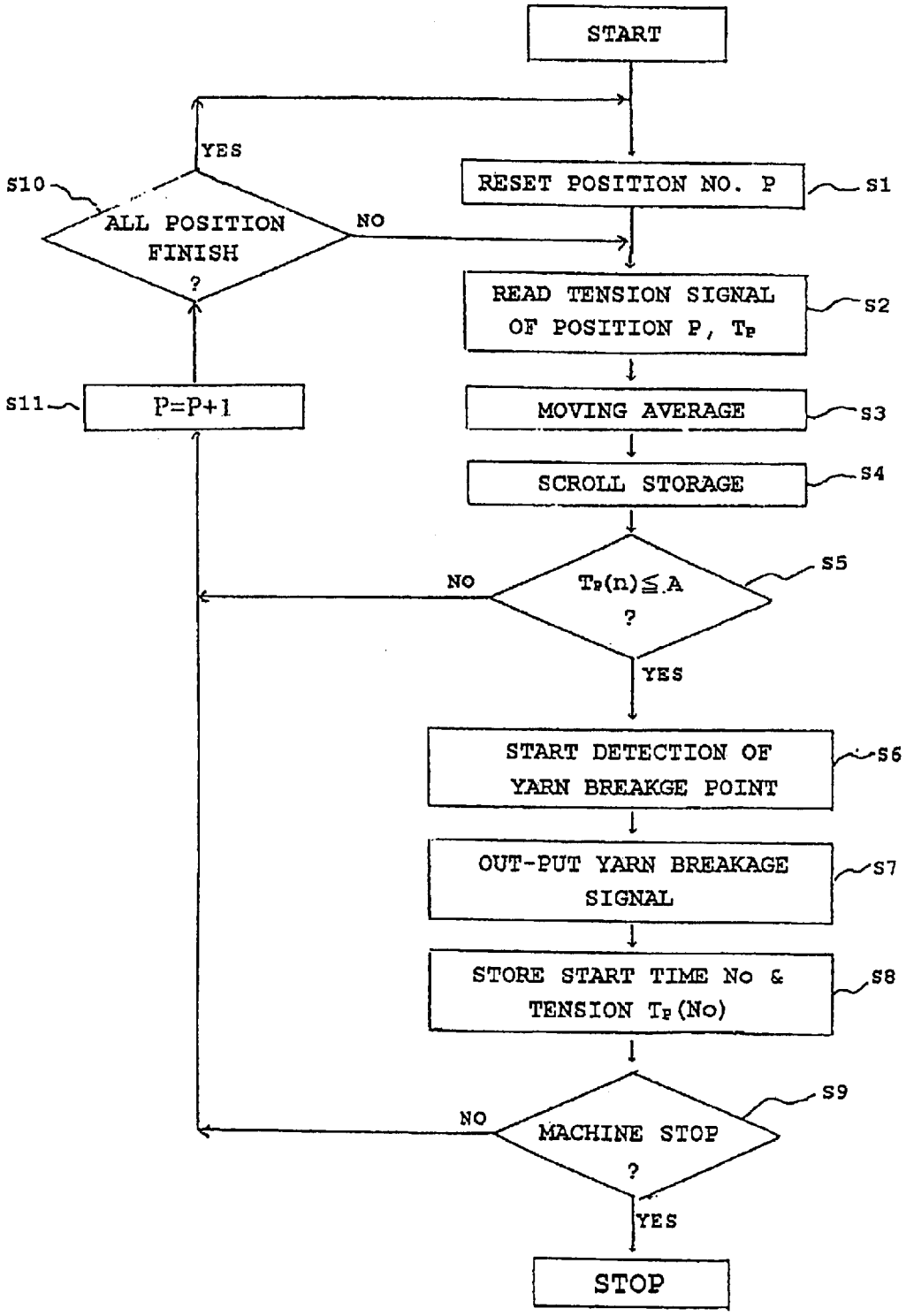
FIG. 13 is a flowchart exemplifying a basic treatment for detecting a point of yarn breakage.

The abovementioned basic processor has a data collection function unit for collecting tension data for each position by serially scanning the tension detectors 300 by position and a yarn breakage treating function unit for performing an inevitable treatment for the yarn breakage after judgment of the occurrence of yarn breakage as shown in FIG. 13. The data collection function unit, as shown in FIG. 13, fills the roles of reset (S1) of position number P, reading in (S2) of tension signal Tp from the tension detector 300 for the position P, execution (S3) of moving average processing and storage (S4) of the result. Regarding the storage in the present example, a scroll storage system which serially stores a prescribed number of recent data sampled at least during a prescribed period of time required to detect the yarn breakage point is used for reducing storage capacity. Regarding moving average value processing, in the present example, it is designed so as to obtain it by averaging 120 continued sample data.

Next, in the yarn breakage treating function unit, it is judged whether yarn breakage occurs or not (S5), and in the case of the absence of yarn breakage, the position number P on which the judgment for the existence of yarn breakage has been carried out is advanced by 1 (S11). On this point, when it is not the final number (S10), the data collection for the next position is carried out in the same manner as mentioned above, and thereby the existence of yarn breakage is judged over all positions. When the confirmation of judging the occurrence of all yarn breakage is completed, the position number P is reset (S1), and the data collection is started from the first position.

Further, in the abovementioned yarn breakage treating function unit (S5), as shown in the figure, at first, the occurrence of yarn breakage is judged by comparing the moving average value of the obtained tension signals Tp (n) with the predetermined yarn breakage set value A. Subsequently, in the case where the yarn breakage does not occurs (in the case where the result of S5 is No, that is, the tension signal T is not less than the yarn breakage set value A) as mentioned above, the processing is returned to the data collection function unit for collecting the tension data of each position as it is, and when the tension signal T is less than the yarn breakage set value A, the yarn breakage treatment shown below is carried out. That is, in the case where the result of S5 is "Yes" (in the case where the moving average of tension signal T is less than the predetermined yarn breakage set value A), it is judged that "the yarn breakage has occurred" (S6). In this case, a yarn breakage signal for actuating a yarn breakage-treating device (not shown in the figure) such as a yarn supply cutter is outputted (S7) by a conventional yarn breakage management apparatus (not shown in the figure) to the position judged on which yarn breakage has occurred. Further, at the same time, the routine of yarn breakage point detection is actuated, after the storage (S8) of the data such as a judging time No which is needed for yarn breakage point detection, maintenance and management, or like, which will be mentioned later, the tension value Tp ($N_0$) at the judging time, or the like. Subsequently, the processing is returned to the data-collection function unit, and the tension data for the next position is collected (S9).

Figure 14:
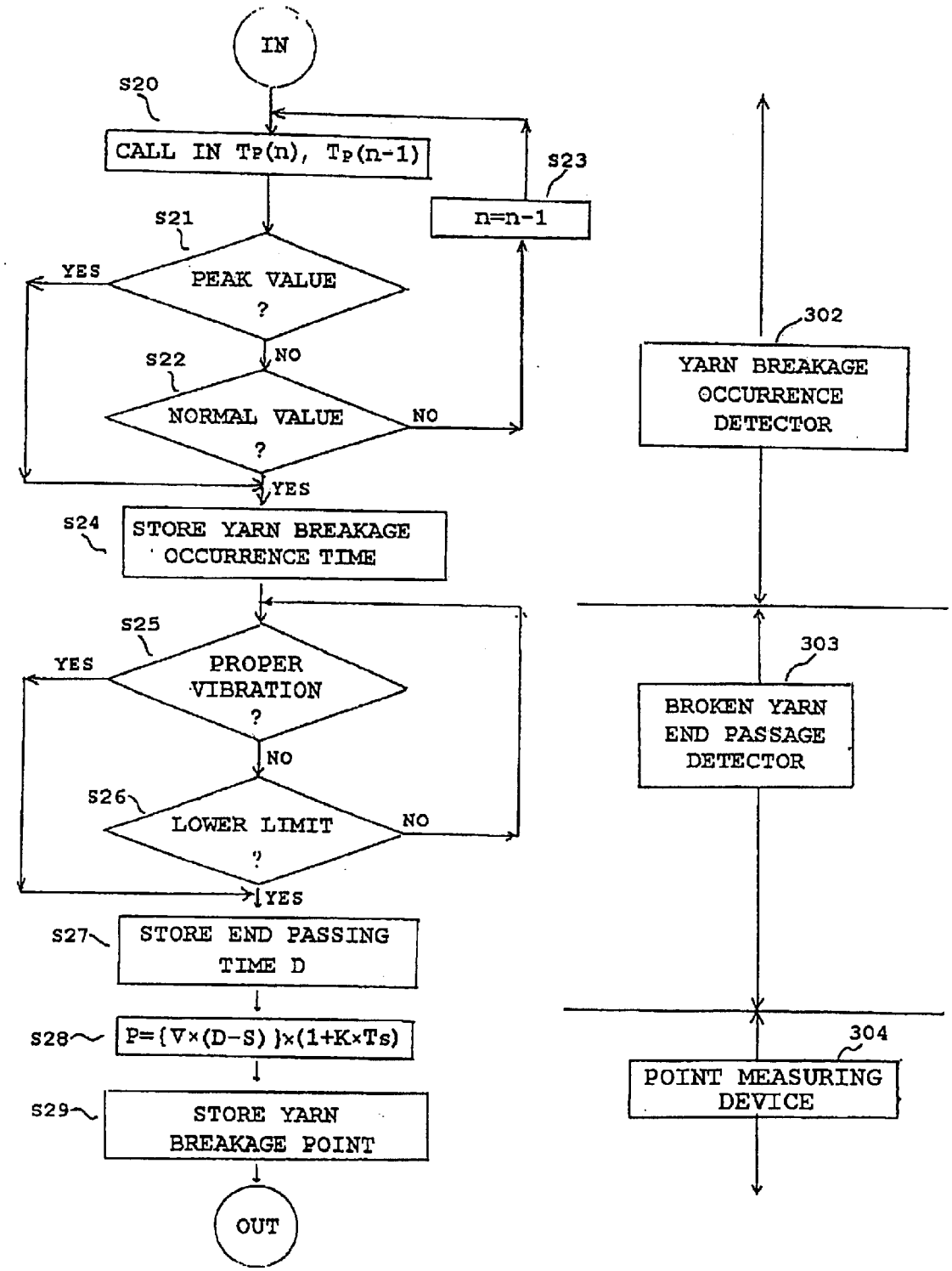
FIG. 14 is the main constituting elements of the yarn breakage point detector of the present invention and a flowchart exemplifying the treatment with these constituting elements.

In that case, in the abovementioned actuated routine for the detection of yarn breakage point, the processing to detect the yarn breakage occurrence by yarn breakage occurrence detector 810 is started at first as shown in FIG. 14. And, as shown below, the process to detect the yarn breakage occurrence carries out the detection of the time of yarn breakage by going back from the judging point $N_0$ of the yarn breakage occurrence based on the tension signal Tp (n) of the position P stored by scroll storage. The present example is carried out intending to improve the accuracy and reliability by adopting a double detecting system having two different principles for detection, as is shown in FIG. 14, when a yarn breakage occurred, this system is basically carried out by a normal value detection mode combined with a peak value detection mode for detecting the peak value peculiar to the present invention.

In concrete terms, as shown in FIG. 14, firstly the continuously retroacted Tp (n−1) and Tp (n) (here, the initial value of n is $N_0$) are called in (S20), then the processing enters into the peak judgment step to judge the existence of peak (S21). In the present example, the judgment process retroacts one by one from the time $N_0$ when it is judged that yarn breakage has occurred, then the measured value Tp (n) at time n is compared with the measured value Tp (n−1) at time (n−1) one lower side of time n, and it is judged that the time satisfying the relation: Tp (n)≧Tp (n−1) is "the time of the peak value". When the judgment of S21 is "YES" (that is, the above relation is satisfied), the process proceeds to the step for storing a yarn breakage occurrence time S, and the time n being satisfied the relation is stored (S24) as the yarn breakage occurrence time S.

On the other hand, when the judgment of S21 is "NO" (that is, the peak value is not detected), the process proceeds to the normal value judgment step, and it is judged (S22) whether it is the normal value or not. In the present example, the judgment is made by judging whether or not the equation |Tp (n)-Tp (n−1)|≦α (α is the set value) is continuously satisfied for a prescribed time in. When the judgment of S22 is "NO", n is retroacted by one to (n−1) (S23), and the retroacted value Tp (n−1) and the next retroacted value Tp (n−2) are called in. Then, the judgment step for peak value and the judgment step for the normal value are carried out on Tp(n−1) and Tp(n−2), and these steps are continued retroactively until the tension value reaches the normal value.

Then, when the judgment of S22 is "YES", that is, the tension value T become the normal value, the process proceeds to the step (S24) in which the time S of the occurrence of yarn breakage is stored. In this step, the time when the value starts to be lower than the set value α continuously in the retroaction, in concrete terms, the time of (n+m) which is the time proceeding by a prescribed time m from the time n when the judgment of S22 has become "YES" at first, is stored as the yarn breakage occurrence time S (S24). In other words, the judgment comprises the detection of the time of the occurrence of a large drop from the normal value exceeding the set value α.

As mentioned above, in the present example, the time of the peak in FIG. 12 is detected as the time of the occurrence of yarn breakage, and the detection is designed as accurate as possible in the peak judgment step. If such a peak is not observed, the judgment step of the normal value is used. And, the time when the value goes down exceeding the specific value α from the normal value of the normal operation is detected as the time of the occurrence of yarn breakage, and this ensures stability and reliability in the detection of the time of the occurrence of yarn breakage. When the time of the occurrence of yarn breakage is detected in this manner, it is stored as yarn breakage occurrence time S. Accordingly, as shown in the measured example of FIG. 12, the yarn breakage occurrence time S can be detected exactly. Further, the normal value detection mode mentioned in the latter case is sufficient enough for specifying the yarn breakage occurrence point, and occasionally either of the modes is sufficient in some cases.

The yarn breakage occurrence time can be detected in an electronic circuit such as comparator circuit, but the inevitable yarn breakage treatment is carried out by a scanning device. Accordingly, the detection processing is not necessary to hurry, and a software processing using the computer of the present invention is advantageous from the viewpoint of generality, operability, and the like. Even in the software processing, a large tension drop like the measured example is observed when a yarn breakage occurred. Thereby, instead of the present example, the following method or the like can be applied. That is, the time on which the value of drop in the differential of the tension signal or that during a specific time (commonly, scanning period) exceeds a prescribed value is judged as the yarn breakage occurrence time.

When the detection of the yarn breakage occurrence time by the yarn breakage occurrence detector 810 is completed, the process proceeds to a yarn-end passage detection processing by a broken yarn end passage detector 820, and the passage time of the yarn end at the reference point is detected. In this detection, a double detection system using a proper vibration detection method and a lower limit detection method having different detection principles as shown below is used in order to increase the reliability of detection. That is, the system is based on the method that a tension detector of the system having a tension detection guide which touches the yarn Y detects the proper vibration (refer the graph in FIG. 12), which is actualized after the passage of the yarn end of the broken yarn and peculiar to a tension detection guide system. The system is constructed in such a manner that, if the proper vibration is not observed, the time on which the tension becomes lower than a lower limit value B is detected, and the detected time is judged as the time of passage, wherein the lower limit value B is predetermined for detecting yarn end passage.

Thus, the yarn-end passage detection processing of the present example, as shown in FIG. 14, comprises a proper vibration judgment step (S25) for detecting the start of the proper vibration and a lower limit value judgment step (S26). The proper vibration judgment step (S25) starts at first with calling in the tension signal Tp (n) observed after the passage of the prescribed time determined by a test from the time of the judgment of the yarn breakage occurrence and the next tension signal Tp (n+1). Then, it is judged whether the equation: Tp (n)≦Tp (n+1) is satisfied or not, and, when the equation is satisfied, the Tp (n) is stored as the local minimum value 'min' together with the satisfaction time n, and a flag indicating the minimum value satisfaction is set. When the relation is not satisfied, the judgment of the sub step 1 is "NO", and the process proceeds to the next judgment step (S26) for lower limit value. In the next sub step 2 in the proper vibration judgment step (S25), when a flag indicating the minimum value satisfaction is set, subsequently it is judged whether the equation: Tp (n)≧Tp (n+1) is satisfied or not. Then, when the relation is satisfied, the Tp (n) of this time is detected as the maximum value 'max' following the minimum value 'min'. When the relation is not satisfied, the judgment of the sub step 2 is "NO", and the process proceeds to the following judgment step (S26) for the lower limit same as in the case of the minimum value.

On the other hand, when the relation of the sub step 2 is satisfied, it is judged whether the difference (max-min) is equal to or less than the prescribed value determined or not by a test. When the difference is equal to or less than the prescribed value, the time of the minimum value 'min' is judged as the time of the passage of the yarn end, and then process proceeds to the next step (S27) for storing the yarn end passage time D, and the time of the minimum value 'min' is stored as the yarn end passage time D. Further, when the abovementioned difference is not less than the prescribed value, it is judged that the vibration is not the proper vibration, a flag indicating the satisfaction of the lower limit value is reset, and the process proceeds to the next judgment step (S26) for the lower limit since the judgment of the judgment step (S25) for the proper vibration is "NO". As is clear in FIG. 12, this proper vibration detection method enables a precise detection in the present example.

When the judgment of the judgment step (S25) for the proper vibration is "NO", the process comes in the judgment step (S26) for the lower limit value as shown in the figure. The judgment step (S26) for the lower limit value judges whether or not the tension signal Tp (n) equal to or less than a prescribed percentage (concretely, 25% or less in the present example) of the normal value observed before the occurrence of yarn breakage continues for a prescribed time. When the judgment is "NO", the process returns to the judgment step for the proper vibration with the time (n+1) instead of the time n, and the abovementioned step is repeated.

On the other hand, when the judgment of the step S26 is "YES", that is, the value is not more than the lower limit, the process proceeds to the step for storing the yarn end passage time D (S27). In this case, the time n on which the value becomes not more than the set value is stored as the yarn end passage time D. By this, the detection reliability of the yarn end passage is improved in the case where the proper vibration is not clear. In the example of FIG. 12, the yarn end passage time is determined by the proper vibration method, and the yarn passage time obtained is D. However, in the present example, the time obtained by the lower limit value detection method is d.

Further, it is desirable to use both the methods for yarn end passage detection, as shown in the present example; however, only either of them is sufficient in some cases. In short, the state of output signal from the tension detector on the yarn breakage occurrence is grasped by experiment for both the yarn breakage occurrence detection processing and the yarn-end passage detection processing, and it is preferable to use the suitable detection processing.

As mentioned above, when the broken yarn end passage detector 820 finishes the prescribed processing, the process proceeds to the processing for measurement of the point of yarn breakage by the yarn-breakage-point measuring device 304, and the point of the yarn breakage is measured as shown below. That is, the moving time ΔT of the yarn end from the point of yarn breakage occurrence to the reference point is obtained as the time difference between the yarn breakage occurrence time S and the yarn end passage time D obtained above. Further, the moving speed V of the yarn end (i.e. yarn Y) is predetermined at a prescribed value by the winding speed of the yarn Y.

Accordingly, the distance from the reference point to the yarn breakage occurrence point P can be determined by multiplying these values, ΔT×V.

That is, the yarn breakage occurrence time is detected in a prescribed range such as a fiber-processing range, and subsequently the time on which the yarn end of the broken yarn passes at the reference point located on the downstream side of the above prescribed range is detected, and the point of yarn breakage can be determined based on the elapsed time from the occurrence time to the passage time.

Incidentally, until just the occurrence of yarn breakage, the yarn Y is moving in a state that the yarn is imparted with a constant tension of the normal operation. Accordingly, accurately speaking, it is preferable to adjust the point using the tension. Considering this, in the present example, as shown in the calculation step (S28) in FIG. 14, the length of the yarn from the reference point, i.e. the point O of yarn breakage is determined from the following equation (1) using the difference between both the times, the predetermined moving speed V of the yarn Y and the stationary tension value Ts at the time S. Thus obtained yarn breakage point O is transformed into a prescribed storage format for the convenience of later use, and it is stored together with the yarn breakage occurrence time S and the yarn end passage time D (S29).

$$O=\{V\times(D-S)\}\times(1+K\times Ts) \quad (1)$$

In the above equation, K is an elastic modulus of the yarn Y.

The collection of thus obtained points of yarn breakages enables the analysis for investigating at which point of the fiber-processing zone, yarn breakage occurs or the like, and also the collection enables the quick and easy elucidation of the factors causing yarn breakage in each position.

Figure 15:
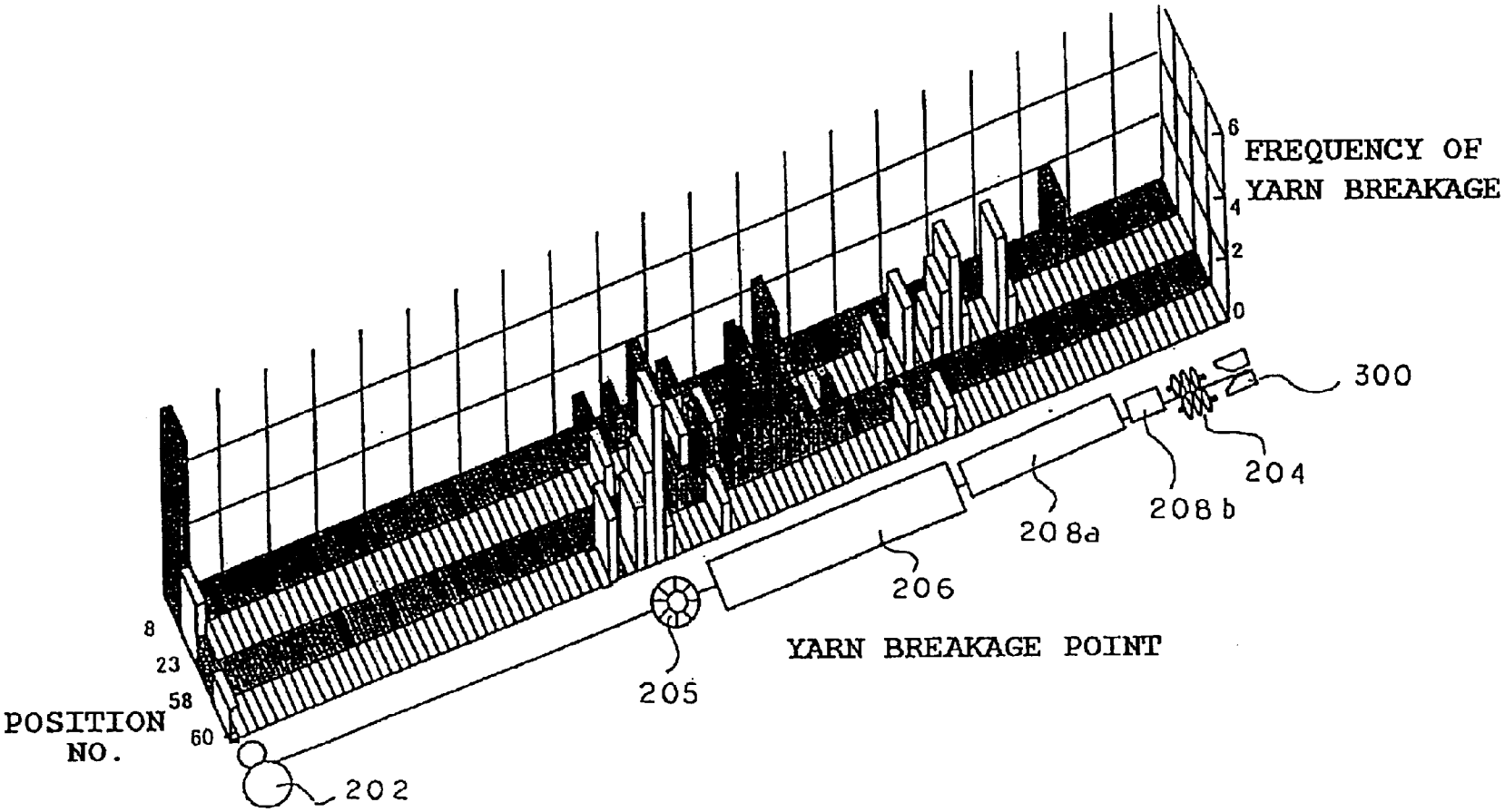
FIG. 15 is a distribution diagram schematically exemplifying the distribution of the occurrences of yarn breakages related to a specific position of a false twist-texturing machine and the state of its occurrence.

FIG. 15 is a distribution chart schematically showing the result of the analysis of yarn breakage occurrence and the state of the occurrence for a specific positions of the false twist-texturing machine 200, which analysis is performed by making good use of the abovementioned yarn breakage detection technique. As is clear from FIG. 15, the analysis can elucidate that yarn breakages frequently occur between the twist setting guide 205 and the first heating device 206.

Figure 16:
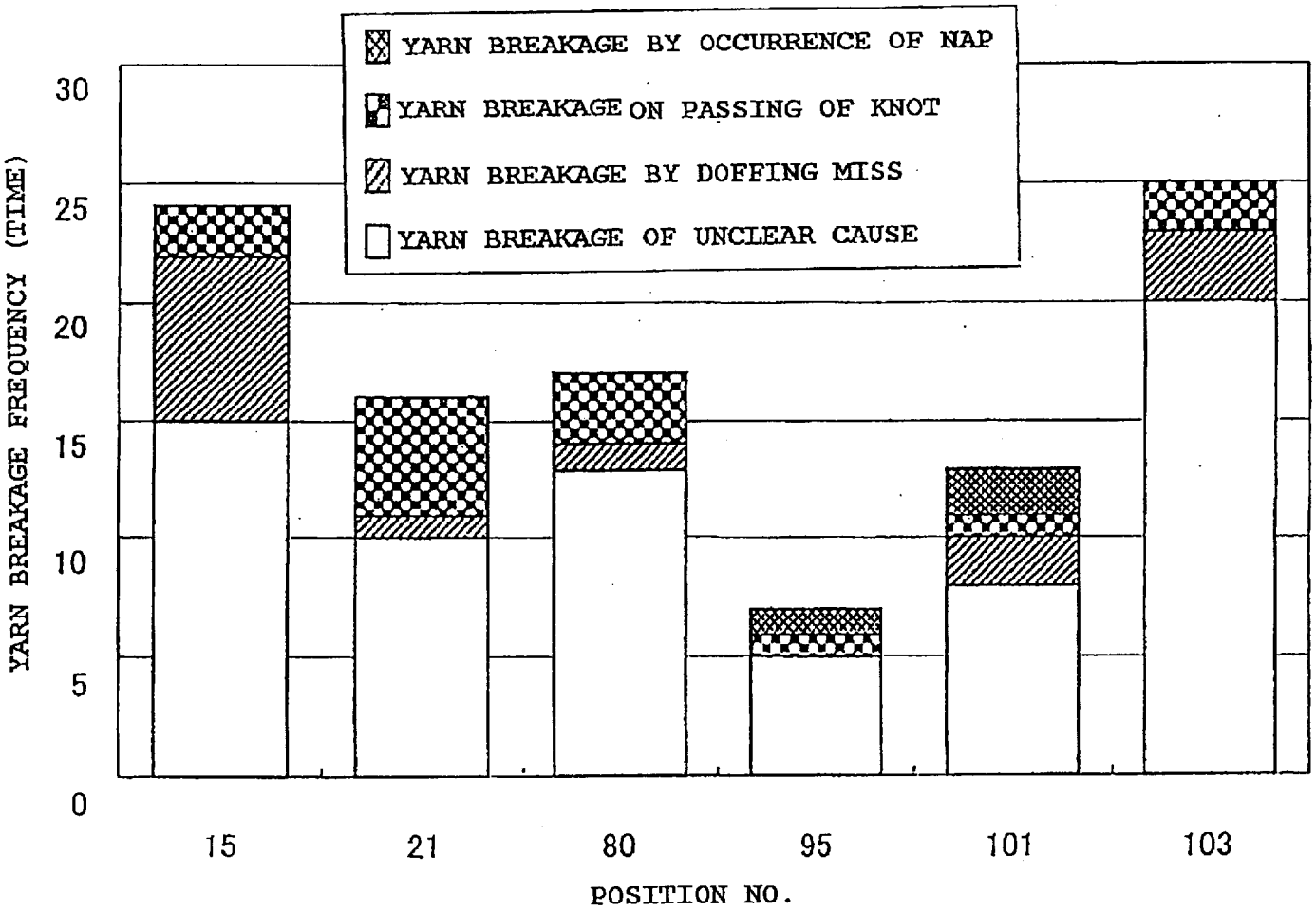
FIG. 16 is the graph expressing an example obtained by analyzing yarn breakage occurred in a specific position of a false twist-texturing machine by cause of the yarn breakage.

It is naturally limited to the fiber-texturing machine which is under operation at the time of investigation that the yarn breakage point or the treatment device on which the yarn breakage occurs is specified as a monitoring event as mentioned above. However, the factors causing the occurrence of yarn breakage includes, besides factors attributable to fiber-processing machines such as a false twist-texturing machine, many factors such as passage failure of the knot between the tail yarn y1*e* and the lead yarn end 2*ys* which ties the yarn packages P1 and P2 together (yarn package changeover failure), broken filaments and loops of the yarn packages P1 and P2, further, the doffing misses of a textured package $P_T$ and the like. Further, these yarn breakage factors almost can be specified, as shown in FIG. 16. The reason is that, the yarn breakage is correlated to tension variation by a broken filament detector 500 in the case of the yarn breakage attributable to the occurrence of broken filaments, it is correlated by the changeover detector 400 in the case of the yarn breakage attributable to the changeover failure of yarn packages, and it is correlated by detecting the starting-up signal of the doffing machine 600 in the case of the yarn breakage attributable to the miss of doffing; and accordingly factors can be easily specified. Accordingly, the problem is the occurrences of yarn breakages attributable to the factors other than these, that is, the occurrences of yarn breakages attributable to uncertain factors. Under these circumstances, the present inventors further advanced their study, and they investigated not only whether they can specify the yarn breakage occurrence point and the device on which the yarn breakage occurred as a monitoring event during the processing of a yarn, but also whether they can analyze by what factors or causes such yarn breakage occurs. As the result, the present inventors found that, by monitoring the states of the occurrences of these yarn breakage, they can understand the states of the occurrence of yarn breakage, and by analyzing the understandings, they can closely elucidate by what factors or causes yarn breakage occurs.

However, it is clear that, in order to achieve the purpose, it is necessary to clarify the yarn breakages occurred as a monitoring event and classify them by factor, for example, such as the failure of the knot of the tail yarn y1*e* and the lead yarn end y2*s* which ties the yarn packages P1 and P2 together, broken filaments and loops of the yarn packages P1 and P2, or doffing misses of a textured yarn package $P_T$. Accordingly, they recognized that in order to realize this for the whole yarn Y constituting the yarn packages P1 and P2, it is necessary to obtain the winding point from the time when the winding of the yarn Y has started to the time of the occurrence of the yarn breakage (in other words, "yarn length" from the starting time of winding to the occurrence time of the yarn breakage) by yarn package on the bobbin of each of the yarn packages P1 and P2.

Figure 17:
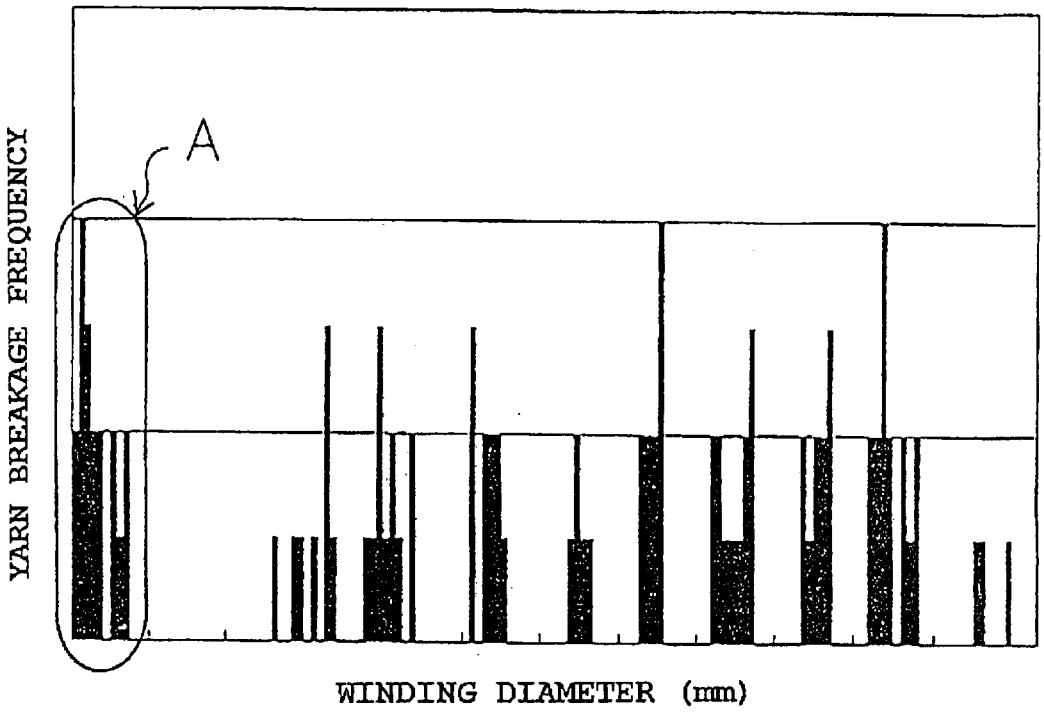
FIG. 17 is a graph exemplifying the correlation between a wound diameter of a yarn package and the number of the occurrences of yarn breakage obtained on a specific position in a melt spinning apparatus.

Hereafter, this will be explained in concrete terms referring to FIG. 17. FIG. 17 shows the distribution of the points of yarn breakage occurrence in terms of the winding diameter (winding point) of the yarn packages P1 and P2 obtained in the melt spinning process, in which all data of yarn breakages are totalized for one brand produced by 20 positions of one false twist-texturing machine 200. In FIG. 17, the abscissa shows the winding diameter of yarn package and the ordinate shows the frequency of yarn breakage occurrences, respectively; and the left end and the right end of the abscissa are the winding diameters at the start of winding and at the completion of winding, respectively. The exhibition of the distribution of yarn breakage points in terms of winding diameter of yarn packages P1 and P2 like this can give useful information for improving the winding up of yarn packages P1 and P2, as shown below.

In FIG. 17 shown above, the part indicated by the reference mark A expresses the yarn breakages occurred at the starting part of winding of a yarn package, i.e. the innermost layer part, and this shows that yarn breakage concentrates in this part. Generally, in the melt spinning process shown in FIG. 1, a controlling state is often changed in order to improve change-over efficiency of yarn packages at the innermost layer of a yarn package P1, that is, the starting point of winding near the place where a winder 107's turret board works. Accordingly, it is assumed that these factors appear as the frequent occurrences of yarn breakages at the starting part of winding. Accordingly, when such frequent occurrence of yarn breakages is observed, it is necessary to reinvestigate conditions of winding in the vicinity of the inner layer of the yarn package P1 to optimize them. Further, the distribution of occurrence other than that shown by the reference mark A in FIG. 17 shows that yarn breakages occur collectively at some specific winding diameters. This is considered as follows. That is, not only in this example, presently, the winding control of the winder 107 generally performed by changing a traverse angle depending on the winding diameter. When a controlling pattern of the traverse angle is overlapped with the distribution of yarn breakage regarding winding diameter of FIG. 17, the points of change of the traverse angle in the winder 107 almost coincide with the winding diameters upon which the occurrence of yarn breakage constrates. This shows that the occurrences of the yarn breakages other than those indicted by the reference mark A have strong correlation to the controlling pattern of the traverse angle. In this way, by analyzing the distribution of the occurrence of the yarn breakage as shown in FIG. 17, it becomes possible to investigate with good sensitivity whether the controlling conditions of traverse angle of the winder 107 in the melt spinning process are adequate.

In this way, the decentralized management unit 800 shown in FIG. 8 performs the online monitoring of the untwisting tension of the yarn Y with the tension detector 300, the existence of changeover between yarn packages P1 and P2 with the changeover detector 400, the occurrence of broken filaments on the supplied yarn Y with the broken filament detector 500 and further the starting signal from the doffing apparatus 600. For example, when a yarn breakage occurs, the causes of the occurrences of yarn breakages are classified according to the state of each signal for monitoring them, for example, into yarn breakage due to doffing miss, yarn breakage due to broken filament occurrence, or yarn breakage on the changeover of yarn packages (knot passage failure), like the classification in FIG. 16. Further, yarn breakages having unclear causes, which do not correspond even to yarn breakage due to the miss in threading by a worker, can be determined on which winding point of the yarn packages P1 and P2 (winding diameter in the present example) they have occurred. Furthermore, the decentralized management unit 800 enables that, thus obtained pieces of yarn breakage information are totalized by brand of yarn packages, the result is outputted (displayed) in the form of totalization, and this enables the optimization of the winding conditions of the yarn packages.

In the monitoring events detected as shown above, pieces of the obtained information are subjected to various statistical processings in the central management unit 900 so that they can serve for the management of fiber-texturing processes including the abovementioned fiber forming process. Yet, they are outputted from the central management unit 900 to an output device in various forms so that managers can read out the information easily and accurately. For example, they are displayed on a liquid crystal display device, printed on paper by a printer, or recorded on a recording medium such as a floppy disk or CD-ROM. One of the examples like this is that, as mentioned above, the distribution of the occurrences of monitoring events of each yarn package supplied to every position of the false twist-texturing machine 200 is outputted from the central management unit 900 in the form arranged chronologically like the graph exemplified in FIG. 18, and it can be displayed on a display device. Yet, the example of FIG. 18 is the chronologically exhibited distribution of the occurrences of the monitoring events regarding each yarn package supplied to every position of the false twist-texturing machine 200 shown above, and time is shown on the abscissa, and the package number of each yarn is shown on the ordinate.

Figure 18:
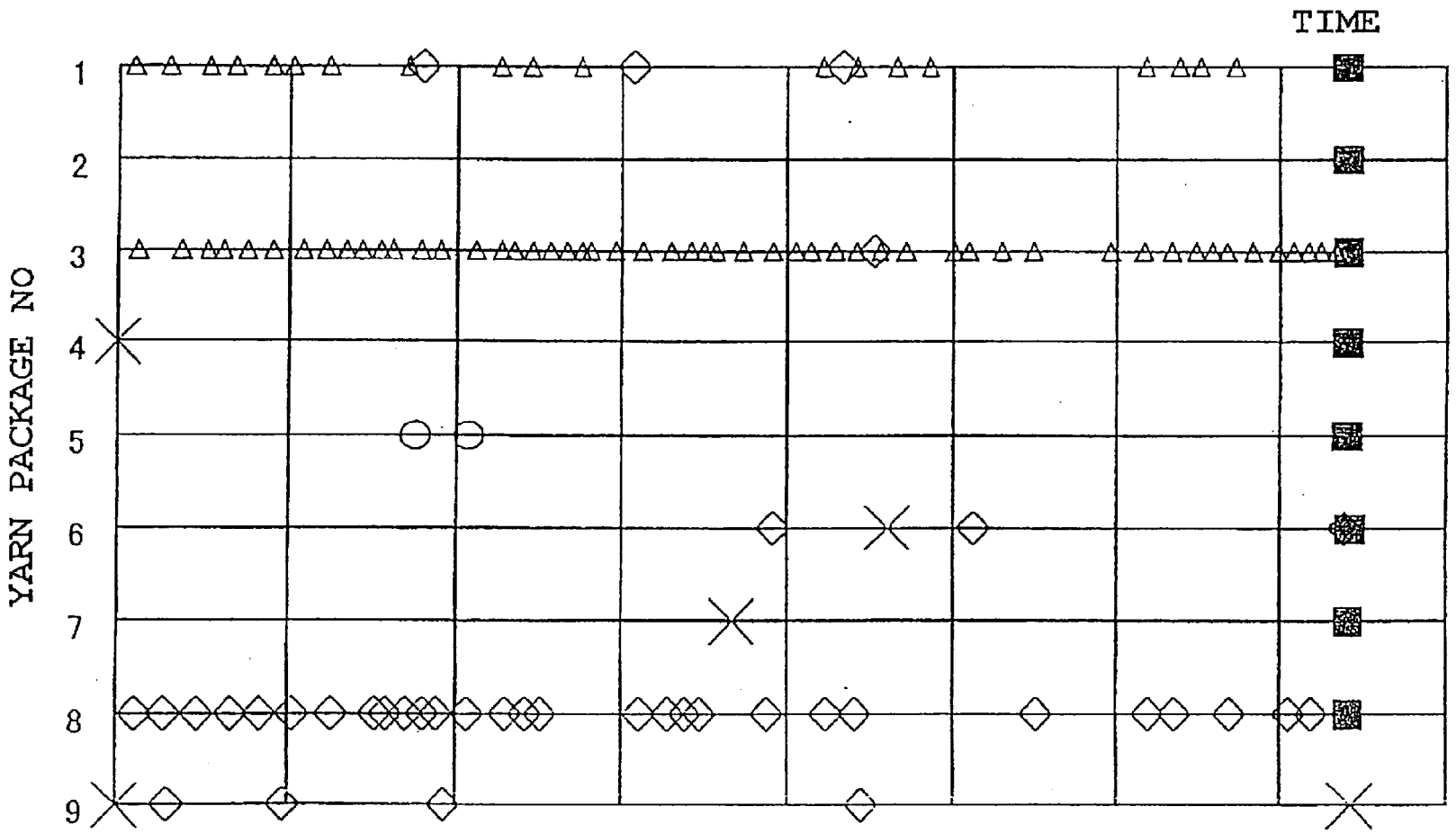
FIG. 18 is an explanatory diagram of a typical example chronologically expressing the distribution of the occurrences of a monitoring event by yarn package.

In the graph shown in FIG. 18, the ordinate shows a typical example of the yarn packages obtained in the spinning apparatus 100. In the actual graph, the number expressed on the ordinate is actually the lot number of a specific yarn package which has been read in from a bar code reader into the decentralized management unit 800.

However, in FIG. 18, for the sake of simplicity of the explanation, the yarn packages are shown with only the order of the numbers from 1 to 9. Further, the abscissa expresses the passage of time from the start of the processing of each yarn package, the left end is the start of the processing, and this is expressed by "00:00". Further, the mark ■ expresses the time of the occurrence of changeover between yarn packages, or the point of the finish of the processing. Accordingly, the interval from the point of the start of processing at the left end of the graph to the finish of the processing expressed by the mark ■ expresses the treating time of processing of the yarn package. Yet, when yarn breakage occurs during the processing, the time when the processing is not curried out can be omitted since the time needed for threading the yarn Y again to the false twist-texturing machine 200 is known. Further, in FIG. 18, the mark ◇ expresses the time of the occurrence of the variation in tension not less than a prescribed value, the mark X expresses the time of the occurrence of yarn breakage, the mark Δ expressed the time of the occurrence of the variation in characteristic values (this will be mentioned in detail later), and the mark ○ expresses the time of the occurrence of a broken filament, respectively. The showing of monitoring events by kind is effective for factorial analysis. Further, in FIG. 18, the abscissa expresses time, but it may express the winding diameter or the winding weight of yarn package. The reason is that the winding diameter and the winding weight are expressed by the parameter of time, and thereby these numbers can be easily calculated using time.

Further, in FIG. 18, the interval from the time of the start of processing "00:00" to the finish of the processing indicated by the mark ■ of the yarn package No. 1 to 9 corresponds to the interval from the completion of winding to the start of winding, respectively. And, when the time axis, from the finish time of processing to the start time of processing, is reversed, FIG. 18 is the graph corresponding to from the start of the winding of yarn package to the finish of winding in the melt spinning process. Accordingly, this has a merit that the correspondence of the occurrence of monitoring events to the history of spinning can be easily grasped. By chronologically expressing the distribution of the occurrences of the monitoring events by yarn package based on the same time base in this manner, the occurrence of the monitoring events can be effectively correlated with the production history of the yarn packages. Thus, this can specify the yarn package having trouble, that is, the yarn package has been produced on which position of which spinning machine, and on what timing. And, the objects for investigating the cause of failure can be easily narrowed down. Further, quick investigation or countermeasures can be applied on the identified specific position.

For example, on a yarn package No. 3, the variations in the characteristic value shown by the mark Δ are frequently observed over almost all period of processing, and the occurrence of the problem of U % or OPU is estimated. Further, when the U % problem and the OPU problem are separately expressed by performing the investigation that has been already mentioned in the frequency analysis of untwisting tension, the graph becomes more understandable. In the present example, it is shown that the U % problem of the yarn package No. 3 has occurred through the whole period of processing. Based on this fact, the production conditions, the state of devices and the like are investigated on the position of the spinning machine 100 by which the yarn package No 3 has been produced, and the causes associated with the U % problem can be studied. Further, in the yarn package No. 8, the variations in tension not less than the prescribed value which need monitoring are frequently observed almost through out the period as shown in the figure, and this causes the problem in dyeing of textured yarn. By reading out of such a display, on one hand, the package of textured yarn on which the tension problems have been observed can be rejected as a defective good before it goes out to the market. On the other hand, the production history in the melt spinning process is investigated from the lot number of the yarn package in which the problem of tension is observed, and the production conditions causing the problem in tension, the state of the occurrence of the problem in tension or the like can be confirmed. The study of the cause, and further the speedy sure action of the countermeasure against the problem therefore can be realized. This results in improvement of the yield of the nondefective yarn package.

Further, on the detection of broken filaments, the manager can read out from the graph of FIG. 18 that filament breaking has occurred twice on the yarn package No. 5. Since the occurrence of broken filament is detected only twice on the yarn package No. 5, the occurrence is estimated to be a sudden case. Further, since it can be estimated in what part of the package of the textured yarn the broken filament exists based on the detection time of the occurrence of the broken filament, an useful information for managing the quality of a textured yarn package is obtained. In addition, needless to say, the cause can be further chased in some states of the occurrence. For example, in the case where broken filaments occur continuously, it is assumed that the cause exists on a single position of the corresponding spinning apparatus 100, especially on an oil applying apparatus 104 or a twining apparatus 105. The reason is that, in the oil applying apparatus 104 or twining apparatus 105, the yarn Y moves on a fixed member such as an oiling guide or a compressed air supplying nozzle, and this causes abrasion. On the abrasion, a part of the multifilaments constituting the yarn Y is supposedly broken to form broken filaments. In this way, by the management based on the monitoring of the monitoring events for each yarn package, the yarn package-related causes can be easily separated among the causes which are considered to be the causes of product problems. At the same time, the information for studying the causes of problems of the spinning apparatus 100 is also obtained, and the countermeasure can be taken quickly; and thereby the above management largely contributes to the improvement of the productivity and the reduction of the production cost.

In addition, the study of the causes of yarn breakage becomes easy as shown below. For example, in the investigation of the occurrences of yarn breakages expressed by the mark X in FIG. 18, the causes of the occurrences of the yarn breakages are found from the times of the occurrences as shown below. That is, the yarn breakages occurred at the time of the start of the processing "00:00" for the yarn package No. 4 and No. 9 are found to be the yarn breakages (transfer yarn breakage) occurred on the time of the changeover of the false twist-texturing machine from the timing of the occurrence. The yarn breakage occurred on finishing the processing for the yarn package No. 9 is found to be the yarn breakage of yarn package (having no knot) occurred on finishing of the yarn supply from the yarn packages P1 and P2.

Further, when the broken yarns are expressed after removal of the yarn breakages having the abovementioned clear causes from FIG. 18, the distribution of the occurrences of the yarn breakages attributable to other causes becomes clearer. As the result, as mentioned above, for example the relation between the winding diameters and the points of the yarn breakages of the yarn packages P1 and P2 becomes clear, and it is estimated that the frequently occurred yarn breakages have problems in winding control on winding up the yarn packages P1 and P2 in the yarn forming process (melt spinning process), and also the countermeasures for them can be pursued. Thus, the present invention can clarify even the problem of the winding up of the supplied yarn, and exerts power on the reduction of production cost based on lowering the yarn breakage rate in the false twist-texturing machine.

Figure 19:
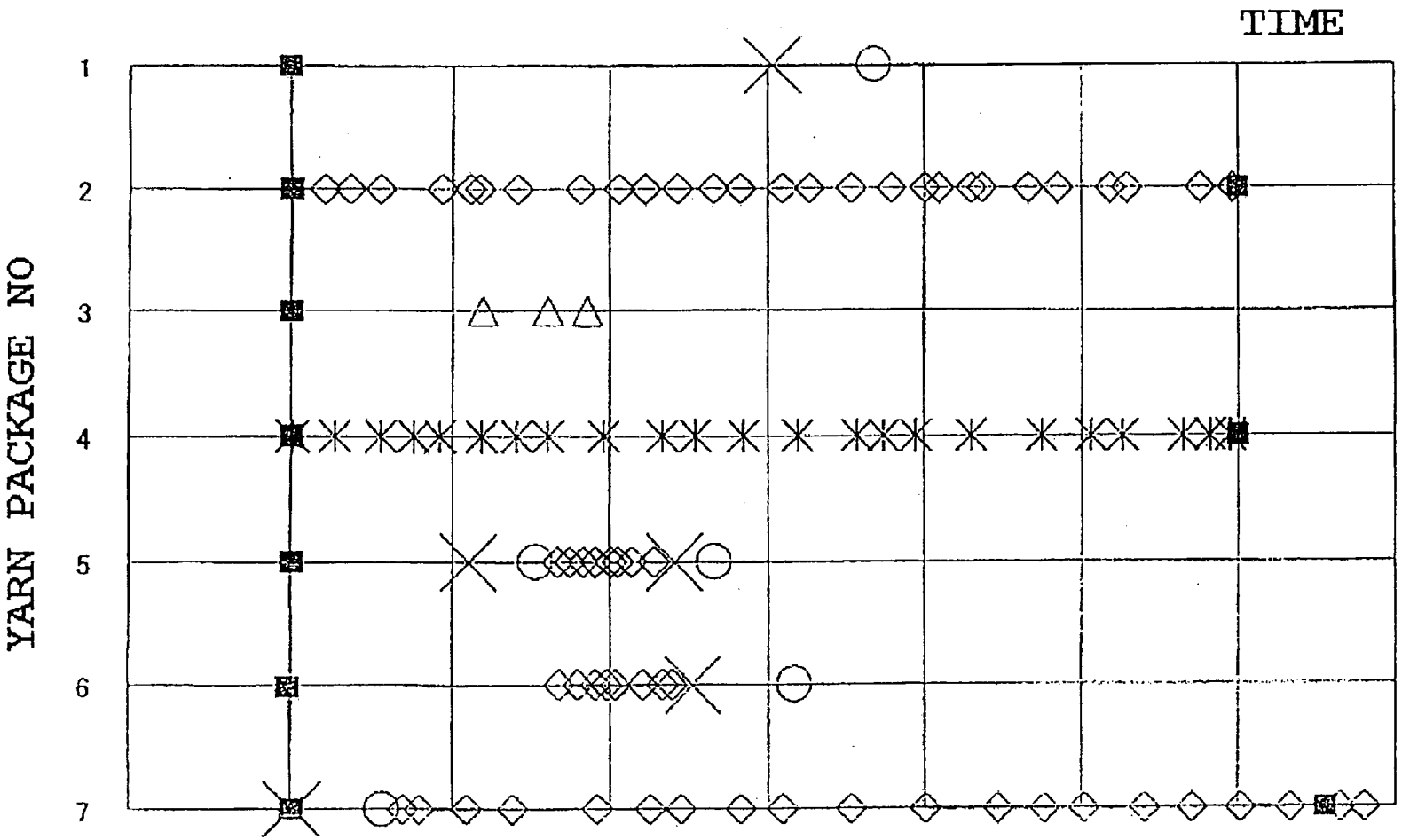
FIG. 19 is an explanatory diagram of a typical example chronologically expressing the distribution of the occurrences of a monitoring event by position in a fiber-texturing machine.

Next, the typical examples will be explained referring to FIG. 19 in which specific positions 1 to 7 constituting the false twist-texturing machine 200 are shown on the ordinate, and the distributions of the occurrences of monitoring events occurred during a prescribed period are shown chronologically on the abscissa. In FIG. 19, the numbers of the positions on the ordinate are expressed by serial numbers only for differentiating the positions for the sake of simplification of explanation. Further, in FIG. 19, the mark X expresses the time of the occurrence of yarn breakage, the mark ○ expresses the time of execution of threading, the mark ◇ expresses the time of the occurrence of the variation in tension not less than the prescribed value, the mark Δ expresses the time of the occurrence of a broken filament, the mark ■ expresses the occurrence of changeover of yarn packages P1 and P2, and the mark * expresses the time of the occurrence of the variation in characteristic value of U %, respectively. By chronologically expressing the distribution of the occurrences of the monitoring events, the information useful for management of the operation of the false twist-texturing machine 200 is obtained as shown below.

At first, on the position No. 1, the time (mark X) of the occurrence of yarn breakage and the time (mark ○) of the execution of the threading which is performed after the treatment of broken yarn are shown. Accordingly, the state of operation, the time of the execution of processing and the like of the position No. 1 can be understood immediately, and this is useful for carrying out process management. Further, from the state of occurrences of the events, the state of the operation of each position can be judged as shown below. On the position No. 2, the monitoring needed variations in tension (mark ◇) not smaller than the prescribed value occur frequently. However, the period of the occurrence is limited to the period separated with two points of time (mark ■) of changeover occurrence. Accordingly, the event is assumed to be attributable to the problem of tensions of the specific yarn package which have been supplied during the period, and the problem of the tension is judged to be attributable to yarn package itself, but not attributable to the false twist-texturing machine 200. Further, it is already known that such a variation in tension causes the problem of dyeing of textured yarn, and thereby it is obvious that the textured yarn package produced during the period should be treated as a quality defective product.

On the position No. 3, it is clear that, three times of the occurrence of broken filaments have been detected ubiquitously in a specific position, and the occurrence of broken filaments is not reproducible. From the state of the occurrences of broken filaments, it will be more possible that the cause of the occurrence of broken filaments exists not on the false twist-texturing machine 200 itself, but it exists on the yarn package itself. The reason is: if the false twist-texturing machine 200 itself has problems, the occurrence of a broken filament is repeated many times. Further, from the displayed information regarding the time of the occurrence of the broken filament, the information useful for quality control enabling the identification of the package of the textured yarn which is contaminated with the broken filaments or the like is obtained. Further, in the case where frequent occurrences are observed on a specific yarn package, it is judged that they are attributable to the problem of the yarn package supplied to the false twist-texturing machine 200. In such case, the yarn is cut compulsively at a certain point of time, the corresponding yarn package is changed over, and at the same time the packages of the textured yarn produced before that time are treated as defective goods; thus, productivity can be increased.

On the position No. 4, it is expressed that the variations (mark *) in a characteristic value of the U % have frequently occurred. Yet, the occurrences is limited in the period separated with two points of time (mark ■) of the occurrences of changeover same as on the position No. 2. From the same reason as on the position No. 2, it is found that the variations (mark *) in a characteristic value of the U % have occurred only on a specific yarn package. Accordingly, by investigating the history of the yarn package, it is possible to examine the cooling failure of the yarn Y occurred on a specific position of the spinning apparatus 100. Yet, the U % problem also causes the dyeing problem on textured yarn, and the packages of the textured yarn produced during the period must be treated as quality defective product.

On the position No. 5, after the occurrence of the first yarn breakage (the first mark X), the variations (mark ◇) in tension not less than the prescribed value frequently have occurred over a prescribed period from just behind the time (the first mark ○) of the execution of threading, and subsequently the yarn has been broken (the second mark X). And, it is clear that re-threading is performed again (the second mark ○) after the yarn breakage. Accordingly, the variations in tension (mark ◇) during the period are attributable to the fact that normal threading is not performed on the time of the first execution of threading (the first mark ○), and it can be judged that they have been caused by the threading miss of the worker, i.e. the fact that normal threading has not been performed. On the position No. 6, the variations (mark ◇) in tension not less than the prescribed value frequently have occurred suddenly in the course of false twist-processing, and subsequently the yarn has been broken (mark X). Accordingly, the problem that the sudden variations in tension (mark ◇) frequently occur and result in the breakage of the yarn (mark X) is estimated to be attributable to the problem of the false twist-texturing machine 200 itself. The present inventors studied the cause of the problem like this and found that the yarn Y is in the state where it had been off actually from the false twist-imparting unit 204. Yet, it is preferable to cut the yarn Y compulsively with a yarn cutting apparatus (not shown in the figure) immediately after the detection when the abnormal patterns are observed on the positions No. 5 and No. 6 , for the prevention of damage of the machine or the like, the spreading of the problem to the adjacent positions and the like. On the final position No. 7, the variations (mark ◇) in tension not less than the prescribed value have occurred frequently regardless the changeover of the yarn package (mark ■) and yet over a long period without resulting in yarn breakage. Accordingly, it is judged that this is not attributable to the problem of the yarn packages P1 and P2, but to the problem of the false twist-texturing machine 200 itself. In concrete terms, problems of processing devices, for example, the entanglement of thread craps of yarn breakage to the false twist-imparting unit 204, the getting dirty of a thread controlling guide of the first heating device 206, some problem occurred on thread guiding, or the like, is assumed to be the cause. Actually, the present inventors studied the causes of the pattern of the problem which occurred on the position No. 7, and found that the problem was caused by the stain on the thread passage controlling guide of the first heating device 206. Further, on the position No. 7, the yarn breakage (mark X) has occurred almost at the same time as the changeover (mark ■) of the yarn package. Accordingly, it is obvious that the yarn breakage has occurred related to change over the yarn packages P1 and P2.

Further, if the timing of the doffing of the yarn which has been processed by false twist-processing, that is, a textured yarn package is displayed besides the expression of FIG. 19, the yarn breakage occurred on this time can be judged to be attributable to the miss of the changeover of paper tubes, and such a display is effective for the analysis of the factors of yarn breakage. If the yarn breakage, whose causes are clear, frequently occurs on a certain position, a countermeasure can be elucidated for each factor, and this results in reduction of the rate of yarn breakage. Further, when the times of expression for the positions to be displayed are synchronized (concretely, plural positions which are operated at the same time on the same false twist-texturing machine 200 are parallelly displayed), problems common to all positions contained in the same false twist-texturing machine 200 can be detected, and this is effective for studying the causes of problem.

As explained above in detail, by chronological expression of the distribution of the occurrences of variations in tension not less than the prescribed value, it can be differentiated whether the cause of the problem exists on the side of the yarn packages of P1 and P2 or on the side of the false twist-texturing machine 200. Accordingly, when the above explanation is referred to, it is clear that the study of the cause becomes easy, and at the same time, when the information is combined with other monitoring events, information becomes more useful for operational management.

The management apparatus used for management of fiber-processing closely mentioned above will be explained in detail together with the flow of the treatments. Yet, the management method and the apparatus thereof in the present invention to be stated below is only one example, and the present invention is not limited to it. That is, needless to say, in the below mentioned embodiments, various kinds of alterations are applicable as far as the main points of the present invention are not changed.

In the present invention, the decentralized management unit 800 shown in FIG. 8 plays an important role. The decentralized management unit 800 is constructed commonly of plural decentralized management units 800 such as a microcomputer, corresponding to its processing capacity, and further it is linked to a high-ranked central management unit 900 common to the decentralized management units 800. Here, the complicated processing which needs relatively long time for processing, or the processing which has lower necessity of real-time processing are designed to be processed by the central management unit 900. The hierarchical structure like this realizes high speed processing for the items such as recording of data needing online processing. Further, an abovementioned decentralized management unite 800 outputs an interruption command at every constant period (every 10 milliseconds in the present example), and various devices for detecting the monitoring events are actuated by the interruption command to perform the below mentioned various processings. Now, the processings using the decentralized management units 800 and the central management unit 900 will be explained in detail based on a concrete example.

Figure 20:
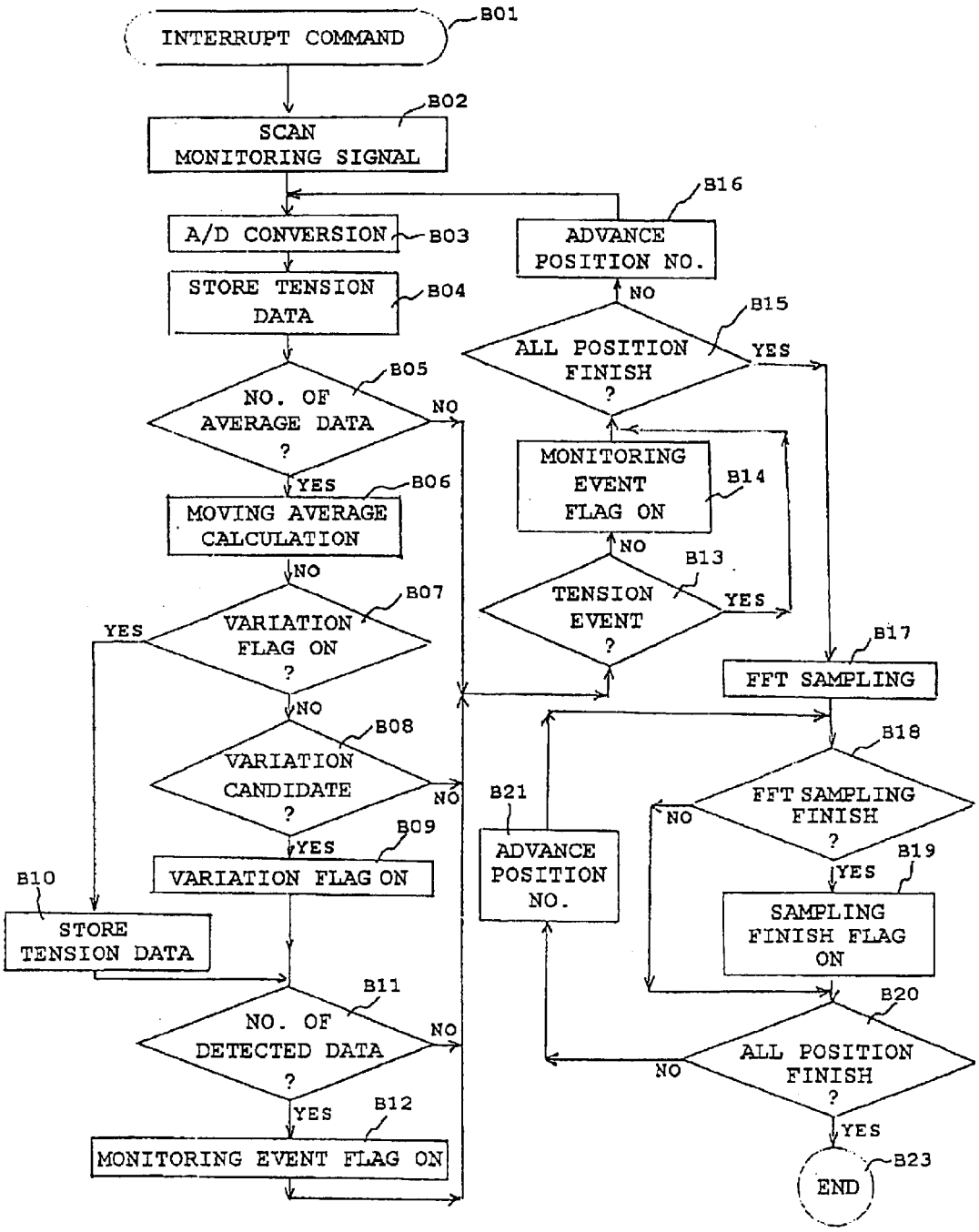
FIG. 20 is a flowchart exemplifying a task for collecting data in background processing by a decentralized management unit 800.
Figure 21:
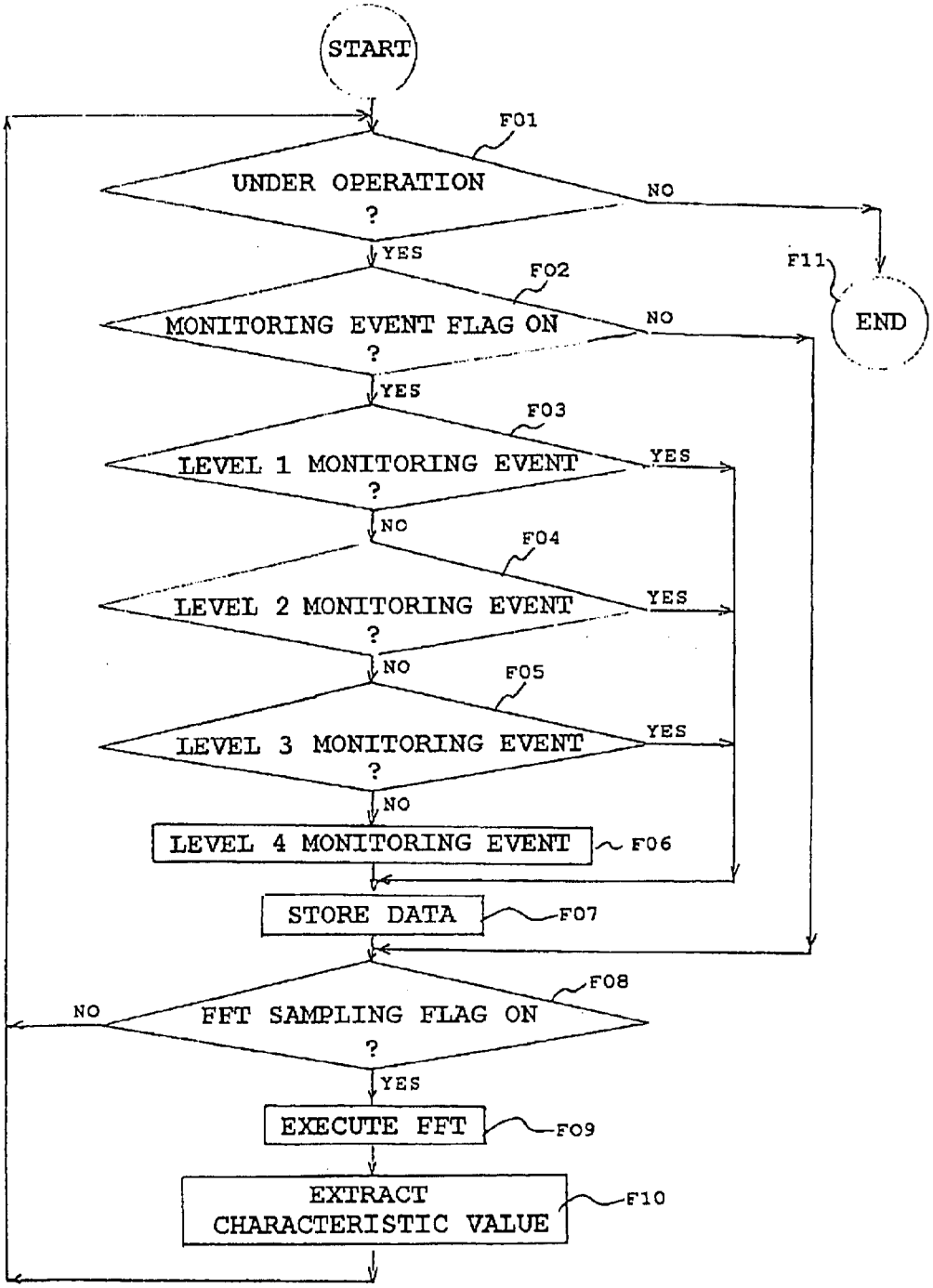
FIG. 21 is a flowchart exemplifying a task for collecting monitoring events in foreground processing by a decentralized management unit 800.

The decentralized management unit 800 executes processings consisting of the flowcharts shown in FIGS. 20 and 21. The processings are constituted so that two tasks of a background processing and a foreground processing are carried out at the same time. Here, a bar code reader (not shown in the figure) is connected to the decentralized management unit 800, and when a yarn package is set to the yarn supply device 201, the necessary information is read out from the bar cord of the management card attached to each yarn package. The bar cord information includes, for example, the management information of the fiber forming process in which the yarn package has been produced, in concrete terms, the fiber formation management information such as the production machine number, the position number, and the doffing number or the production time. Yet, in the present example, the input of the bar cord information is executed by reading out it with a bar cord reader (not shown in the figure), but a scanner or the like is also usable beside the bar code reader.

At first, in the background processing by the decentralized management unit 800, the data collection task shown in the flowchart of FIG. 20 is executed. In the data collection task, an interruption command (B01) is inputted at every constant period (every 10 milliseconds in the present example), and the data collection is performed by the abovementioned interruption command. Accordingly, by the interruption signal inputted at every 10 milliseconds, the decentralized management unit 800 goes into the step (B02) for scanning the monitoring signals for the occurrences of the monitoring events represented by the tension signal of the yarn, the changeover signal for the yarn packages, the broken filament detection signal, the start-up signal for a doffing apparatus 600 and the like, which have been detected online. In concrete terms, in the scanning step (B02), the tension signals detected by each tension detector 300, the changeover signal dispatched from each changeover detector 400 for the yarn package, the broken filament occurrence signal dispatched from each broken filament detector 500, and the doffing start up signal dispatched to each doffing apparatus 600 are scanned each as a monitoring event at a constant scanning interval for all positions in the management range of one decentralized management unit 800 in the false twist-texturing machine 200 to be monitored. Pieces of the information generated during the scanning period, for example, existences of the variation in tension, the changeover of the yarn packages, the broken filament of the textured yarn Y, the start-up of the doffing apparatus 600 and the like are clearly classified by position of the false twist-texturing machine 200, the results are read into the decentralized management unit 800, and the contents are stored together with the date & hour of the occurrence of the event and the serial number of the position on which the event has occurred.

Subsequently, the process proceeds into the step for collecting the tension data of each position detected by the tension detector 300, and tension data are collected as shown below. At first, the position No. 1 is set as the position number of the scanning device 313 in order to serially collect the data of tension of all the positions from the first position by the tension detector 300 placed on each position of the false twist-texturing machine 200. The process proceeds to the A/D conversion step (B03) for converting the detected analog tension signal to the digital signal, and the A/D conversion circuit 314 is directed to start the AJID conversion of the tension signal. By doing this, the A/D conversion of the tension signal, which is detected by the tension detector 300 placed on the position No. 1, is executed. The A/D-converted tension data are stored (B04) in a tension data storage area of a memory unit placed in the decentralized management unit 800. When the number of the tension data thus stored reaches the number (120 in the present invention) required to calculate the moving average value, the calculation of the moving average value is started. The judgment whether the number reached the prescribed number (120) is executed in the data number judging step (B05) or not. In the initial state where the uptaking of the tension data starts, the collection of 120 data is necessary in the present example, and so the time of 1.2 seconds is required before the processing reaches the stationary state where the number of data needed to execute the normal moving average value calculation has been obtained. When the number reaches 120, the judgment of the step (B05) becomes "Yes", the process goes into the abovementioned moving average value calculation step (B06), and the moving average value is calculated. In the tension data storage area of the decentralized management unit 800, the updated 120 data for every position are always stored to calculate a moving average value. When the moving average value is calculated in this manner, the obtained moving average value is stored as the comparative reference value for judging the existence of the variation in tension. Then, the process proceeds to the next step of the tension variation detection processing for detecting the existence of tension variation. On the contrary, when the number of data is less than 120, that is, in the case of "No", the process goes to the tension event judgment step (B13) until the number of data reaches 120 of the stationary state, and these processings are repeated until the number reaches 120.

In the abovementioned tension variation detection processing, it is designed to carry out the processing over a prescribed period (concretely, until the prescribed number of the tension data are uptaken) by judging whether or not the tension variation exists. Accordingly, it is necessary to detect the existence of the tension variation at first, and this is executed by judging whether the variation flag is ON or not (B07). In the initial state, the variation flag is reset at "No" which is the state of OFF. Accordingly, the variation flag is OFF in the initial state, and thereby the process goes to the variation candidate judgment-step (B08) where the state is "No" and the subsequent steps. After that, the background processing is carried out according to the processing procedure of FIG. 20. In the case of "Yes" where the variation flag is ON, the updated data regarding said position which have been stored in the abovementioned tension data storage step (B04) are stored in a tension variation data storage area (B10). Then, the number of the detected data is advanced by one, and the process proceeds to the next step (B12) for judging the number of detected data.

On the contrary, in the case of "No" where the variation flag is OFF, the process goes into the variation candidate judgment step (B08). In the variation candidate judgment step (B08), the kind of the monitoring events in which the tension variation is occurred is judged as shown below. At first, regarding the tension, the newest moving average value obtained by the calculation shown above is used as the comparative reference. Then, the value of the present tension collected in the A/D conversion step is compared with the comparative reference. In the case that there is a difference not less than the predetermined reference value (5 g or more in the present example), the judgment is "the existence of tension variation", and the process proceeds to the variation candidate judgment step (B08) for identifying the monitoring event which has become the cause of the occurrence of the tension variation like this. In the case of "Yes" indicating the existence of the variation candidate, the process goes into the step (B09) for setting the variation flag to ON, and the variation flag for said position is set to ON. Then, the newest data are stored in the tension variation data storage area, at the same time the number of the detected data is set to 1, and the process goes to the step (B11) for judging whether the next detection data reaches the prescribed number or not. On the contrary, in the case of "No" indicating the absence of the variation candidate, the process proceeds to the step (B13) for judging whether it is the tension event or not.

Next, in the abovementioned judgment step (B11) for the number of the detected data, it is judged whether the number of the stored data after the detection of the variation candidate reaches the prescribed number or not (in the present example, it is 500 corresponding to the interval of 5 sec) which is required to obtain the whole image of the variation. In the case of "No" where the number of the data is less than 500, the process goes to the tension event judgment step (B13) in the same manner as in the case of the absence of variation candidate. On the contrary, in the case of "Yes" where the number of the data reaches 500, the collection of the detected data for the variation candidate is finished, and at the same time the process enters to the step (B12) for setting up the monitoring flag at ON. Then, the monitoring flag is set at ON, and at the same time the tension data, the date of occurrence, the time of occurrence, the position on which the event occurred and the like which have been detected during the prescribed detection interval are stored in an event candidate storage area, and the process goes to the next tension event judgment step (B13).

In the tension event judgment step (B13), the data of the events such as the occurrence of changeover, the occurrence of broken filaments and the start-up of the doffing apparatus 600 which have been collected above are scanned, and the existences of the monitoring events other than the tension change such as the existence of the occurrence of changeover, the existence of the occurrence of broken filaments and the existence of the start up of the doffing apparatus 600 in said position are investigated. In the case of "No" where the occurrences of these monitoring events are not observed, the process proceeds to the step (B14) for setting up the monitoring event flag indicating the occurrence of the monitoring event at ON. In the step (B14), the monitoring event flag is set at ON, and at the same time the content of the monitoring events, that is, the occurrence of broken filaments, the occurrence of changeover, the occurrence of the start up of the doffing apparatus 600 and the like together with the date of the occurrence, the time of the occurrence, the serial number of the position on which the event has occurred and the like are stored in the event candidate storage area, and the process proceeds to the next step (B15) for judging the finish in all the positions. Yet, in the case of "Yes" in the abovementioned tension event judgment step (B13), the process immediately proceeds to the step (B15) for judging the finish in all the positions as shown in the figure.

In the step (B15) for judging the completion of all positions, whether the processing is finished in all the positions or not is judged by the reaching of the serial number of position to the final position number. In the case of "No" where it does not reach the final serial number, the process goes to the position number advancing step (B16), the position number is advanced by one, and the processing of the next position is executed. On the contrary, in the case of "Yes" where the position number is the final position number and the processing is finished in all the positions, the process goes to the next FFT sampling step (B17) for collecting the data for frequency conversion.

In the monitoring event detection means of the present example, the execution of the process in this way enables accurate detection of the tension variation not less than the prescribed value, which becomes a monitoring event, over the period of 5 min from 10 milliseconds, which is the time when the sampling of tension starts, to the time of the completion of the sampling. Further, the monitoring events can be classified, for example, into the occurrence of yarn breakage, threading, the occurrence of monitoring needed variation not less than the prescribed value, and the like, by an event classification means as mentioned below.

In the case where tension variation or any other monitoring event such as yarn package changeover, broken filament occurrence or start-up of a doffing apparatus is detected, the monitoring event flag is set to ON indicating the occurrence of remarkable events in the monitoring event-flag ON step (B12 and B14) shown in FIG. 20. At the same time, the necessary data (concretely, the serial number of the position, and the contents of the event, i.e. the existence of tension variation, the existence of changeover of the yarn packages, the existence of broken filament occurrence, the existence of starting-up of a doffing machine, and the like) are stored in the event candidate storage area.

When the processing is finished in all the positions, the process goes to the next FFT sampling step (B17) for collecting the data for frequency conversion. In the routine to collect the data for frequency conversion, the collection of tension signal data for all the positions needed for fast Fourier transformation (FFT) is executed. At first, in the FFT sampling step (B17), the newest data stored in the above-mentioned tension data storage area are serially scanned over all the positions, the results are stored in the FFT data storage area for each position. Yet, in the present example, the frequency range and the frequency resolution of fast Fourier transformation are properly changeable, and this enables the setting of the number of samplings, which is determined from the frequency region and frequency resolution corresponding to the object in order to collect data.

Accordingly, in the next step (B18) for judging the completion of FFT sampling, the completion is judged by whether the number of the data collected for each position reaches the set sampling number needed for fast Fourier transformation or not. When the position in which the number of the obtained data reaches the sampling number needed for the fast Fourier transformation becomes "Yes", the process proceeds to the step (B19) for setting the sampling finish flag to ON. And, in order to confirm the completion of the sampling of the data needed for fast Fourier transformation (FFT), the sampling completion flag of said position is set to ON. And, when all the positions become "Yes", i.e. finish in the all position-completion step (B20), the interruption processings of the background are finished (B23). When not all the positions are finished, the position number advancing step (B21) for advancing the position number by one is carried out, and the process returns to the judgment step (B18) for the completion of FFT sampling. Further, in the case where the number of data is short, the judgment for the position is "No", and the data are collected, but the sampling completion flag is not set to ON.

As explained above, in the background processing, the abovementioned processings are repeated for every 10 milliseconds to collect the data regarding the broken filament occurrence, the changeover of the yarn packages, the occurrence of the start-up of the doffing machine, the tension variation, FFT, and the like.

The processings shown above are executed on in the background. On the other hand, in the foreground, the following monitoring events collection tasks are always repeated while machines are operating. These processings will be explained in detail referring to the flowchart of FIG. 21.

In FIG. 21, in the step (F01) for judging a state under operation, it is confirmed whether the machine is operating or not by the existence of the signal or the like connected with the operation switch of the machine. Yet, when the machine is not operating because of routine inspection, maintenance, trouble, or the like, the processings are not executed. In the case of "Yes" where the machine is operating, the following processings are always repeated. At first, in the step (F02) for judging monitoring flag's ON, it is checked whether the monitoring event flag used in the abovementioned background processing is ON or not. In the case of "Yes" where the flag is set to ON, the process proceeds to the next judgment step (F03) for specifying the kind of the monitoring event such as tension variation not less than the prescribed value, the occurrence of yarn breakage, the execution of threading, the occurrence of changeover of the yarn packages, the occurrence of broken filaments, or the startup of the doffing machine, and in the case of "No" where the flag is not ON, the process goes to the fast Fourier transfer processing step (F08).

In the abovementioned step (F03) for judging monitoring events, the relevant data in the event candidate storage area which have been stored by the background processing are read out, and it is studied which of the monitoring events of Level 1 (that is, the changeover of the yarn packages, the occurrence of broken filaments, the start-up of the doffing machine, or the like) the detected event corresponds to. In the case of "Yes" where this event corresponds to any of the above events, the process proceeds to the data storage step (F07), and the contents of the monitoring events of Level 1 (concretely, a specific monitoring event such as the changeover of the yarn packages, the occurrence of broken filaments or the start up of the doffing machine, and the date of the occurrence, the time of the occurrence, the position of the occurrence and the like are relevant) are extracted, and they are stored in a monitoring event file placed in a storage device.

Regarding a set of these steps will be explained further in detail. In the case of "No" where the detected monitoring event does not corresponds to any of the monitoring events of Level 1, the event is considered as being a monitoring event (that is, tension variation) other than Level 1. Based on the 500 tension data collected in the background processings as mentioned above, processings (F04 to F06) for classifying all the detected monitoring events into any category, for example, the content of the monitoring event is classified into the monitoring event of Level 2 (in the present example, the occurrence of yarn breakage), the monitoring event of Level 3 (in the present example, the execution of threading), the monitoring event of Level 4 (in the present example, and the tension variation greater than the prescribed value). Yet, in the present example, the classification processing (F06) of the monitoring event (tension variation) of Level 4 uses the moving average value of the 120 tension data, in the same manner as the abovementioned moving average value calculation in the background. At first, in the step (F04) for judging the monitoring event (yarn breakage) of Level 2, for example, regarding the yarn breakage, it is judged that the yarn breakage has occurred when the moving average value is continuously smaller than a prescribed yarn breakage judgment value for a prescribed period of time. And, in the case of "Yes" where the monitoring event (yarn breakage) of Level 2 has occurred, the content of the monitoring event is specified as the monitoring event (yarn breakage) of Level 2, the process proceeds to the abovementioned data storage step (F07), and the relevant data are stored in the monitoring event file. In the present example, good results are obtained by setting the yarn breakage judgment value for 20 g and the prescribed period of time for 3 sec.

On the other hand, in the case of "No" where the occurrence of yarn breakage is absence and the moving average is greater than said yarn breakage judgment value, the process goes to the step (F05) for judging the monitoring event (threading) of Level 3. In the step (F05) for judging the monitoring event (threading) of Level 3, it is judged whether said tension variation is attributable to the execution of threading or not. The judgment is executed based on the moving average value, and the monitoring event is judged by whether the moving average value have varied from 0 to beyond a prescribed threading judgment value or not. In the present example, the threading judgment value is set for 20 g. When the moving average value exceeds 20 g, the cause of the yarn breakage is judged to be attributable to the execution of threading, and the time at which the moving average value becomes a stable state is considered as the time of the completion of threading. Here, the stable state is the case where the moving average value continuously exists within the variation width of 3 g for 5 sec, and the judgment is executed by this criterion. In the case where the cause is the execution of threading, the process proceeds to a threading time storage steps (not shown in the figure), and the threading execution time (concretely, the abovementioned threading finish time) is stored in a threading time storage area of the corresponding position. Thus, in the case of "Yes" in the step (F05) for judging the monitoring event (threading) of Level 3, the content of the monitoring event is judged as the occurrence of the monitoring event (threading) of Level 3, the process goes to the data storage step (F07) in the same manner as in the case of the occurrence of the monitoring event (yarn breakage) of Level 2, and the relevant data are stored. In the case of "No", the detected event is specified as the tension variation which is required to monitor the occurrence of the monitoring event (tension variation) of Level 4, the process proceeds to the abovementioned data storage step (F07), and the relevant data are stored (F07) in the monitoring event file in the same manner as in the abovementioned monitoring event of each Level. Accordingly, in the monitoring event file, the date of the occurrence, the time of the occurrence and the position of the occurrence of the monitoring event are stored, together with the contents of the monitoring event (the occurrence of the changeover of the yarn packages, the occurrence of broken filaments, the occurrence of yarn breakage, the execution of threading, the existence of the monitoring-needed variation which is greater than the prescribed value, or the like).

Further, in the step (F04) for judging the monitoring event of Level 2, in the case where the monitoring event is specified as the occurrence of yarn breakage, a yarn cutting signal is dispatched to a yarn cutting treatment apparatus (not shown in the figure) which cuts the yarn Y with a cutter (not shown in the figure) placed on the upstream side of the existing yarn feeding roller 202 to perform the yarn cutting treatment, and thus the aftertreatment for broken yarn is carried out. These processes are already explained referring to FIGS. 12–14.

Further, when the monitoring event (yarn breakage occurrence) of Level 2 are detected, the process proceeds to the step for classifying the yarn breakage as shown in FIG. 16, although the detail is not shown in the figure. At first, the process goes into a threading miss judgment step for classifying yarn breakages that have occurred immediately after threading (in other words, yarn breakage caused by working miss in threading). This judgment is performed by the comparison with the threading execution time that has been stored in the judgment step for the monitoring event (threading) of Level 3, that is, by judging whether the time of the occurrence of the yarn breakage is within a prescribed time or not (5 min in the present example) after execution of threading. In the case where the yarn breakage occurrence time is judged to be within the prescribed time by this judgment, the yarn breakage is classified into the category of yarn breakage caused by threading miss. Then, the process proceeds to the data storage step (F07) for storing the position number as one of the clarified causes of the yarn breakage and the yarn breakage occurrence time. On the contrary, in the case where the yarn breakage is judged that the occurrence time is not less than 5 min, and the cause of the yarn breakage is not threading miss, the process proceeds to the judgment step for further executing the classification of the causes of yarn breakage. In this step, it is judged whether said yarn breakage's cause is clarified or not, and the yarn breakage is classified by the judgment. The judgment is executed, in the present example, by investigating each state (concretely, the signal has been imputed or not) of the occurrence of the monitoring events (concretely, changeover of the yarn packages, the occurrence of broken filaments, the start-up of the doffing machine or the like) of Level 1 occurred within a prescribed time before the occurrence of the yarn breakage. In concrete terms, it is studied whether each causes of the yarn breakage has occurred within a prescribed time set separately for each event or not. Good results are obtained, in the present example, by setting the prescribed time to in the range of 0.6 to 1 sec for the yarn package changeover, 2 sec for the occurrence of broken filament, and 1 min for the start-up of the doffing machine. That is, in the present example, the yarn breakage is classified into the yarn breakages having clear cause, such as the yarn breakage attributable to the changeover when the changeover of the yarn packages have been observed in the range of 0.6 to 1 see before the yarn breakage occurrence time, the yarn breakage attributable to the occurrence of a broken filament when the broken filament is detected within 2 sec, and the yarn breakage attributable to doffing miss when the start up signal for the doffing machine has been inputted within 1 min before the yarn breakage occurrence time. Then, the process proceeds to the step (F07) for storing data, yarn breakage is differentiated as yarn breakage having clear cause, and then the position number, the occurrence time of yarn breakage, and the like are stored.

In the case of yarn breakages having unclear causes where the causes do not correspond to the abovementioned causes, the yarn breakage is differentiated as a yarn breakage having unclear cause, and the process goes to the data storage step (F07) to store the position number, the time of the yarn breakage occurrence, and the like. Through these processes, only the yarn breakage having unclear cause can be extracted, and this extraction is needed to control the wound-up shape in the yarn packages.

After the completion of the abovementioned processing, the process enters into the next step (F08) for executing the fast Fourier transformation (FFT). In the FFT processing step, at first, it is confirmed whether the FFT sampling needed for FFT is finished or not by the sampling completion flag in the step (F08) for judging the completion of the FFT sampling. In the case of "No" where the sampling is not finished, and the sampling completion flag is OFF, the process returns to the head step (F01) in the foreground processings. In the case of "Yes" where the sampling completion flag is ON, the process proceeds to the FFT execution step (F09), and the fast Fourier transformation (FFT) is executed for all of the positions on which the sampling is completed on this timing. Yet, for the fast Fourier transformation (FFT), the well-known fast Fourier transformation process is used. For processing this, a commercially available program can be used. When the FFT execution step (F09) is over, the step proceeds to the characteristic value extraction step (F10), and the characteristic value is extracted by using a characteristic value extraction means from the frequency distribution data obtained by the fast Fourier transformation. The relevant data including the data obtained in the characteristic value extraction step (F10) are stored in serial order in the characteristic value file installed in the storage device of the decentralized management unit 800. Yet, the characteristic value extraction means of the present example is designed to integrate the frequency components in the specific frequency area that has been set in advance and to store the obtained integral value as a characteristic value. Examples of the characteristic value mentioned above include U % characteristic value, OPU characteristic value, and roller problem. The U % characteristic value and OPU characteristic value are obtained by integrating the components in the first specific frequency domain 0.1 Hz to 0.3 Hz, whose correlation with the U % of the unevenness of yarn fineness in the yarn package mentioned above has been confirmed, and in the second specific frequency domain 0.6 Hz to 1.4 Hz, whose correlation with OPU, i.e. the index of the amount of the attached oil also has been conferred. The roller problem is obtained by integrating the components in the third specific frequency domain 0.38 Hz to 0.42 Hz centering the traverse frequency (0.04 Hz in the present example) of the yarn moving on the feed roller, which has a relation with the problem of the feed roller of the false twist-texturing machine. These characteristic values obtained above are stored in the characteristic value file together with the position number and the date & time when the characteristic values have been extracted. When the characteristic value extraction step (F10) is over, the process returned to the head step (F0I) of the processings, and the abovementioned processings are repeated.

In this way, the decentralized management unit 800 carries out the collection of the monitoring events such as broken filament occurrence time, occurrence time of changeover of yarn packages, occurrence time of yarn breakage, execution time of threading, and the time of the generation of tension variation not less than the prescribed value, and also carries out the extraction of characteristic values through fast Fourier transformation. These results are stored both in the monitoring event file and the characteristic value file.

On the other hand, the central management unit 900 takes out data from each decentralized management unit 800 at every prescribed time interval, and at the same time, the data of the position on which the occurrence of the changeover of the packages has been detected are recoded. When a distribution display request command is received from an operator console, a chronological distribution state of the monitoring events of each position and the like (refer FIGS. 15–19) are outputted to exhibit them on a display device or print them on paper by a printer. This will be explained in detail below based on the flowchart of FIG. 22.

Figure 22:
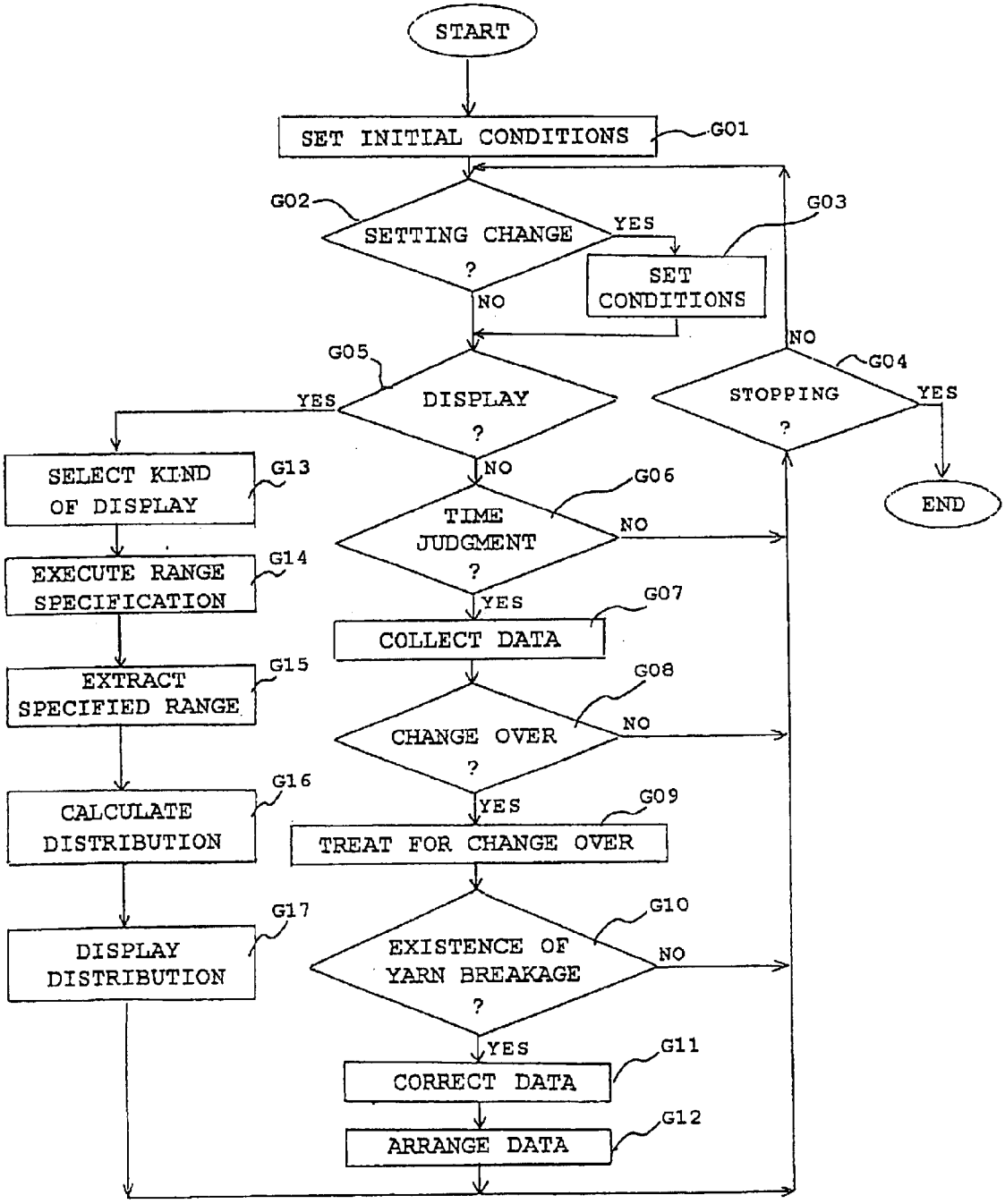
FIG. 22 is a flowchart exemplifying a central management processing by a central management unit.

At first, as shown in the flowchart of FIG. 22, the central management unit 900 is started up by the inputted command from an operator console or the like, and then, the process enters into the initial setting step (G01) to display an initial setting table. Then, the operator inputs the required data. The data required for the management such as the brands of the yarn packages to be treated on each machine, the data (in the present example, the unwinding speed and the processing speed of the yarn package, the wound diameter of the fully wound yarn package, the wound weight of full package, paper tube diameter, or the like) of each machine necessary to calculate the wound diameter of a yarn package, and the like are inputted. Yet, these input data are stored in a prescribed storage area of the central management unit 900. Next, the process proceeds to the judgment step (G02) for change requirement of setting. In this step (G02), the existence of the change requirement for changing the abovementioned initial setting values is examined. The central management unit 900 of the present example has a step (G04) for judging the existence of stop requirement of processing, and the process is designed so that, when the process has once started, processings are repeatedly executed without intermitting the processings unless the stop requirement exists. Accordingly, the above judgment step (G02) for judging the change requirement is set in order to perform to change the setting without stopping the machine. In the judgment step (G02), in the case of "No" where the setting change requirement is absent, the process immediately proceeds to the below mentioned judgment step for display. On the contrary, in the case of "Yes" where the setting change requirement is present, the process enters into the setting step for executing to change the setting. In the setting step, a setting change table of a prescribed format is displayed in the same manner as in the abovementioned initial setting step, and a necessary change, for example, the change associated with the brand change of a machine or the like is inputted. For example, it is examined whether an input exists or not, which is from the bar code reader for reading out various kinds of fiber forming information for the case where the yarn package is obtained at a fiber forming process (melt spinning process). When the input is detected, a yarn package file consisting of the necessary management item columns of said yarn package is formed in the storage area for managing the yarn package based on the inputted fiber forming information for management. Then, with the items of the abovementioned fiber forming management information, the machine number of the false twist-texturing machine 200 on which the yarn is set, the position number, or the like, are stored into said columns. Subsequently, the process enters into the step (G05) for judging the display which is carried out with a display means, and the existence of the distribution display command from the operator console is examined. In the case of "Yes" where the distribution display command exists, the process moves to the steps (G13 to G17) of distribution display processings. Yet, this processings will be mentioned later. On the other hand, in the case of "No" where the distribution display command is absent, the process goes to the next step (G06) for judging time. This step (G06) is installed for judging a reading-out time, because data stored in each decentralized management unit 800 are read out at every prescribed time-interval (i.e., prescribed cycle). Since the step (G06) is designed so that all the data (concretely, the cause data for monitoring event, time data for threading, data of yarn breakage having unclear cause, and the like) stored in each decentralized management unit 800 as mentioned above are read out and collected, the reading out time is judged by this step (G06). In the present example, the prescribed time is set for 2 min. In the case of "No" where the reading out time does not reach the prescribed time, the process returns to the initial step for judging the stop requirement.

On the other hand, in the case of "Yes" where the reading out time reaches the prescribed time, the process enters into the data collection step (G07). Then, all the data, which have been stored in each decentralized management unit 800 by the processings already shown referring to FIG. 20 and FIG. 21, are taken out and the data are stored in the storage device of the central management unit 900. Now, the position numbers corresponding to each decentralized management unit 800 are also stored by number that has been assigned to the decentralized management unit 800. Next, a variation event of yarn characteristics is extracted as a monitoring event, as shown below, based on the characteristic value obtained in the characteristic value extraction step (F10) shown in the flowchart of FIG. 21. That is, the mean value of the characteristic values related to the past normal operation is set as the standard value, and the characteristic value obtained by the characteristic value extraction step (F10) is compared with the standard value. When the difference is not less than the standard value (concretely, not less than two times the standard value), it is detected as a variation event of the yarn characteristic property, and the time of the occurrence is stored in the file assigned to said yarn package of said position together with the characteristic value as the occurrence of a monitoring event.

When the step (G07) is finished, subsequently the process enters into the judgment step (G08) for examining whether the occurrence of changeover of yarn packages exists or not in the data of monitoring events taken out from each decentralized management unit 800, and the position in which the changeover of the yarn packages exists is judged. In the case of "No" where the occurrence of changeover is absent, the process returns to the step (G04) for judging process stopping.

On the other hand, in the case of "Yes" where the occurrence of yarn package changeover is observed, the following changeover treating step (G09) is executed. In the changeover treating step (G09), at first, the time of the occurrence of the changeover is stored in the storage file of the yarn package which is under treatment in said position as completion time for processing, and the treatment of the yarn package is finished. At the same time, the storage file of said position is used as the storage file of the new yarn package which have started to supply yarn after the occurrence of changeover, and the time on which the changeover has occurred is recorded in the file as the processing start time. In this way, the changeover treating step (G09) is executed by detecting the changeover. In other words, the changeover treating step (G09) is executed for every changeover of the yarn package (that is, for every exchange of yarn package). Yet, in the changeover treating step (G09), the processing is executed for extracting management information such as the processing start time, the processing completion time, each monitoring event, the spinning apparatus 100 in fiber forming process, the number of the spinning position, and production lot number of said yarn package of said position, from the storage data of corresponding the position. Further, the data thus obtained are stored in the storage device of the central management unit 900. On this time, the package file of said yarn package of said position of said machine is set up, and each of the pieces of the management information is stored in each management information column formed in the file. Accordingly, in the central management unit 900, the management information necessary to manage yarn packages is stored in a file by yarn package.

Next, the process proceeds to the step (G10) for judging the existence of yarn breakage, and it is judged whether a yarn breakage having unclear cause is present or not on the yarn package P1 of processing finish of the position on which the changeover of yarn packages is observed. The judgment is executed by scanning the file of said yarn package obtained through the abovementioned changeover treating step (G09), and thereafter by examining the existence of the yarn breakage having unclear cause among the data. Here, in the case of "No" where the yarn breakage having unclear cause is absent, the process goes to the step (G04) for judging process stopping; and in the case of "Yes" where the yarn breakage having unclear cause is present, the process goes to the next data correction step (G11). Incidentally, the processing starting time and the processing finishing time which have been recorded in the data collection step (G07) are, as mentioned above, the times of the occurrence of changeover of the yarn packages which are detected by the changeover detector 400. Thereby, the yarn Y actually under processing at the time of detection is the yarn which has been supplied from the yarn package P1 before the changeover. Accordingly, the processing starting time of the yarn supplied from the new yarn package P2, and the processing finishing time of the yarn supplied from the yarn package P1 before the changeover are different from the actual starting time and the actual finishing time.

Then, the difference is corrected in the next data correction step (G11). In the data correction step (G11), the processing starting time and the processing finishing time are corrected as shown below so that they become the actual processing starting time and the actual processing finishing time, respectively. Since the yarn length (yarn processing length) corresponding to the length of time while the yarn is processed by the false twist-texturing machine 200 and also the processing speed are known, the correction is performed by adding the correction time obtained by dividing the yarn processing length by the processing speed to a change-over detection time. Then, the corrected times are overwritten as the actual processing starting time and processing finishing time. At the same time, the data related to the file of said yarn package P2 prepared by the storage device is also necessary to rewrite. That is, in the case where a monitoring event is detected after detection of the changeover of a yarn package, the occurred monitoring event is the event occurred for the old yarn package P1, but not the event occurred for the new yarn package P2 before the abovementioned correction time passes. Thereby, the monitoring events occurred during this time are extracted, therefore events are transferred from the file of the changeovered new yarn package P2 to the file of the old yarn package P1. The problem that the monitoring event detected as the occurrence of the changeover is assigned to which of the new yarn package P1 or the old yarn package P2, exactly speaking, should be also decided to be taken into consideration of the processing finish time for each processing event. However, it is sufficient enough to adopt the abovementioned judgment based on the processing start time, because it is easy in processing.

Further, in the data correction step (G11), the wound diameter conversion corrections of yarn packages are executed. That is, the points of the yarn breakages attributable to unclear cause are converted into the wound diameters of the yarn packages, and the occurrence points are serially determined. For example, in the present example, the abovementioned time corrections are applied to all yarn breakages having unclear cause in said yarn package, the processing finish time corresponding to the start of winding of the yarn package is set as the reference time, and it is determined how long before the reference time the yarn breakage has occurred. By converting each of the obtained times into a wound diameter using the paper tube diameter, the wound diameter of full package, the weight of full package, and the unwinding speed inputted at the initial setting, the points of the occurrence of the yarn breakage having unclear cause are determined in terms of the wound diameter of yarn package. In this way, the point of the broken yarn expressed by actual wound diameter of the yarn package is calculated, and the calculation is carried out in serial order on all yarn packages in which yarn breakages having unclear cause have occurred. Needless to say, the time during which processing is not operated, that is, from the occurrence of yarn breakage to threading, is corrected.

Next, the process enters into the data arrangement step (G12). In the data arrangement step (G12), in all the monitoring events which has occurred during the period from the processing start time to the processing finished time, the data are arranged for each monitoring event based on the file of the former yarn package P1 which has been decided by the abovementioned correction, that is, the processing start time is set as the reference time, and the time of each occurrence is chronologically arranged in the order of the elapsed time from the reference time. The obtained data are restored in the file of the former yarn package P1. By this process, each of the monitoring events is stored in the order of the occurrence in each of the yarn package files by using the processing start time as the reference time (concretely, this point as the starting point), and thereby the distribution display processing already shown referring to FIG. 18 becomes simple.

Subsequently, a position file is formed from the abovementioned yarn package file as shown below. That is, the position file in which the monitoring events occurred during a prescribed period are to be recorded by machine and by position in advance is installed in the central management unit 900. Necessary data are extracted from the yarn package file obtained above, and they are recorded serially in chronological order in the position file of the position during processing. Thus, in the position file, the contents and the occurrence times of all the monitoring events occurred in each position are stored chronologically. By this, the data arrangement processing is over. Resultingly, operational management databases consisting of yarn package files and position files are serially constructed. In said yarn package files, necessary management information regarding the most nearly processed yarn packages are recorded by yarn package in a prescribed format. In said position files, all monitoring events occurred during the prescribed period are recorded for each position.

Incidentally, in the case where the display request commands are inputted from the abovementioned keyboard of an operator console or the like (that is, in the case where the judgment step (G05) for the display is "Yes" in FIG. 22), the processings by a display means is performed as shown below.

At first, in the step (G13) for selecting the kind of display, the kind of display is selected from display by position, display by yarn package, display of the converted wound diameter, and the like, and thereafter the process proceeds to the range specification step (G14). Then, a range specification table having a format which can specify the range of the lot number of yarn package, machine number, position number, or the like is expressed on a display device such as a liquid crystal display device of the central management unit 900. Then, following the instruction on the display, an operator specify the range by inputting the period or the like of the lot number of yarn package, the machine number, the position number or the like, which are intended to be displayed. Then, the process goes to the step (G15) for extracting specified ranges, and the data of the monitoring events whose range of lot numbers in yarn package, range of position numbers, and processing period are each specified are read out from the yarn package files, the position files, or the like. Further, in order to subject the data thus to read out from each file for the statistical processing, the process enters next into the step (G16) for calculating the chronological distribution of occurrence of monitoring events. Through these processes, finally in the distribution display step (G17), the chronological distribution of the occurrence in said position is outputted and displayed on a liquid crystal display device or the like. Yet, the examples of this display already have been explained in detail referring to FIG. 17 to FIG. 19, and the explanation is omitted here.

Above, in the present examples, the processings have been executed by a management apparatus system consisting of detection devices and microcomputers; however, the processings using the central management unit can be executed offline. Further, the waveforms of tension variation and the waveforms of the results of fast Fourier transformation can be displayed on graph, and can be analyzed further in detail.

Industrial Field of Application

As mentioned above, the present invention enables the classification of the occurred monitoring events into troubles attributable to yarn package side factors and the troubles attributable to fiber-processing machine side factors by detecting the monitoring events occurred under processing, during fiber-texturing process and displaying the occurrences of the monitoring events at every position in chronological distribution of occurrence. Accordingly, the present invention can provide the data necessary for management of fiber-processing machine and management of yarn package to be treated by the machine, and thus largely contributes for stable operation of the fiber-processing machine and for improvement of productivity.

Further, by displaying the chronological distribution of occurrences of the specific monitoring events by yarn package, the data useful to examine the causes of the problem of the yarn to be treated can be obtained, and this has a large effect on improvement of collective productivity including the yarn production process.

As mentioned above, the present invention largely contributes to manufacturing of textured yarn, further to process stabilization for manufacturing textured yarn and to improvement of productivity.

What is claimed is:

1. A management method for fiber-processing comprising the steps of:

(a) selecting a plurality of monitor needed events including at least a tension variation of a yarn during fiber texturing in order to manage processing conditions of the yarn which is wound up as a yarn package in a fiber forming process, wherein the tension variation is identified as a large variation of a tension level of the texturing yarn or a tension variation having an abnormal behavior different from the behavior under normal processing, (b) supplying the yarn to at least one position of a fiber texturing machine, (c) monitoring the selected monitoring events, (d) detecting an occurrence of the monitoring events, (e) chronologically storing the occurred monitoring event with data to identify an occurred moment of the monitoring event for each yarn package during fiber-processing and/or for each position of the fiber texturing machine during fiber-processing and (f) managing the fiber-texturing process or the fiber texturing machine by the stored data.

2. The management method for fiber-processing set forth in claim 1 further comprising the step of classifying the monitoring events owing to said tension variation into each factor such as yarn breakage, threading, changeover of yarn package, and monitoring needed variation based on said stored data of the measured yarn tension.

3. The management method for fiber-processing set forth in claim 1 further comprising the steps of:

detecting the yarn tension during fiber-processing, converting a measured tension signal of said yarn into a digital signal from an analog signal at a prescribed sampling cycle, regarding the measured tension data of the converted signal, calculating a moving average value for a prescribed number of the most newly measured tension data, and setting the calculated moving average value as a management criterion, and detecting the tension variation as one of the monitoring events based on tension variation in the case that the newest tension datum is not less than the management criterion when compared.

4. The management method for fiber-processing set forth in claim 1 further comprising the steps of:

detecting the yarn tension during fiber-processing, converting a measured tension signal of said yarn into a digital signal from an analog signal at a prescribed sampling cycle, subjecting said digital signal to Fourier transformation at a prescribed time interval, and thereby transforming said digital signal into space signal in frequency domain, obtaining a characteristic value from predetermined frequency components of the space signal in said frequency domain, comparing the obtained characteristic value with a pre-set management criterion, and detecting the characteristic value as one of the monitoring events based on characteristic value variation in the case that the compared value is not less than the pre-set management criterion.

5. The management method for fiber-processing set forth in claim 1 further comprising the steps of:

placing plural yarn packages for each position of the fiber texturing machine, and detecting a changeover of the yarn packages as one of the monitoring events, wherein when yarn supply from one of the yarn packages is completed, the changeover is carried out so that the yarn can be continuously supplied to the fiber texturing machine from a new yarn package of said yarn packages.

6. The management method for fiber-processing set forth in claim 1, wherein the start-up of a doffing machine for doffing a textured yarn package during fiber-processing and/or a broken filament having occurred to the yarn during fiber-processing is identified as one of the monitoring events.

7. The management method for fiber-processing set forth in claim 1, wherein the yarn breakage occurred to the yarn during fiber-processing is identified as one of the monitoring events, wherein the position of the yarn breakage is determined by calculation based on a occurred moment of the yarn breakage, a passing moment that a end of the broken yarn passes through a predetermined reference point, and a processing speed of the yarn.

8. The management method for fiber-processing set forth in claim 1 further comprising the steps of:

detecting a starting moment of fiber-processing of the yarn supplied from the yarn package, and obtaining a wound position of the yarn package at the occurred moment of a yarn breakage based on the starting time of fiber-processing.

9. The management method for fiber-processing set forth in claim 1, wherein regarding a yarn breakage occurred as one of the monitoring events in the fiber-texturing process, the occurred moment of the yarn breakage is determined as a wound position from the start position of winding of each yarn package.

10. The management method for fiber-processing set forth in claim 9, wherein, related to plural yarn packages obtained under the same conditions in the fiber forming process before the fiber-texturing process where said packages are supplied, yarn breakages occurred in the fiber-texturing process are totalized by the wound position, and the totalized result is outputted as an occurrence distribution of yarn breakages in terms of wound positions.

11. The management method for fiber-processing set forth in claim 1 further comprising the steps of:

monitoring online yarn breakages occurred during fiber-processing as the monitoring event, classifying the yarn breakages occurred in a predetermined period into the yarn breakages having clear causes and the yarn breakages having unclear causes, and outputting the result of the classified data after statistical processing.

12. The management method for fiber-processing set forth in claim 1, wherein when said yarn breakage having an unclear cause occurred, the point of the yarn breakage is determined.

13. The management method for fiber-processing set forth in claim 1, wherein the method has an operational management database comprising a position file for recording the monitoring events occurred for each position of the fiber texturing machine and a yarn package file for recording the monitoring events occurred for each yarn package.

14. The management method for fiber-processing set forth in claim 1 further comprising the steps of:

referring to said operational management database, arranging and classifying the monitoring events occurred by position and/or by yarn package and/or statistically processing the monitoring events, and outputting the result.

15. The management method for fiber-processing set forth in claim 1 further comprising the steps of:

processing the data online in accordance with an occurrence of the monitoring event, executing the analytical and/or statistical processing that is relatively time consuming, and/or executing a processing that is not required high-ranked processing or immediate processing.

16. The management method for fiber-processing set forth in claim 1, wherein the fiber-texturing process is at least one out of a false twist-texturing process, a draw texturing process, and a yarn twist-texturing process.

17. A management apparatus for fiber-processing comprising:

a monitoring event detector placed in each position of a fiber texturing machine for detecting monitoring events selected so as to monitor processing conditions of texturing yarn under processing in each position of a fiber texturing machine, and the monitoring event detector further comprises at least a tension detector placed at a reference point for detecting at least a tension variation of the moving yarn tension by touching the moving yarn, wherein the tension variation is identified as a large variation of a tension level of the texturing yarn or a tension variation having an abnormal behavior different from the behavior under normal processing, a scanning device for scanning every position of the fiber texturing machine to be monitored in order to detect an occurrence of the monitoring events by the monitoring event detector in each position, and a management device for chronologically storing the detected result of the monitoring events during fiber-processing by yarn package or by position of the fiber texturing machine together with data to identify the occurred moment of the monitoring events while a yarn supplied from the yarn package is processed.

18. The management apparatus for fiber-processing set forth in claim 17, wherein said monitoring event detector comprises a broken filament detector for detecting broken filaments occurring during processing.

19. The management apparatus for fiber-processing set forth in claim 17, wherein said management device comprises a yarn-breakage-point measuring device for detecting a yarn breakage as one of the monitoring event during yarn the fiber processing, wherein said yarn-breakage-point measuring device further comprises:

a tension detector placed at a reference point for detecting the tension of a moving yarn by touching the moving yarn, a broken yarn end passage detector for detecting the first moment of a yarn breakage occurrence based on a tension signal detected by the tension detector when the moving yarn broke, a yarn breakage occurrence detector for detecting the second moment that a broken end of the yarn passes through the reference point based on the tension signal, and a yarn-breakage-point detector for detecting a broken point of the yarn based on the first and second moments.

20. The management apparatus for fiber-processing set forth in claim 17, wherein said management device comprises a tension detector for detecting a yarn tension during processing and a Fourier transformer for transforming a tension signal detected by the tension detector into a space signal in a frequency domain by Fourier transformation at a prescribed time interval, and a characteristic value extractor for extracting a characteristic value from signal components in a predetermined specific frequency domain regarding the Fourier transformed space signal, and a monitoring event detector for detecting the extracted characteristic value as one of the monitoring events in the case that a variation of the characteristic value is not less than a predetermined managing criterion when the extracted characteristic value is compared with the managing criterion.

21. The management apparatus for fiber-processing set forth in claim 20, wherein said Fourier transformer further comprises an A/D (analog/digital) converter for converting the tension signal into digital signal from analog signal, a storage device for storing digitized tension signal in at least a prescribed time interval, and a fast Fourier transformer for transforming the tension signal that is stored during a prescribed time at a prescribed time interval into a space signal in a frequency domain by fast Fourier transform technique.

22. The management apparatus for fiber-processing set forth in claim 17, wherein the monitoring event detector equips with a yarn package changeover detector for detecting a changeover of the yarn package, wherein a crossing yarn is formed respectively by tying a tail yarn of the yarn package (P1) with a lead yarn of the yarn package (P2), which is placed on a yarn supply device in each position of the fiber texturing machine, so that the yarn is continuously supplied for fiber-processing.

23. The management apparatus for fiber-processing set forth in claim 22, wherein said yarn package changeover detector is a detector for detecting the traveling of a crossing yarn engaged in a loosened state after the crossing yarn gets tightened corresponding to the changeover.

24. The management apparatus for fiber-processing set forth in claim 23 further comprising an engaging member movable freely in order to engage the crossing yarn in a loosened state and to isolate the crossing yarn from a ordinary position of a yarn supply, and a movement detector for detecting the movement of the engaging member in accordance with the traveling of the tightened crossing yarn.

25. The management apparatus for fiber-processing set forth in claim 24, wherein said movement detector is a limit switch or a photoelectric detector.

26. The management apparatus for fiber-processing set forth in claim 22, wherein said managing device executes a corrective calculation of a start time and a completed time of the fiber-processing for each yarn package before and after the changeover based on the detected changeover signal from the yarn package changeover detector.

27. The management apparatus for fiber-processing set forth in claim 22, wherein said managing device comprises a mean for calculating a winding point from the start of winding of the yarn package based on the detected changeover signal from the yarn package changeover detector.

28. The management apparatus for fiber-processing set forth in claim 17, wherein the management apparatus has a interface circuit for up-taking a start-up signal generated by a start-up of a doffing apparatus in order to doff a textured yarn package obtained by the fiber-processing and/or for up-taking a detected signal of the monitoring event from the monitoring event detector.

29. The management apparatus for fiber-processing set forth in claim 17, wherein said managing device further comprises:

an A/D (analog/digital) converter for converting a yarn tension signal measured by a tension detector into digital signal from analog signal at a prescribed sampling cycle, and a moving average value calculator for calculating a moving average value for a prescribed number of updated measured tension data regarding the converted measured tension data.

30. The management apparatus for fiber-processing set forth in claim 29, wherein the managing device further comprises a means for detecting a tension variation as the monitoring event, wherein the updated moving average value obtained by the moving average value calculator is set as the managing criterion, and thereby the newest measured tension datum taken up from the A/D converter is not less than the managing criterion when compared.

31. The management apparatus for fiber-processing set forth in claim 17, wherein said managing device further comprises a yarn breakage classification means for classifying a yarn breakage occurred in the fiber texturing machine into the yarn breakage having a clear cause or the yarn breakage having an unclear cause occurred by unclear cause.

32. The management apparatus for fiber-processing set forth in claim 17, wherein said managing device further comprises a-an operational management database having a position file for recording the monitor events occurred for each position of the fiber texturing machine and a yarn package file for recording the monitoring events occurred for each yarn package.

33. The management apparatus for fiber-processing set forth in claim 32, wherein said monitoring device further comprises an output device for outputting the result obtained by arranging and classifying the monitoring events occurred position by position and/or yarn package by yarn package, and/or by statistically processing the monitoring events referring to said operational management database.

34. The management apparatus for fiber-processing set forth in claim 33, wherein said statistical processing is an arithmetic processing regarding a chronological distribution of the occurrence of the monitoring events and/or an arithmetic processing regarding an occurrence distribution of the occurred points of the yarn breakages in the fiber texturing machine.

35. The management apparatus for fiber-processing set forth in claim 17, wherein said managing device further comprises:

a decentralized management unit for processing the data from the monitoring event detector by online processing, and a central management unit for executing an analytical and/or statistical processing that is relatively time consuming, and/or for executing a processing that is not required high-ranked processing or immediate processing.

36. The management apparatus for fiber-processing set forth in claim 17, wherein the fiber texturing machine is at least one out of a false twist-texturing machine, a yarn twist-texturing machine, and a draw texturing machine.

* * * * *